US010881257B2

(12) United States Patent
Kim et al.

(10) Patent No.: US 10,881,257 B2
(45) Date of Patent: Jan. 5, 2021

(54) CLEANER AND METHOD FOR CONTROLLING CLEANER

(71) Applicant: Samsung Electronics Co., Ltd, Gyeonggi-do (KR)

(72) Inventors: Byung Chan Kim, Gyeonggi-do (KR); Kyung Han Jeong, Gyeonggi-do (KR); Shin Kim, Gyeonggi-do (KR); Won Min Lee, Gyeonggi-do (KR); Eun Sung Kim, Gyeonggi-do (KR); Sang Sik Yoon, Gyeonggi-do (KR); Byoung In Lee, Gyeonggi-do (KR); Woo Ram Oh, Gyeonggi-do (KR); Yeon Kyu Jeong, Gyeonggi-do (KR); Jae Young Jung, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 502 days.

(21) Appl. No.: 15/101,410

(22) PCT Filed: Dec. 2, 2014

(86) PCT No.: PCT/KR2014/011717

§ 371 (c)(1),
(2) Date: Jun. 2, 2016

(87) PCT Pub. No.: WO2015/084031

PCT Pub. Date: Jun. 11, 2015

(65) Prior Publication Data

US 2016/0302636 A1 Oct. 20, 2016

Related U.S. Application Data

(60) Provisional application No. 62/046,336, filed on Sep. 5, 2014, provisional application No. 62/049,579, filed on Sep. 12, 2014.

(30) Foreign Application Priority Data

Dec. 2, 2013 (KR) ..... 10-2013-0148643
Dec. 2, 2014 (KR) ..... 10-2014-0170225

(51) Int. Cl.
*A47L 9/28* (2006.01)
*A47L 5/28* (2006.01)
(Continued)

(52) U.S. Cl.
CPC ..... *A47L 9/2826* (2013.01); *A47L 5/28* (2013.01); *A47L 5/30* (2013.01); *A47L 9/009* (2013.01);
(Continued)

(58) Field of Classification Search
CPC . A47L 9/325; A47L 5/28; A47L 9/009; A47L 9/2805; A47L 5/30; A47L 11/4075; A47L 11/4066; A47L 11/4061
(Continued)

(56) References Cited

U.S. PATENT DOCUMENTS 3,220,043 A * 11/1965 Lampe ..... A47L 5/34 15/340.2
3,618,687 A * 11/1971 Ripple ..... A47L 5/30 180/19.3
(Continued)

FOREIGN PATENT DOCUMENTS

CN 1768688 A 5/2006
CN 101198275 A 6/2008
(Continued)

OTHER PUBLICATIONS

Yoneyama, Akihiro; "Self-running Vacuum Cleaner", Nov. 1995, JP-07308272—Machine Translation (Year: 1995).*
(Continued)

*Primary Examiner* — David G Cormier
*Assistant Examiner* — Thomas Bucci

(57) ABSTRACT

The present disclosure includes a main body, a cleaning tool assembly connected to the main body to be movable in at least one axial direction, a handle part connected to the main body and configured to receive an applied force of a user, a detection part provided in the handle part and configured to detect a magnitude and a direction of the force applied to the handle part, and a control part configured to control the movement direction of the cleaning tool assembly based on the detected direction of the force and to control the movement distance of the cleaning tool assembly based on the detected magnitude of the force. In this way, the steering performance may be improved by reducing a horizontal load felt by a user when the user holds and moves the handle of the cleaner, fatigue felt when performing the cleaning operation may be removed by removing a vertical load applied by the handle, and convenience may be improved.

10 Claims, 59 Drawing Sheets

(51) Int. Cl.

| | |
|---|---|
| ***A47L 9/32*** | (2006.01) |
| ***A47L 5/30*** | (2006.01) |
| ***A47L 9/00*** | (2006.01) |
| ***A47L 9/04*** | (2006.01) |
| ***A47L 9/16*** | (2006.01) |
| ***A47L 9/26*** | (2006.01) |

(52) U.S. Cl.
CPC ..... *A47L 9/0477* (2013.01); *A47L 9/1683* (2013.01); *A47L 9/26* (2013.01); *A47L 9/2805* (2013.01); *A47L 9/2847* (2013.01); *A47L 9/2852* (2013.01); *A47L 9/2857* (2013.01); *A47L 9/322* (2013.01); *A47L 9/325* (2013.01)

(58) Field of Classification Search
USPC ... 15/340.2, 410, 319, 339, 320, 329, 340.1, 15/351; 134/18, 6, 21; 74/557
See application file for complete search history.

(56) References Cited

U.S. PATENT DOCUMENTS

| | | | | | |
|---|---|---|---|---|---|
| 3,896,892 | A * | 7/1975 | Kohls | B62D 51/002 | 180/19.2 |
| 3,938,216 | A * | 2/1976 | Schmitz | A47L 9/325 | 15/340.2 |
| 4,249,281 | A * | 2/1981 | Meyer | A47L 5/30 | 15/340.2 |
| 4,615,071 | A * | 10/1986 | Frohbieter | A47L 9/2842 | 15/340.2 |
| 4,624,027 | A * | 11/1986 | Martin | A47L 9/32 | 15/340.2 |
| 5,339,916 | A * | 8/1994 | Louis | A47L 5/28 | 15/340.2 |
| 5,504,971 | A * | 4/1996 | McCormick | A47L 5/30 | 15/340.2 |
| 6,061,869 | A * | 5/2000 | Ettes | A47L 5/28 | 15/319 |
| 6,108,862 | A * | 8/2000 | Frederick | A47L 5/28 | 15/340.2 |
| 7,062,816 | B2 * | 6/2006 | Kasper | A47L 11/30 | 15/320 |
| 7,421,758 | B2 * | 9/2008 | Kim | A47L 9/0427 | 15/319 |
| 7,487,569 | B2 * | 2/2009 | Zahuranec | A47L 5/28 | 15/340.2 |
| 7,725,223 | B2 * | 5/2010 | Gordon | A47L 9/2842 | 701/23 |
| 8,082,624 | B2 * | 12/2011 | Myers | A47L 5/28 | 15/411 |
| 8,186,009 | B2 | 5/2012 | Smith et al. | | |
| 8,752,237 | B2 | 6/2014 | DeJonge | | |
| 8,959,708 | B2 | 2/2015 | Ventress et al. | | |
| 2004/0134018 | A1 * | 7/2004 | Conner | A47L 9/2852 | 15/339 |
| 2004/0134020 | A1 * | 7/2004 | Conner | A47L 9/325 | 15/340.2 |
| 2004/0135537 | A1 * | 7/2004 | Conner | A47L 9/2842 | 318/701 |
| 2005/0029971 | A1 * | 2/2005 | Coates | A47L 11/4088 | 318/400.38 |
| 2005/0071056 | A1 * | 3/2005 | Tondra | A47L 9/2805 | 701/23 |
| 2006/0156505 | A1 * | 7/2006 | Kim | A47L 9/325 | 15/319 |
| 2006/0218742 | A1 * | 10/2006 | Lim | A47L 9/009 | 15/340.2 |
| 2007/0039122 | A1 * | 2/2007 | Zahuranec | A47L 9/2842 | 15/340.2 |
| 2007/0061058 | A1 * | 3/2007 | Gordon | A47L 9/2863 | 701/23 |
| 2007/0094839 | A1 * | 5/2007 | Zahuranec | A47L 5/30 | 15/328 |
| 2007/0136979 | A1 * | 6/2007 | Zahuranec | A47L 9/2842 | 15/319 |
| 2009/0056056 | A1 * | 3/2009 | Liebig | A47L 5/30 | 15/347 |
| 2009/0094780 | A1 * | 4/2009 | Jansen | A47L 9/0494 | 15/320 |
| 2009/0133215 | A1 * | 5/2009 | Zahuranec | A47L 9/325 | 15/415.1 |
| 2012/0060322 | A1 * | 3/2012 | Simonelli | A47L 9/009 | 15/411 |

FOREIGN PATENT DOCUMENTS

| | | | |
|---|---|---|---|
| CN | 101263996 | A | 9/2008 |
| CN | 101843462 | A | 9/2010 |
| CN | 102028428 | A | 4/2011 |
| CN | 102188214 | A | 9/2011 |
| CN | 102652656 | A | 9/2012 |
| EP | 1683458 | A2 | 7/2006 |
| JP | 07308272 | A * | 11/1995 |
| JP | H 07-308272 | | 11/1995 |
| JP | H07308272 | A | 11/1995 |
| JP | 2006-240361 | | 9/2006 |
| KR | 10-2006-0064330 | | 6/2006 |
| KR | 10-0602226 | | 7/2006 |
| WO | WO 99/07272 | A1 | 2/1999 |
| WO | 2011/036615 | A1 | 3/2011 |

OTHER PUBLICATIONS

European Patent Office, "Supplementary European Search Report," Application No. EP 14 86 8103, dated Jul. 18, 2017, 7 pages.
Office Action dated Apr. 2, 2018 in connection with Chinese Patent Application No. 201480074656.6.
International Search Report dated Feb. 27, 2015 in connection with International Application No. PCT/KR2014/011717, 4 pages.
Written Opinion of the International Searching Authority dated Feb. 27, 2015 in connection with International Application No. PCT/KR2014/011717, 16 pages.
Notification of Fulfilling of Registration Formality dated Oct. 12, 2018 in connection with Chinese Patent Application No. 201480074656.6, 5 pages.
Communication pursuant to Article 94(3) EPC dated May 18, 2020 in connection with European Patent Application No. 14 868 103.4, 4 pages.

* cited by examiner (a)

(b)

CLEANER AND METHOD FOR CONTROLLING CLEANER

CROSS-REFERENCE TO RELATED APPLICATION(S)

The present application claims priority under 35 U.S.C. § 365 to International Patent Application No. PCT/KR2014/011717 filed Dec. 2, 2014, entitled "CLEANER AND METHOD FOR CONTROLLING CLEANER", and, through International Patent Application No. PCT/KR2014/011717, to Korean Patent Application No. 10-2013-0148643 filed Dec. 2, 2013, U.S. Provisional Application No. 62/046,336 filed Sep. 5, 2014, U.S. Provisional Application No. 62/049,579 filed Sep. 9, 2014, and Korean Patent Application No. 10-2014-0170225 filed Dec. 2, 2014, each of which are incorporated herein by reference into the present disclosure as if fully set forth herein.

TECHNICAL FIELD

The present disclosure relates to a cleaner and a method of controlling the same, and more particularly, to a cleaner for improving navigation performance and convenience and a method of controlling the same.

BACKGROUND ART

A cleaner is an apparatus to clean an indoor space by removing foreign substances therein, and a vacuum cleaner is commonly used in homes generally. The vacuum cleaner suctions in air using a suction force of a blower device and then separates foreign substances in the suctioned air by a device such as a filter to clean the indoor space, and the vacuum cleaner is mainly classified as a canister type and an upright type.

Of the above, the canister type cleaner has a main body in which a blower device, a dust collecting device, and the like are embedded, a suctioning body installed to be separated from the main body in order to suction in dust on a floor, and a connection tube that connects the main body to the suctioning body and has a handle installed thereon. Consequently, a user performs cleaning while holding the handle of the canister type cleaner and moving the suctioning body in a direction for cleaning.

On the other hand, the upright cleaner has an upright type main body, a suctioning body integrally coupled to the lower portion of the main body, a wheel that allows the main body to move on a floor surface, a handle gripped by a user, and the like.

Here, the suctioning body of the upright cleaner is parallel to the floor, and the main body rotates with respect to one or more rotation axes which are vertical to the navigating direction.

Consequently, the user performs cleaning while holding the handle of the upright cleaner and moving the whole main body.

Since the main body is disposed by being coupled to an upper end of a brush of the suctioning body in the upright cleaner, the load of the main body is transmitted to the brush, thus causing a problem of being difficult for the user to move, redirect, and reciprocate the cleaner while performing a cleaning operation.

In addition, since the main body of the upright cleaner is parallel to the floor surface and is coupled to the brush while having a rotation axis that is perpendicular to the navigating direction, the load of the main body generated due to the rotation is entirely applied to the user's hand when the user performs the cleaning operation, thus causing a problem in which the user may feel fatigue when the user continues the cleaning operation for a long time.

DISCLOSURE

Technical Problem

An aspect of the present disclosure is directed to providing a cleaner and a method of controlling the same in which the magnitude and the direction of a force applied to a handle part are detected and a movement of a cleaning tool assembly is controlled based on the detected magnitude and direction of the force.

Technical Solution

According to an aspect of the present disclosure, a cleaner includes a main body, a cleaning tool assembly connected to the main body to be movable in at least one axial direction, a handle part connected to the main body and configured to receive applied force of the user, a detection part provided in the handle part and configured to detect the magnitude and the direction of the force applied to the handle part, and a control part configured to control the movement direction of the cleaning tool assembly based on the detected direction of the force and to control the movement distance of the cleaning tool assembly based on the detected magnitude of the force.

The handle part may include a body part, a cap part disposed to be spaced apart from the body part, a guide part disposed between the body part and the cap part; and a sliding part slidably installed at the guide part and configured to straightly move and rotationally move between the body part and the cap part.

The detection part may include a first detection part configured to detect a straight-line movement force corresponding to a straight-line movement of the sliding part, and a second detection part configured to detect a rotational movement force corresponding to a rotational movement of the sliding part.

The handle part may further include a first holder part connected to the sliding part and configured to receive the straight-line movement force and the rotational movement force of the sliding part and a second holder part connected to the first holder part and configured to receive the rotational movement force transmitted to the first holder part. The first detection part may include a linear potentiometer connected to the first holder part and configured to have a resistance value changed when the first holder part moves by the straight-line movement force transmitted to the sliding part. The second detection part may include a rotational potentiometer connected to the second holder part and configured to have a resistance value changed when the first holder part and the second holder part move by the rotational movement force transmitted to the sliding part.

The first detection part may include a linear potentiometer connected to the sliding part and configured to have a resistance value changed when the sliding part straightly moves by the straight-line movement force transmitted to the sliding part.

The first detection part may include an optical sensor installed in the body part or the cap part and configured to emit light toward the sliding part and detect an incident amount of light reflected by the sliding part.

The handle part may further include a reflection part disposed at an outer circumferential surface of the sliding part and configured to have a plurality of reflection cells with reflectivity values different from each other, and the first detection part may include an optical sensor configured to emit light toward the reflection part disposed at the sliding part and detect an incident amount of light reflected by the reflection part.

The handle part may further include a shaft member connected to the sliding part, and the first detection part may include a capacitance detection part disposed in front of and behind the guide part, disposed at positions corresponding to positions of both end portions of the shaft member, and configured to detect a capacitance corresponding to proximity of the shaft member.

The second detection part may include a rotational potentiometer connected to the guide part and configured to have a resistance value changed when the guide part rotationally moves due to the rotational movement force transmitted to the sliding part.

The handle part may further include a reflection part disposed at a side surface of the sliding part, configured to rotate due to being interlocked with the rotational movement of the sliding part, and formed of a plurality of reflection cells with reflectivity values different from each other, and the second detection part may include an optical sensor configured to emit light toward the reflection part disposed at the side surface of the sliding part and detect an incident amount of light reflected by the reflection part.

The handle part may further include a contact member connected to the sliding part, and the first detection part may include a capacitance detection part disposed left and right of the guide part, disposed at a position corresponding to a position of the contact member, and configured to detect capacitance corresponding to proximity of the contact member.

The handle part may further include a first elastic part configured to move the sliding part to the initial position when the straight-line movement force is applied, and a second elastic part configured to move the sliding part to the initial position when the rotational movement force is applied.

The handle part may further include a reflection part disposed at a side surface of the sliding part, and the detection part may include an optical sensor configured to emit light toward the reflection part and detect an amount of light reflected from the reflection part disposed at the side surface of the sliding part.

The cleaning tool assembly may include a housing, a brush part disposed in the housing and configured to sweep up dust, and a moving part having at least two wheels and a wheel motor configured to apply a rotational force to each of the at least two wheels and configured to add a movement force.

The control part may determine a movement direction and a movement distance of at least one of a forward movement, a rearward movement, a leftward rotation, and a rightward rotation of the cleaning tool assembly based on the magnitude and the direction of the force detected by the detection part and may control each of the rotational direction and the rotational speed of the wheel motor based on the determined movement direction and movement distance.

According to another aspect of the present disclosure, a cleaner includes a main body, a cleaning tool assembly connected to the main body to be movable with respect to a surface to be cleaned, a handle part connected to the main body, configured to be graspable, and configured to relatively move with respect to the main body, and a control part configured to control the movement speed and the rotation amount of the cleaning tool assembly such that the movement speed and the rotation amount are controlled to vary according to a relative movement amount of the handle part.

The handle part may include a control part configured to be graspable, and a guide part configured to guide a movement of the control part and to relatively move with respect to the main body.

The guide part may include a rotation guide part configured to relatively rotate with respect to the main body, and a movement guide part formed extending from the rotation guide part and configured such that the control part is movable.

The control part may include a control body formed to surround at least a portion of the movement guide part and formed to be movable along an outer circumferential surface of the movement guide part, and a control holder protruding from an inner circumferential surface of the control body. The movement guide part may include a resistor longitudinally formed along a movement direction of the control part, a displacement member coupled to the control holder and configured to be movable along an upper portion of the resistor together with the control holder in order to adjust a resistance value of the resistor, and at least one movement restoring elastic member configured to elastically press the displacement member so that the displacement member moves to the original position.

The movement guide part may include a pair of movement limiting members configured to selectively come in contact with both sides of the movement direction of the control holder and to prevent a movement within a predetermined section, and the at least one movement restoring elastic member may include a pair of movement restoring elastic members configured to press end portions of the pair of movement limiting members toward the control holder.

The main body may include a sloped part disposed at a portion where the rotation guide part is rotatably coupled to face the rotation guide part and configured to have a pair of sloped surfaces formed to be symmetrical to each other, and the rotation guide part may include a steering unit configured to relatively rotate with respect to the main body together with the rotation guide part and to straightly move elastically inside the rotation guide part, wherein one end portion of the steering unit is configured to be movable along the sloped part.

The sloped part may include a first sloped surface, a second sloped surface symmetrical to the first sloped surface, and an inflected part where the first sloped surface and the second sloped surface meet, and the steering unit may be configured to move along the first sloped surface or the second sloped surface by an external force and to be disposed at the inflected part when the external force is released.

The rotation guide part may include a steering holder configured to guide a movement of the steering unit, and the steering holder may include a pair of holder stoppers configured to limit the rotation of the steering unit to be within a predetermined section.

The rotation guide part may rotate about a rotation axis formed along the longitudinal direction of the main body, and the movement guide part may be formed extending from the rotation guide part along a movement axis formed to be tilted by a predetermined angle from the rotation axis.

The cleaner may include a standby state in which the main body is vertically disposed with respect to the ground and an operable state in which the cleaner is usable with the main body tilted from the standby mode, and, in the operable state, the movement axis is provided to be parallel to the ground.

According to still another aspect of the present disclosure, a cleaner includes a main body, a cleaning tool assembly connected to the main body to be movable in close contact with a surface to be cleaned, a handle part connected to the main body, configured to be graspable, and configured to manipulate the main body, and a control part configured to control the movement speed and the rotation amount of the cleaning tool assembly such that the movement speed and the rotation amount are controlled to vary according to a manipulation direction of the handle part and a force applied in the manipulation, wherein the handle part may include a control part configured to be graspable, a movement guide part having a movement detection sensor configured to detect a movement of the control part in the front and rear directions and transmit the result of detection to the control part, and a rotation guide part configured to have a rotation detection sensor configured to detect a movement of the control part in a rotational direction and transmit the result of detection to the control part and configured to have one end formed extending from the movement guide part and the other end connected to the main body.

The control part may include a control body formed to surround at least a portion of the movement guide part and formed to be movable along an outer circumferential surface of the movement guide part and a control holder protruding from an inner circumferential surface of the control body, and the movement detection sensor may include a first movement detection sensor disposed in front of the control holder to detect a forward movement of the control part and a force applied forward and a second movement detection sensor disposed behind the control holder to detect a rearward movement of the control part and a force applied rearward.

The rotation guide part may include a rotation guide body rotatably disposed with respect to the main body, a first rotation detection sensor disposed at an outer circumferential surface of the rotation guide body to detect a movement of the rotation guide body in a first rotational direction and a force applied, and a second rotation detection sensor disposed at an outer circumferential surface of the rotation guide body to detect a movement of the rotation guide body in a second rotational direction which is the opposite from the first rotational direction and a force applied.

The movement detection sensor and the rotation detection sensor may include a pressure sensor.

A cleaner may include a cleaning tool assembly configured to be in close contact with a surface to be cleaned and be movable by rotations of a plurality of wheels, a main body connected to the cleaning tool assembly, a handle part connected to the main body and configured to be graspable, and a control part configured to control the rotational speeds and the rotation amounts of the plurality of wheels to be changed according to at least one of the direction and the magnitude of a force applied to the handle part.

The cleaner may further include a state detection sensor configured to detect a tilt of the main body, and the control part may determine whether the cleaner is in the operable state or the cleaner is laid according to the tilt of the main body.

The cleaner may further include an obstacle detection sensor configured to detect an obstacle on a movement path, and, when an obstacle is detected by the obstacle detection sensor, the control part may decrease the rotational speeds and the rotation amounts of the plurality of wheels or stop the rotations of the plurality of wheels.

The cleaner may further include an input part manipulated by a user, and, when the input part is manipulated, the control part may decrease the rotational speeds and the rotation amounts of the plurality of wheels or stop the rotations of the plurality of wheels.

The control part may control the cleaner to move at a predetermined speed according to a user's choice or predefined settings.

The handle part may include at least one of a first detection part configured to detect a straight-line movement force and output a corresponding electrical signal and a second detection part configured to detect a rotational movement force and output a corresponding electrical signal.

When the straight-line movement force or the rotational movement force exceeds a predetermined range, the control part may control the rotational speeds and the rotation amounts of the plurality of wheels to be changed.

When an electrical signal is output for a longer amount of time than an amount of time predefined by the first detection part or the second detection part, the control part may block the operation of the cleaning tool assembly.

The cleaner may further include a storage battery chargeable by an external power source, and, when the storage battery is being charged, the control part may block the operation of the cleaning tool assembly.

A method of controlling a cleaner may be executed by a cleaner that includes a cleaning tool assembly configured to be in close contact with a surface to be cleaned and be movable by rotations of a plurality of wheels, a main body connected to the cleaning tool assembly, and a handle part connected to the main body and configured to be graspable.

The method of controlling the cleaner may include detecting at least one of the direction and the magnitude of a force applied to the handle part, deciding the rotational speeds and the rotation amounts of the plurality of wheels using at least one of the direction and the magnitude of the force, and driving each of the plurality of wheels according to the rotational speeds and the rotation amounts.

The cleaner may further include a state detection sensor configured to detect a tilt of the main body, and the method of controlling the cleaner may further include detecting a tilt of the main body and determining an operation state of the cleaner or whether the cleaner is laid according to the tilt of the main body.

The cleaner may further include an obstacle detection sensor configured to detect an obstacle on a movement path, and the method of controlling the cleaner may further include detecting an obstacle by the obstacle detection sensor and decreasing the rotational speeds and the rotation amounts of the plurality of wheels or stopping the rotations of the plurality of wheels according to the result of detecting an obstacle.

The cleaner may further include an input part manipulated by a user, and the method of controlling the cleaner may further include outputting an electrical signal by the input part according to the manipulation and decreasing the rotational speeds and the rotation amounts of the plurality of wheels or stopping the rotations of the plurality of wheels according to the electrical signal.

The method of controlling the cleaner may further include moving the cleaner at a predetermined speed according to a user's choice or predefined settings.

The handle part may include at least one of a first detection part configured to detect a straight-line movement force and output a corresponding electrical signal and a second detection part configured to detect a rotational movement force and output a corresponding electrical signal.

The method of controlling the cleaner may further include, when the straight-line movement force or the rotational movement force is determined to exceed a predetermined range, controlling the rotational speeds and the rotation amounts of the plurality of wheels to be changed.

The method of controlling the cleaner may further include, when an electrical signal is output for a longer amount of time than an amount of time predefined by the first detection part or the second detection part, blocking the operation of the cleaning tool assembly.

The cleaner may further include a storage battery chargeable by an external power source, and the method of controlling the cleaner may further include, when the storage battery is being charged, blocking the operation of the cleaning tool assembly.

Advantageous Effects

According to a cleaner and a method of controlling the same of the present disclosure, the steering performance of the cleaner may be improved by reducing a horizontal load felt by a user when the user holds and moves a handle of the cleaner, and fatigue felt when performing the cleaning operation may be removed by removing a vertical load applied by the handle. Accordingly, convenience in manipulating the cleaner may be improved.

MODES OF THE INVENTION

Hereinafter, embodiments according to the present disclosure will be described in detail with reference to the accompanying drawings.

Figure 1:
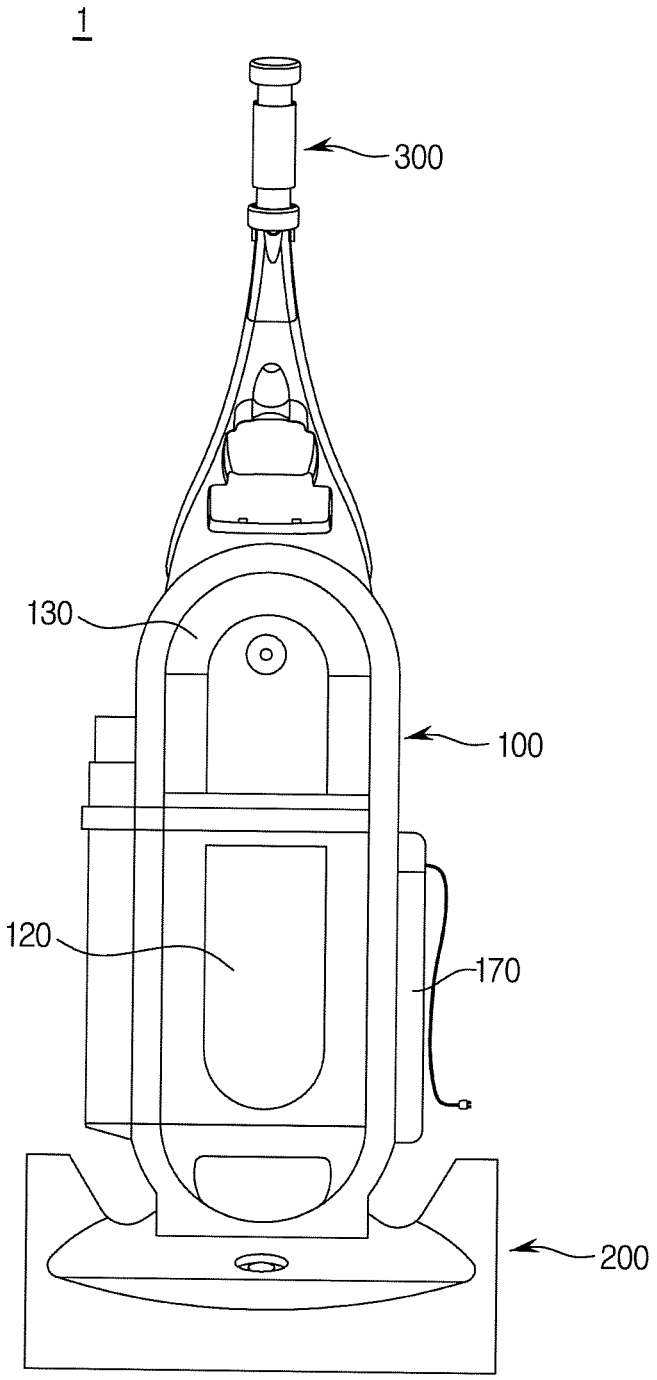
FIG. 1 is an exemplary view of a front surface of a cleaner according to a first embodiment.
Figure 2:
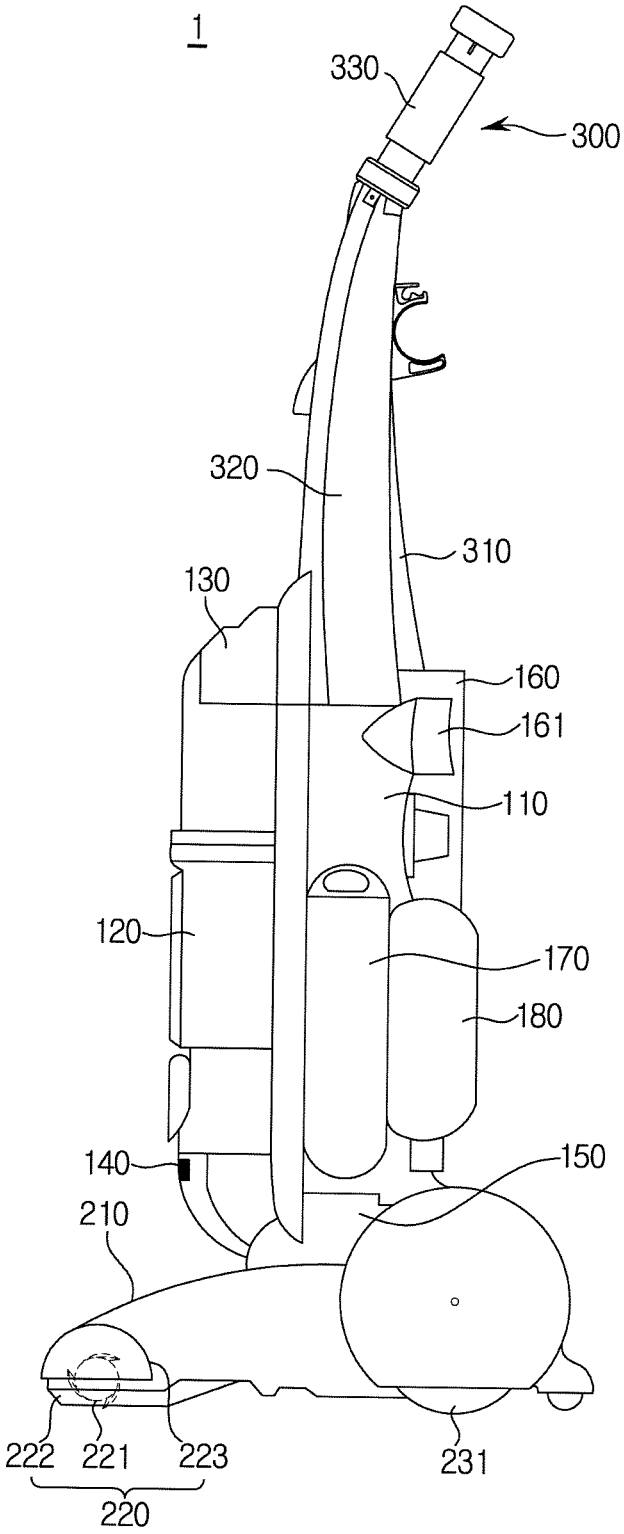
FIG. 2 is an exemplary view of a side surface of the cleaner according to the first embodiment.

FIG. 1 is an exemplary view of a front surface of a cleaner according to a first embodiment, and FIG. 2 is an exemplary view of a side surface of the cleaner according to the first embodiment.

The cleaner of the first embodiment is an upright cleaner 1 and includes a main body 100, a cleaning tool assembly 200, and a handle part 300. The cleaner 1 is operated by receiving power from an external power source or an internal battery.

The cleaning tool assembly 200 is mounted to one portion of the main body 100, and the handle part 300 is mounted to the other portion thereof such that the main body 100 stores foreign substances suctioned in by the cleaning tool assembly 200 and transmits a force acted on the handle part 300 to the cleaning tool assembly 200.

The main body 100 includes a body base part 110, a dust collecting part 120 that is detachably mounted to the body base part 110 and has a cyclone (not shown) embedded therein to separate and collect dust using the centrifugal force of the cyclone, a dust collecting cover 130 that is detachably mounted to an upper surface of the dust collecting part 120 to open and close the dust collecting part 120, and a locking part 140 that detachably fixes the dust collecting part 120 to the body base part 110.

Here, the dust collides against a wall of the dust collecting part by the centrifugal force, is dropped to the lower portion of the dust collecting part, then is collected by the dust collecting part, and clean air rises from a central portion to be discharged to the outside.

Furthermore, the dust collecting cover 130 may also form an upper surface of the dust collecting part 120 which is a portion of the dust collecting part 120.

The main body 100 further includes a suctioning part 150 that is disposed at a lower portion of the body base part 110 and the dust collecting part 120 which are coupled to each other and generates a suction force required for a cleaning operation, a passage part 160 that is mounted to the body base part 110 and forms a passage so that dust and foreign substances suctioned in by the suction force generated by the suctioning part 150 may enter the dust collecting part 120, and an air discharge part 170 that is disposed at the body base part 110 and discharges cleaned air in the dust collecting part 120 to the outside.

Here, the suctioning part 150 includes a suction motor (not shown) for generating a suction force.

Furthermore, the passage part 160 is a passage that connects the cleaning tool assembly 200 to the dust collecting part 120 and may be integrally formed with the body base part 110.

In addition, the passage part 160 includes a clamp 161 that holds and fixes a hose (not shown) inserted into the dust collecting part 120.

In addition, the main body 100 further includes a cord reel 180 that is mounted to the body base part 110, has a wound cord for connecting to external power, and accommodates as well as protects the wound cord.

The cleaning tool assembly 200 is mounted to the lower portion of the main body 100 being to be rotatable back and forth with respect to the navigating direction during moving forward or backward.

The cleaning tool assembly 200 comes in contact with the floor surface, sweeps up or scatters dust on the floor surface, and suctions in the swept-up or scattered dust. Here, the dust suctioned in is transmitted to the dust collecting part 120.

The cleaning tool assembly will be described with reference to FIG. 3.

Figure 3:
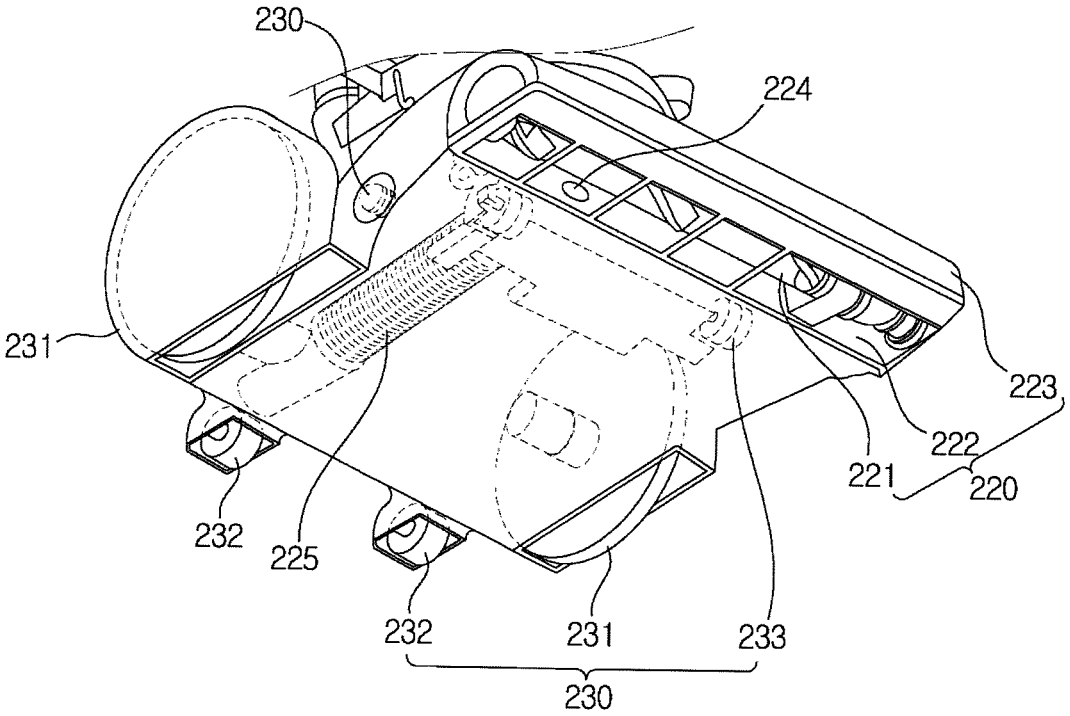
FIG. 3 is an exemplary view of a cleaning tool assembly provided in the cleaner according to the first embodiment.

As illustrated in FIG. 3, the cleaning tool assembly 200 includes a housing 210 that forms an exterior, a brush part 220 that is disposed in the housing 210 and sweeps up dust, and a moving part 230 that is disposed in the housing 210 and adds a movement force to the cleaner.

The cleaning tool assembly 200 further includes a knob member 240 that is disposed at the housing 210 for adjusting the height of a height-adjusting wheel.

The brush part 220 may be formed as a drum type.

The brush part 220 includes a brush member 221 that uses a rotary force to sweep up and gather dust on the floor surface, a brush base part 222 that rotatably fixes both ends of the brush member 221, a brush cover 223 that is mounted to the housing 210, separates the brush member in the form of a chamber, and protects the brush member 221, a suction port 224 formed at the brush cover 223 and through which dust is suctioned in, and a connection tube 225 that connects the suction port 224 to the passage part 160 and transfers the dust suctioned in through the suction port 224 to the passage part 160.

That is, the suction port 224 is a hole through which dust is suctioned in by the suction force generated by the suctioning part 150.

In addition, the brush part 220 further includes a brush motor (not shown) that applies a rotary force to the brush member 221.

The moving part 230 includes a pair of main wheels 231 disposed at the rear of the housing 210 for moving the cleaning tool assembly 200, an auxiliary wheel 232 that is disposed at the rear of the housing 210 while being disposed further behind the pair of main wheels 231 and provides an auxiliary movement force to the movement force of the main wheels 231, and a height-adjusting wheel 233 disposed at the rear of the brush base part 222 of the brush part and capable of adjusting the height according to a rotational path difference of the knob 240.

The moving part 230 further includes a pair of wheel motors 234 that apply rotary force to each of the pair of main wheels 231.

That is, the pair of wheel motors 234 rotate in a rotational direction and at a rotational speed corresponding to the direction and the magnitude of the force acted by the handle part 300.

Here, the pair of main wheels 231 receive the rotary force from each of the wheel motors 234 connected thereto and rotate in the rotational direction and at the rotational speed received so that the cleaning tool assembly 200 may be moved by a movement distance intended by the user in a movement direction intended by the user.

In addition, the moving part 230 may also further include an elastic member 235 that is mounted to a hinge part (not shown) that connects the main body 100 to the cleaning tool assembly 200 and applies an elastic force to a rotational operation of the main body 100.

The handle part 300 is coupled to the main body 100, is gripped by the user's hand, and transmits the force acted thereupon when gripped by the user to the cleaning tool assembly 200.

The handle part 300 will be described with reference to FIGS. 4 and 5.

Figure 4:
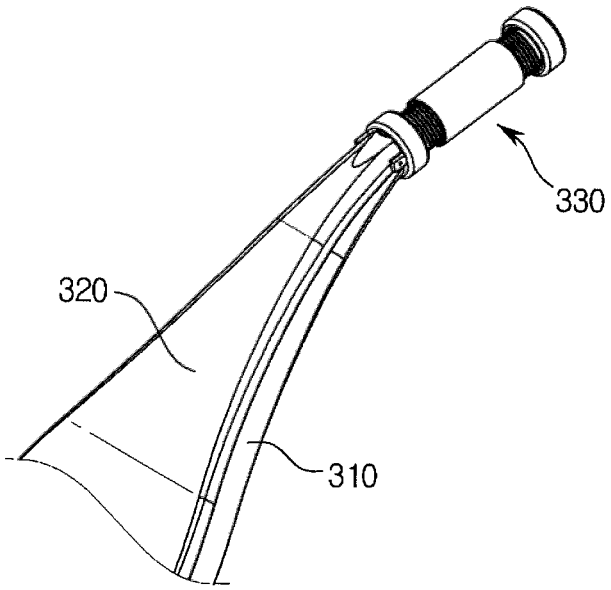
FIG. 4 is an exemplary view of a handle part provided in the cleaner according to the first embodiment.

As illustrated in FIG. 4, the handle part 300 includes a handle base part 310 coupled to the body base part 110 of the main body, a handle cover 320 coupled to the handle base part 310, and a hand grip part 330 mounted to an end portion of the handle base part 310 and the handle cover 320 when the handle base part 310 and the handle cover 320 are coupled. Here, the handle base part 310 and the handle cover 320 may be integrally formed with each other.

Figure 5:
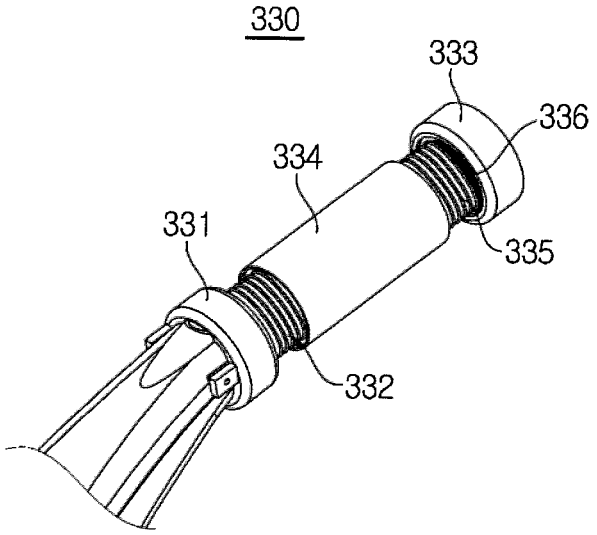
FIG. 5 is a detailed exemplary view of a hand grip part of a handle part provided in the cleaner according to the first embodiment.

As illustrated in FIG. 5, the hand grip part 330 includes a body part 331 coupled to the body base part 110 of the main body, a guide part 332 coupled to the body part 331, a cap part 333 coupled to the end of the guide part 332, and a sliding part 334 that is slidably mounted to the outer portion of the guide part 332 and slides between the body part 331 and the cap part 333.

In addition, the hand grip part 330 further includes a first elastic part 335 that applies an elastic force to the sliding part 334 that straightly moves between the body part 331 and the cap part 333 to keep a straight neutral position thereof and a second elastic part 336 that is disposed at the cap part 333 and applies an elastic force to the sliding part 334 that rotates to keep the center of rotation neutral.

Here, the first elastic part 335 may be disposed at both sides of the sliding part 334, and the second elastic part includes a torsion spring.

The guide part 332 is movably inserted into the sliding part 334. That is, the sliding part 334 and the guide part 332 have shapes corresponding to each other.

The sliding part 334 and the guide part 332 may be formed in a cylindrical shape so that the sliding part 334 that moves along the guide part 332 is capable of straightly moving backward and forward and rotationally moving leftward and rightward.

In addition, the hand grip part 330 further includes a detection part 400 that detects the magnitude and the direction of the force acting on the sliding part 334.

Here, the magnitude of the force acting on the sliding part 334 corresponds to the movement distance of the cleaning tool assembly, and the direction of the force acting on the sliding part 334 corresponds to the movement direction of the cleaning tool assembly.

The detection part 400 includes a first detection part 410 that detects straight-line movement directions and straight-line movement forces of a forward movement and a backward movement of the sliding part 334 that straightly moves along the guide part 332 and a second detection part 420 that detects rotational movement directions and rotational movement forces of a leftward rotation and a rightward rotation of the sliding part 334 that rotationally moves along the guide part 332.

The detection part 400 transmits a first detection signal detected by the first detection part 410 to a control part 510 and transmits a second detection signal detected by the second detection part 420 to the control part 510. Here, the configuration of the control part 510 will be described later.

Here, the first detection part 410 may be implemented with any one of a linear potentiometer, an optical sensor such as an infrared sensor, a capacitance sensor, a strain gage, a load cell, a magnetic sensor, and a high-frequency oscillation type induction sensor, and the second detection part 420 may be implemented with any one of a rotational potentiometer, an optical sensor such as an infrared sensor, a capacitance sensor, a strain gage, a load cell, a magnetic sensor, and a high-frequency oscillation type induction sensor.

When the first and second detection parts are implemented with at least one sensor of the capacitance sensor, the strain gage, the load cell, the magnetic sensor, and the high-frequency oscillation type induction sensor, the hand grip part 330 further includes a manipulation member such as a joystick.

An illustrative embodiment of the detection part 400 provided at the hand grip part 330 will be described with reference to FIGS. 6 to 15.

Figure 6:
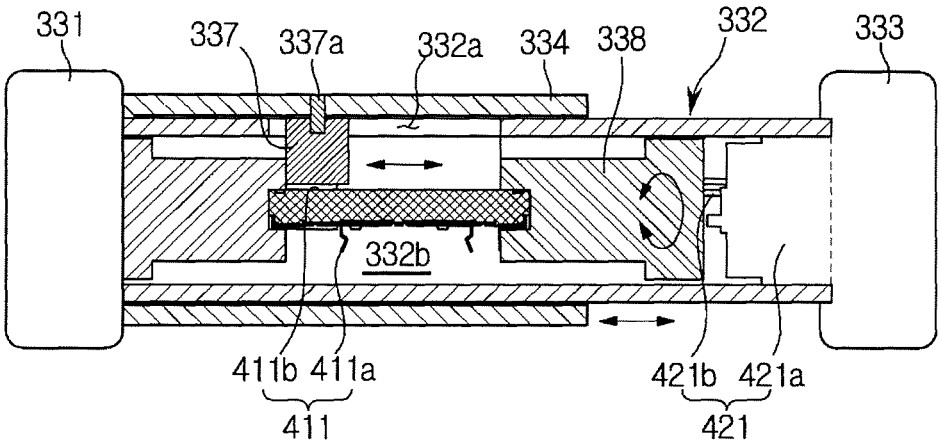
FIGS. 6 to 14, 15A, and 15B are exemplary views of a detection part provided in the handle part illustrated in FIG. 5.

FIG. 6 is an example of the hand grip part 330 at which the detection part 400 is provided.

The first detection part of the detection part 400 includes a first potentiometer 411 which is a linear potentiometer that detects straight-line movement directions and straight-line movement forces of a forward movement, a backward movement, and the like of the sliding part, and the second detection part includes a second potentiometer 421 which is a rotational potentiometer that detects rotational movement directions and rotational movement forces of leftward and rightward rotations, and the like of the sliding part.

The structure of the hand grip part 330 having the first potentiometer 411 and the second potentiometer 421 will be described.

The guide part is rotatably mounted between the body part 331 and the cap part 333 of the hand grip part 330.

A guide hole 332*a* that limits a straight-line movement area of the sliding part 334 is formed at the guide part 332.

In addition, an accommodation space 332*b* is formed inside the guide part 332, and the first potentiometer 411 and the second potentiometer 421 are disposed in the accommodation space 332*b*.

The hand grip part 330 includes a first holder part 337 that is disposed in the guide hole 332*a* and straightly reciprocates within a hole area of the guide hole 332*a*.

The sliding part 334 includes a first connection hole for mechanically connecting to the first holder part 337, and the first holder part 337 includes a second connection hole for mechanically connecting to the sliding part 334.

That is, the hand grip part 330 includes a connection member 337*a* that mechanically connects the first connection hole of the sliding part to the second connection hole of the first holder part.

One portion of the first holder part 337 is mechanically connected to the sliding part 334 and the other portion thereof is mechanically connected to the first potentiometer 411 such that the force acting on the sliding part 334 may be transmitted to the first potentiometer 411.

In addition, the hand grip part 330 further includes a second holder part 338 that is rotatably disposed in the accommodation space 332*b* of the guide part 332, mounts and fixes the first potentiometer 411, and is connected to the second potentiometer 421.

The second holder part 338 transmits the force acting on the sliding part 334 to the second potentiometer 421.

The first potentiometer 411 and the second potentiometer 421 will be described in more detail.

The first potentiometer 411 is a variable resistor that converts a straight-line displacement into a change in electrical resistance and includes a first resistor 411*a* disposed in the accommodation space 332*b* in the guide part while being disposed to be fixed to the second holder part 338 and a first displacement member 411*b* that is connected to the first holder part 337 and adjusts a resistance value of the first resistor 411*a* while sliding the first resistor 411*a*.

That is, when the sliding part 334 is straightly moved by the user, the straight-line movement force that has acted on the sliding part 334 is transmitted to the first holder part 337 through the connection member 337*a*, and the first displacement member 411*b* of the first potentiometer straightly moves by the straight-line movement force transmitted to the first holder part 337.

Here, the resistance value of the first resistor 411*a* of the first potentiometer is changed based on the direction and the distance in which the first displacement member 411*b* of the first potentiometer has straightly moved, and the straight-line movement direction and the straight-line movement force of the sliding part may be acquired based on the resistance value of the first potentiometer 411.

That is, the straight-line movement direction and movement distance of the cleaning tool assembly corresponding to the user's intention may be acquired. Here, the straight-line movement distance of the cleaning tool assembly may be determined based on the straight-line movement force.

When matched with a resistance value according to a spring force ($f(x)=kx$, k is a spring constant), a distance by which the cleaner moves may be controlled according to the magnitude of the force applied to the sliding part by the user.

The second potentiometer 421 is a variable resistor that converts a rotational displacement into a change in an electrical resistance and includes a first resistor 421*a* disposed in the accommodation space 332*b* in the guide part and being disposed to be fixed to the cap part 333 and a second displacement member 421*b* that is connected to the second holder part 338 and adjusts the resistance value of the second resistor 421*a* while sliding the second resistor 421*a*.

That is, when the sliding part 334 is rotationally moved by the user, the rotational movement force that has acted on the sliding part 334 is transmitted to the first holder part 337 through the connection member 337*a*, the rotational movement force that has been transmitted to the first holder part 337 is transmitted to the guide part 332 and the first potentiometer 411, the rotational movement force that has been transmitted to the first potentiometer 411 is transmitted to the second holder part 338 that fixes the first potentiometer 411, the rotational movement force that has been transmitted to the second holder part 338 is finally transmitted to the second displacement member 421*b* of the second potentiometer, and the second displacement member 421*b* slides the second resistor 421*a* by the rotational force transmitted to the second displacement member 421*b*.

Here, the resistance value of the second resistor of the second potentiometer is changed based on the direction and the distance in which the second displacement member 421*b* of the second potentiometer has rotationally moved, and the rotational movement direction and the rotational movement force may be acquired based on the resistance value of the second potentiometer.

That is, the rotational movement direction and rotational movement distance of the cleaning tool assembly corresponding to the user's intention may be acquired.

Here, the rotational movement distance of the cleaning tool assembly is leftward and rightward rotational angles of the cleaning tool assembly. An angle change amount may be calculated according to the change in the resistance value of the second potentiometer, and a rotational angle of the cleaning tool assembly corresponding to the calculated angle change amount may be acquired.

Figure 7:
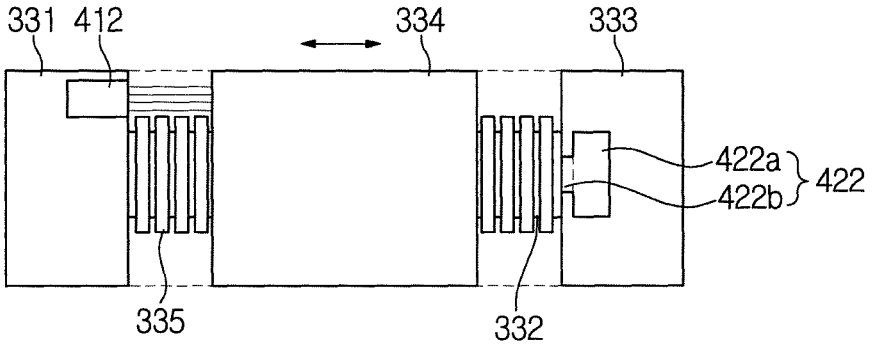

FIG. 7 is another example of the hand grip part 330 at which the detection part 400 is provided.

The first detection part of the detection part 400 includes an infrared sensor 412 which is an optical sensor that detects straight-line movement directions and straight-line movement forces of a forward movement, a backward movement, and the like of the sliding part 334, and the second detection part includes a potentiometer 422 that detects rotational movement directions and rotational movement forces of leftward and rightward rotations, and the like of the sliding part. Here, the potentiometer 422 is a rotational potentiometer.

The structure of the hand grip part 330 having the infrared sensor 412 and the potentiometer 422 will be described.

The infrared sensor 412 for detecting a movement distance of the sliding part 334 that has moved from the body part 331 is provided in the body part 331 of the hand grip part 330.

Furthermore, the infrared sensor 412 may also be provided in the cap part 333 and detect a movement distance of the sliding part 334 that has moved from the cap part.

Here, the infrared sensor 412 is disposed at an outer perimeter of the body part 331 so that emitted infrared rays and incident infrared rays are not interfered by the guide part 332 and the first elastic part 335.

Furthermore, the outer diameter of the sliding part 334 is similar to or the same as the outer diameter of the cap part 333.

That is, the infrared sensor 412 emits infrared rays and detects the incident amount of infrared rays reflected from a side surface of the sliding part 334.

That is, the sliding part 334 becomes closer to or farther away from the infrared sensor 412 when the sliding part 334 straightly moves, and the incident amount of infrared rays reflected from the sliding part 334 varies according to the sliding part 334 becoming closer to or farther away from the infrared sensor 412.

Here, the cleaner detects the movement distance and the movement direction of the sliding part 334 based on the amount of infrared rays detected by the infrared sensor 412, checks the movement direction and the movement distance of the cleaning tool assembly corresponding to the movement direction and the movement distance detected, and moves the cleaning tool assembly by the checked movement distance in the checked movement direction.

Here, the detecting of the movement distance and the movement direction of the sliding part 334 based on the amount of infrared rays detected by the infrared sensor 412 includes detecting the magnitude and the direction of the force applied to the sliding part 334 based on the amount of change between the amount of infrared rays detected before the sliding part moves and the amount of infrared rays detected after the sliding part moves and checking a movement distance and a movement direction of the cleaning tool assembly corresponding to the detected magnitude and direction of the force.

The guide part 332 of the hand grip part 330 is rotatably mounted between the body part 331 and the cap part 333, is mechanically connected to be interlocked with the sliding part 334, and is mechanically connected to the potentiometer 422.

In more detail, the potentiometer 422 is a variable resistor that converts a rotational displacement into a change in an electrical resistance and includes a resistor 422*a* disposed to be fixed to the cap part 333 and a displacement member 422*b* that adjusts the resistance value of the resistor 422*a* while sliding the resistor 422*a*.

That is, when the sliding part 334 rotationally moves, the rotational movement force of the sliding part 334 is applied to the guide part 332, and the rotational movement force that has been applied to the guide part 332 is finally applied to the displacement member 422*b* of the potentiometer.

Here, the displacement member 422*b* slides the resistor 422*a* by the rotational force that has been transmitted to the displacement member 422*b*, and the resistance value of the resistor varies by the rotational movement force of the displacement member 422*b*.

The rotational movement direction and the rotational movement force may be acquired based on the resistance value of the potentiometer 422.

In this manner, the infrared sensor and the potentiometer may be used to acquire the rotational movement direction and the rotational movement distance of the cleaning tool assembly corresponding to the user's intention.

Here, for the rotational movement distance of the cleaning tool assembly, the amount of angle change may be calculated according to the change in the resistance value of the potentiometer, and the rotational angle of the cleaner may be determined based on the calculated amount of angle change.

Figure 8:
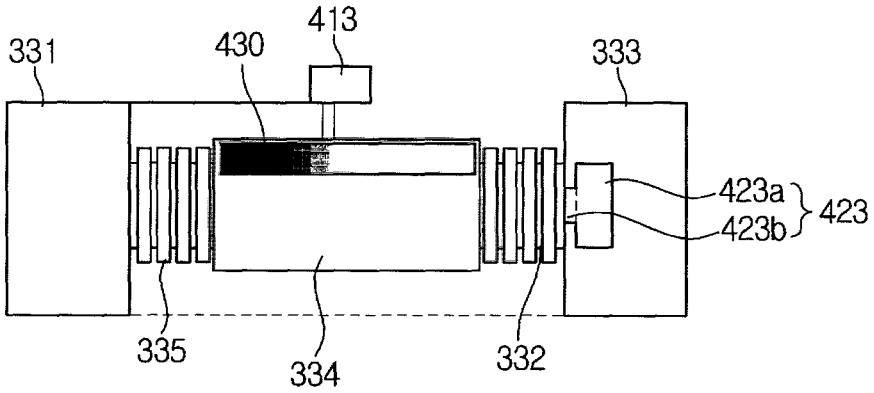

FIG. 8 is still another example of the hand grip part 330 at which the detection part 400 is provided.

The first detection part of the detection part 400 includes an infrared sensor 413 which is an optical sensor that detects straight-line movement directions and straight-line movement forces of a forward movement, a backward movement, and the like of the sliding part 334, and the second detection part includes a potentiometer 423 that detects rotational movement directions and rotational movement forces of leftward and rightward rotations, and the like of the sliding part 334. Here, the potentiometer 423 is a rotational potentiometer.

The structure of the hand grip part 330 having the infrared sensor 413 and the potentiometer 423 will be described.

The hand grip part 330 further includes a reflection part 430 that is disposed at the sliding part 334 and reflects the incident light when light emitted from the infrared sensor 413 is incident.

Here, the reflection part 430 is formed in the longitudinal direction extending from the body part 331 to the cap part 333.

The reflection part 430 includes a plurality of reflection cells that have predetermined sizes and are disposed adjacent to each other, and optical reflectivity values of the plurality of reflection cells are different from each other.

That is, the plurality of reflection cells of the reflection part 430 are formed by a gradation method and have characteristics in which reflectivity gradually becomes higher from the body part 331 toward the cap part 333. For example, the plurality of reflection cells of the reflection part 430 have colors with the reflectivity gradually becoming higher from the body part 331 toward the cap part 333.

Furthermore, the plurality of reflection cells may also have a characteristic in which the reflectivity becomes gradually lower from the body part 331 toward the cap part 333.

The infrared sensor 413 for detecting the distance from the body part 331 by which the sliding part 334 has moved is provided between the body part 331 and the cap part 333 of the hand grip part 330.

The sliding part 334 has a smaller outer diameter than the body part 331 and the cap part 333 so that the infrared sensor 413 may be easily installed and infrared rays may be easily emitted and detected.

The infrared sensor 413 is electrically and mechanically connected to the body part or the cap part, is disposed within the movement area in which the sliding part 334 straightly moves, and is disposed at a portion unreachable by the user's hand when the user grips the sliding part 334.

The infrared sensor 413 emits infrared rays and detects the incident amount of infrared rays reflected from the reflection part 430 disposed at the sliding part 334.

Here, based on the amount of infrared rays detected by the infrared sensor 413, the cleaner detects the movement distance of the sliding part which is the distance between the body part and the sliding part.

Here, the detecting of the movement distance of the sliding part includes detecting the movement distance of the sliding part based on the amount of change between the amount of infrared rays detected before the sliding part moves and the amount of infrared rays detected after the sliding part moves.

That is, when the sliding part 334 is straightly moved by the user, the reflection part 430 disposed at the sliding part 334 moves due to being interlocked with the movement of the sliding part 334. Accordingly, the position of a reflection cell of the reflection part 430 facing the infrared sensor 413 is changed, and here, the infrared sensor detects the amount of infrared rays reflected from the reflection cell facing the infrared sensor.

In this manner, a reflection cell facing the infrared sensor 413 changes according to the straight-line movement of the sliding part 334, the incident amount of infrared rays from the reflection cell facing the infrared sensor changes, and the movement distance of the sliding part 334 that has moved from the body part 331 may be detected based on the amount of infrared rays.

Furthermore, the cleaner may match the amount of change of the amount of infrared rays with a displacement value according to a spring force ($f(x)=kx$, $k$ is a spring constant) and calculate the magnitude of force applied to the sliding part by the user. Accordingly, the movement of the cleaning tool assembly may be controlled.

The guide part 332 of the hand grip part 330 is rotatably mounted between the body part 331 and the cap part 333. The guide part 332 is mechanically connected to the sliding part 334 to interlock with the movement of the sliding part 334 and is also mechanically connected to the potentiometer 423 to transmit the rotational movement force to the potentiometer 423.

In more detail, the potentiometer 423 is a variable resistor that converts a rotational displacement into a change in an electrical resistance and includes a resistor 423*a* disposed to be fixed to the cap part 333 and a displacement member 423*b* that adjusts a resistance value of the resistor 423*a* by sliding the resistor 423*a*.

That is, when the sliding part 334 rotationally moves, the rotational movement force of the sliding part 334 is transmitted to the guide part 332, and the rotational movement force that has been transmitted to the guide part 332 is finally transmitted to the displacement member 423*b* of the potentiometer.

Here, the displacement member 423*b* is slid on the resistor 423*a* by the rotational movement force that has been transmitted to the displacement member 423*b*, and the resistance value of the resistor 423*a* varies by the rotational movement force of the displacement member 423*b*.

The rotational movement direction may be acquired based on the resistance value of the potentiometer 423, and the rotational movement force may be acquired based on the amount of change of the resistance value.

Here, the rotational movement force is a rotational angle of the cleaning tool assembly. An amount of change of the rotational angle of the sliding part may be calculated according to the change in the resistance value of the potentiometer, and a rotational angle of the cleaner may be determined based on the calculated amount of angle change.

In this manner, the infrared sensor 413 and the potentiometer 423 may be used to acquire the rotational movement direction and the rotational movement distance (i.e. the rotational angle) of the cleaning tool assembly corresponding to the user's intention.

Figure 9:
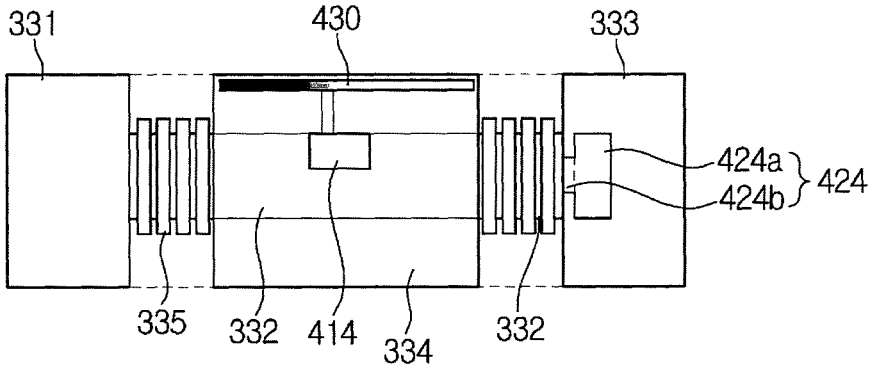

FIG. 9 is still another example of the hand grip part 330 at which the detection part 400 is provided.

The first detection part of the detection part 400 includes an infrared sensor 414 which is an optical sensor that detects straight-line movement directions and straight-line movement forces of a forward movement, a backward movement, and the like of the sliding part 334, and the second detection part includes a potentiometer 424 that detects rotational movement directions and rotational movement forces of leftward and rightward rotations, and the like of the sliding part 334.

The structure of the hand grip part 330 having the infrared sensor 414 and the potentiometer 424 will be described. Here, the potentiometer 424 is a rotational potentiometer, and the description thereof will be omitted since it is the same as the potentiometer 423 in FIG. 8.

The hand grip part 330 further includes the reflection part 430 that is disposed inside the sliding part 334 and reflects the incident light when light emitted from the infrared sensor 414 is incident.

Here, the reflection part 430 is formed in the longitudinal direction extending from the body part 331 to the cap part 333, and the description thereof will be omitted since it is the same as the reflection part 430 in FIG. 8.

The infrared sensor 414 for detecting the distance from the body part 331 by which the sliding part 334 has moved is provided in the guide part 332 of the hand grip part 330.

The infrared sensor 414 emits infrared rays and detects the incident amount of infrared rays reflected from the reflection part 430 disposed at the sliding part 334.

Here, the cleaner detects the movement distance of the sliding part which is a distance between the body part and the sliding part based on the amount of infrared rays detected by the infrared sensor 414.

Here, the detecting of the movement distance of the sliding part includes detecting the movement distance of the sliding part based on the amount of change between the amount of infrared rays detected before the sliding part moves and the amount of infrared rays detected after the sliding part moves.

That is, when the sliding part 334 is straightly moved by the user, the reflection part 430 disposed at the sliding part 334 moves due to being interlocked with the movement of the sliding part 334. Accordingly, the position of a reflection cell of the reflection part 430 facing the infrared sensor 414 is changed, and here, the infrared sensor detects the amount of infrared rays reflected from the reflection cell facing the infrared sensor.

In this manner, a reflection cell facing the infrared sensor 414 changes according to the straight-line movement of the sliding part 334, the amount of infrared rays incident from the reflection cell facing the infrared sensor changes, and the movement distance of the sliding part 334 that has moved from the body part 331 may be detected based on the amount of infrared rays.

That is, the cleaner may match the amount of change of the amount of infrared rays with a displacement value according to a spring force ($f(x)=kx$, k is a spring constant) and calculate the magnitude of force applied to the sliding part by the user. Accordingly, the movement of the cleaning tool assembly may be controlled.

Figure 10:
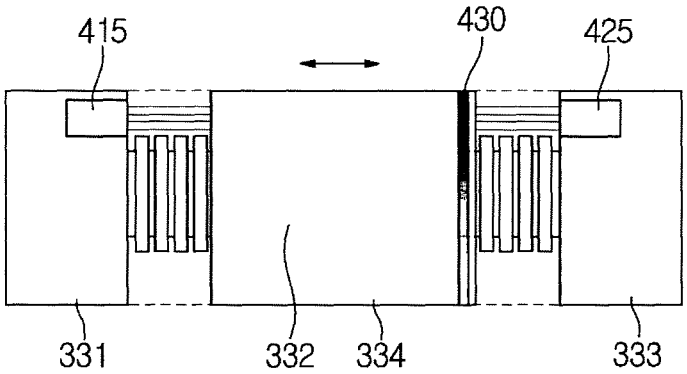

FIG. 10 is still another example of the hand grip part 330 at which the detection part 400 is provided.

The first detection part of the detection part 400 includes a first infrared sensor 415 which is an optical sensor that detects straight-line movement directions and straight-line movement forces of a forward movement, a backward movement, and the like of the sliding part 334, and the second detection part includes a second infrared sensor 425 that detects rotational movement directions and rotational movement forces of leftward and rightward rotations, and the like of the sliding part 334.

The structure of the hand grip part 330 having the first infrared sensor 415 and the second infrared sensor 425 will be described.

Figure 11:
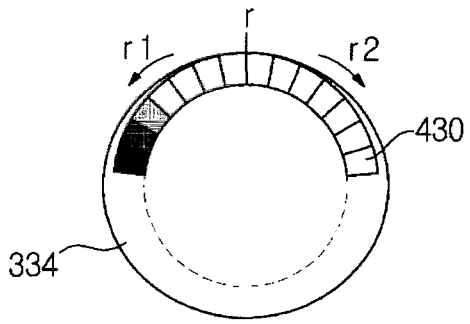

As illustrated in FIG. 11, the hand grip part 330 further includes the reflection part 430 that is disposed at a side surface of the sliding part 334, disposed along an outer edge of a circle corresponding to an area in which the sliding part rotates, and, when light emitted from the first infrared sensor 415 is incident, reflects the incident light.

Here, the reflection part 430 includes a plurality of reflection cells that have predetermined sizes and are disposed adjacent to each other, and the optical reflectivity values of the plurality of reflection cells are different from each other.

That is, the plurality of reflection cells of the reflection part 430 are formed by a gradation method, have a characteristic in which the reflectivity gradually becomes lower from a reference position r toward a first rotational direction r1, and have a characteristic in which the reflectivity gradually becomes higher from the reference position toward a second rotational direction r2.

For example, the plurality of reflection cells of the reflection part 430 have colors with reflectivity gradually becoming higher from one end portion toward the other end portion.

The first infrared sensor 415 for detecting the movement distance of the sliding part 334 that has moved from the body part 331 is provided in the body part 331 of the hand grip part 330.

Furthermore, the first infrared sensor 415 may also be provided in the cap part 333 and detect the movement distance of the sliding part 334 that has moved from the cap part 333.

Here, the first infrared sensor 415 is disposed at an outer edge of the body part 331 so that emitted infrared rays and incident infrared rays are not interfered by the guide part 332 and the first elastic part 335.

Furthermore, the outer diameter of the sliding part 334 is similar to or the same as the outer diameter of the cap part 333.

The first infrared sensor 415 emits infrared rays and detects the incident amount of infrared rays reflected from a side surface of the sliding part 334.

That is, the sliding part 334 becomes closer to or farther away from the first infrared sensor 415 when the sliding part 334 straightly moves, and the incident amount of infrared rays reflected from the sliding part 334 varies according to the sliding part 334 becoming closer to or farther from the first infrared sensor 415.

Here, the cleaner detects the movement distance and the movement direction of the sliding part 334 based on the amount of infrared rays detected by the first infrared sensor 415, checks a movement direction and a movement distance of the cleaning tool assembly corresponding to the movement direction and the movement distance detected, and moves the cleaning tool assembly by the checked movement distance in the checked movement direction.

Here, the detecting of the movement distance and the movement direction of the sliding part 334 based on the amount of infrared rays detected by the first infrared sensor 415 includes detecting the magnitude and the direction of the force applied to the sliding part 334 based on the amount of change between the amount of infrared rays detected before the sliding part moves and the amount of infrared rays detected after the sliding part moves and checking a movement distance and a movement direction of the cleaning tool assembly corresponding to the detected magnitude and direction of the force.

The second infrared sensor 425 for detecting a distance by which the sliding part 334 has rotationally moved is provided in the cap part 333 of the hand grip part 330. Furthermore, the second infrared sensor 425 may also be provided in the body part 331.

Here, the second infrared sensor 425 faces the reflection part 430.

The second infrared sensor 425 emits infrared rays and detects the incident amount of infrared rays reflected from the reflection part 430 disposed at a side surface of the sliding part 334.

Here, the cleaner detects a rotational angle which is a rotational movement distance of the sliding part based on the amount of infrared rays detected by the second infrared sensor 425.

That is, when the sliding part 334 rotationally moves leftward and rightward by the user, the reflection part 430 disposed at the side surface of the sliding part 334 rotates due to being interlocked with the rotational movement of the sliding part 334. Accordingly, the position of a reflection cell of the reflection part 430 facing the second infrared sensor 425 changes, and here, the second infrared sensor 425 detects the amount of infrared rays reflected from the reflection cell facing the second infrared sensor 425.

In this manner, the reflection cell facing the second infrared sensor 425 changes according to the rotational movement of the sliding part 334, the amount of infrared rays incident from the reflection cell facing the second infrared sensor 425 is changed, and the rotational angle of the sliding part 334 that has rotated may be detected based on the amount of infrared rays.

Figure 12:
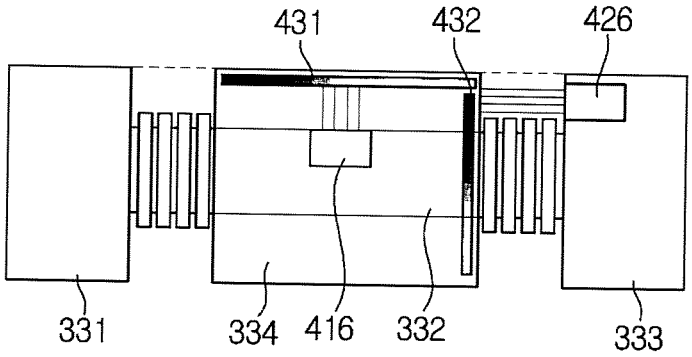

FIG. 12 is still another example of the hand grip part 330 at which the detection part 400 is provided.

The first detection part of the detection part 400 includes a first infrared sensor 416 which is an optical sensor that detects straight-line movement directions and straight-line movement forces of a forward movement, a backward movement, and the like of the sliding part 334, and the second detection part includes a second infrared sensor 426 that detects rotational movement directions and rotational movement forces of leftward and rightward rotations, and the like of the sliding part 334.

The structure of the hand grip part 330 having the first infrared sensor 416 and the second infrared sensor 426 will be described.

The hand grip part 330 further includes a first reflection part 431 that is disposed inside the sliding part 334 and reflects the incident light when light emitted from the first infrared sensor 416 is incident.

Here, the first reflection part 431 is formed in the longitudinal direction extending from the body part 331 to the cap part 333, and the description thereof will be omitted since it is the same as the reflection part 430 in FIG. 8.

The hand grip part 330 further includes a second reflection part 432 that is disposed at a side surface of the sliding part 334, disposed along an outer edge of a circle corresponding to an area in which the sliding part rotates and reflects the incident light when light emitted from the second infrared sensor 426 is incident.

Here, the second reflection part 432 is formed on the side surface of the sliding part, and the description thereof will be omitted since it is the same as the reflection part 430 in FIG. 10.

The first infrared sensor 416 for detecting a distance from the body part 331 by which the sliding part 334 has moved is provided in the guide part 332 of the hand grip part 330.

The first infrared sensor 416 emits infrared rays and detects the incident amount of infrared rays reflected from the first reflection part 431 disposed at the sliding part 334.

Here, the cleaner detects the movement distance of the sliding part which is a distance between the body part and the sliding part based on the amount of infrared rays detected by the first infrared sensor 416.

Here, the detecting of the movement distance of the sliding part includes detecting the movement distance of the sliding part based on the amount of change between the amount of infrared rays detected before the sliding part moves and the amount of infrared rays detected after the sliding part moves.

That is, when the sliding part 334 is straightly moved by the user, the first reflection part 431 disposed at the sliding part 334 moves due to being interlocked with the movement of the sliding part 334. Accordingly, the position of a reflection cell of the first reflection part 431 facing the first infrared sensor 416 is changed, and here, the infrared sensor detects the amount of infrared rays reflected from the reflection cell facing the infrared sensor.

The second infrared sensor 426 for detecting a distance by which the sliding part 334 has rotationally moved is provided in the cap part 333 of the hand grip part 330. Furthermore, the second infrared sensor 426 may also be provided in the body part 331.

Here, the second infrared sensor 426 faces the second reflection part 432.

The second infrared sensor 426 emits infrared rays and detects the incident amount of infrared rays reflected from the second reflection part 432 disposed at a side surface of the sliding part 334.

Here, the cleaner detects a rotational angle which is a rotational movement distance of the sliding part based on the amount of infrared rays detected by the second infrared sensor 426.

Figure 13:
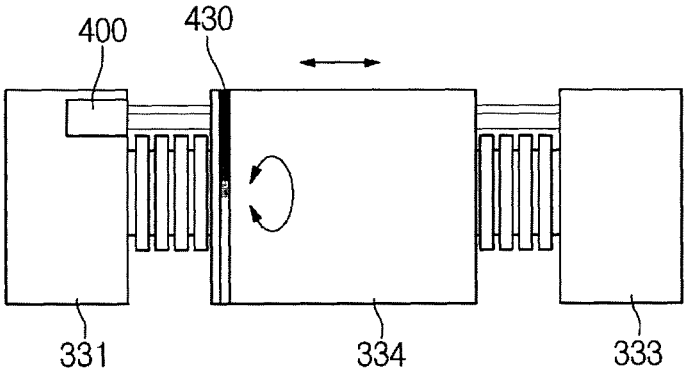

FIG. 13 is still another example of the hand grip part 330 at which the detection part 400 is provided.

The detection part 400 is in a form in which the first detection part and the second detection part are integrated and includes an infrared sensor 400 that detects straight-line movement directions and straight-line movement forces of a forward movement, a backward movement, and the like of the sliding part 334 and detects rotational movement directions and rotational movement forces of leftward and rightward rotations, and the like of the sliding part 334.

The hand grip part 330 having the infrared sensor 400 will be described.

The hand grip part 330 further includes the reflection part 430 that is disposed at a side surface of the sliding part 334, disposed along an outer perimeter of a circle corresponding to an area in which the sliding part rotates and reflects the incident light when light emitted from the infrared sensor 400 is incident.

Here, the reflection part 432 is formed at the side surface of the sliding part, and the description thereof will be omitted since it is the same as the reflection part 430 in FIG. 10.

The infrared sensor 400 that detects the amount of infrared rays reflected from the reflection part 430 is provided in the body part 331 of the hand grip part 330.

The first infrared sensor 400 emits infrared rays and detects the incident amount of infrared rays reflected from the reflection part 430 disposed at the sliding part 334.

Here, the amount of infrared rays varies according to a correlation between a distance between the infrared sensor and the side surface of the sliding part and a reflection cell facing the infrared sensor. The data are pre-acquired from an experiment.

For example, when the sliding part has rotationally moved while the straight-line movement distance of the sliding part stays the same, the detected amount of infrared rays differs according to the reflection cell facing the infrared sensor.

In addition, when the sliding part has straightly moved while the rotational angle by which the sliding part has rotationally moved stays the same, even though the reflection cell facing the infrared sensor stays the same, the distance from the sliding part varies, and thus the amount of infrared rays incident after being reflected from the sliding part also varies.

In this manner, the straight-line movement distance and the straight-line movement direction of the sliding part and the rotational angle and the rotational direction of the sliding part may be acquired based on the correlation between the distance between the infrared sensor and the sliding part and the rotational angle of the sliding part.

Figure 14:
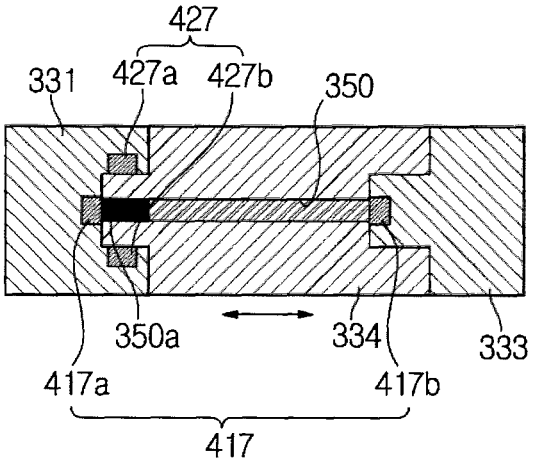
Figure 15:
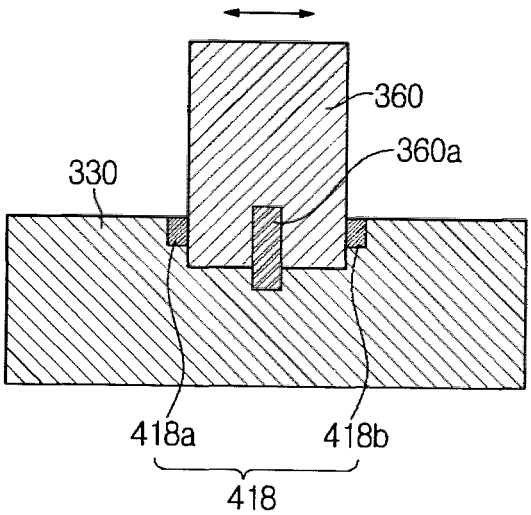
Figure 15:
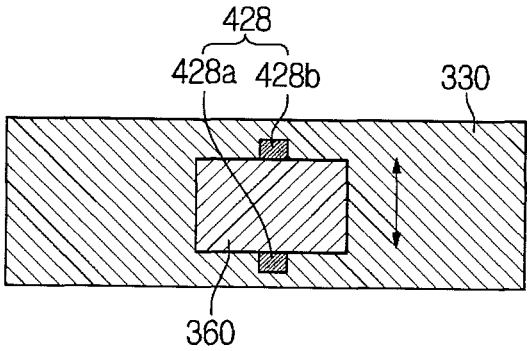

FIG. 14 is still another example of the hand grip part 330 at which the detection part 400 is provided.

The first detection part of the detection part 400 includes a first capacitance sensor 417 that detects straight-line movement directions and straight-line movement forces of a forward movement, a backward movement, and the like of the sliding part 334, and the second detection part includes a second capacitance sensor 427 that detects rotational movement directions and rotational movement forces of leftward and rightward rotations, and the like of the sliding part 334.

The structure of the hand grip part 330 having the first and second capacitance sensors 417 and 427 will be described.

The hand grip part 330 includes a shaft member 350 mounted to the sliding part 334.

The shaft member 350 straightly moves along the guide part 332 due to being interlocked with the straight-line movement of the sliding part 334. Here, the shaft member 350 is formed with a flexible material.

Furthermore, the shaft member 350 further includes a contact member 350*a* capable of coming in contact with the second capacitance sensor.

The first capacitance sensor 417 includes a first sensor 417*a* for sensing a straight-line direction corresponding to a forward movement and a second sensor 417*b* for sensing a straight-line direction corresponding to a backward movement, and the second capacitance sensor 427 includes a third sensor 427*a* for sensing a rotational direction corresponding to a rightward rotation and a fourth sensor 427*b* for sensing a rotational direction corresponding to a leftward rotation.

The first sensor 417*a* and the second sensor 417*b* of the first capacitance sensor are disposed at both ends of the shaft member 350.

Accordingly, when the shaft member 350 moves forward due to being interlocked with the straight-line movement of the sliding part 334, the shaft member 350 becomes closer to the first sensor 417*a* and becomes farther away from the second sensor 417*b*. Thus, the capacitance detected by the first sensor 417*a* becomes larger, and the capacitance detected by the second sensor 417*b* becomes smaller.

Conversely, when the shaft member 350 moves backward due to being interlocked with the backward movement of the sliding part 334, the shaft member 350 becomes farther away from the first sensor 417*a* and becomes closer to the second sensor 417*b*. Thus, the capacitance detected by the first sensor 417*a* becomes smaller, and the capacitance detected by the second sensor 417*b* becomes larger.

That is, a movement distance of the sliding part corresponding to the capacitance of the first sensor or the second sensor of the first capacitance sensor is pre-stored.

Here, although two first capacitance sensors have been used, the straight-line movement distance of the sliding part may also be detected with only one first capacitance sensor.

The third sensor 427*a* and the fourth sensor 4276 of the second capacitance sensor are disposed at both ends of the contact member 350*a* provided in the shaft member.

That is, the third sensor 427*a* of the second capacitance sensor is disposed at the right side with respect to the shaft member, and the fourth sensor 427*b* is disposed at the left side with respect to the shaft member.

Accordingly, when the shaft member 350 rotates rightward due to being interlocked with the rightward rotation of the sliding part 334, the contact member 350*a* rotates rightward due to being interlocked with the rightward rotation of the shaft member, and by the rightward rotation of the contact member 350*a*, the contact member 350*a* becomes closer to the third sensor 427*a* and becomes farther away from the fourth sensor 427*b*. Accordingly, the capacitance detected by the third sensor 427*a* becomes larger, and the capacitance detected by the fourth sensor 427*b* becomes smaller.

Conversely, when the shaft member 350 rotates leftward due to being interlocked with the leftward rotation of the sliding part 334, the contact member 350*a* rotates leftward due to being interlocked with the leftward rotation of the shaft member, and accordingly, the contact member 350*a* becomes farther away from the third sensor 427*a* and becomes closer to the fourth sensor 427*b*. Thus, the capacitance detected by the third sensor 427*a* becomes smaller, and the capacitance detected by the fourth sensor 427*b* becomes larger.

That is, a rotational angle which is a movement distance of the sliding part corresponding to the capacitance of the third sensor or the fourth sensor of the second capacitance sensor is pre-stored.

Here, although two second capacitance sensors have been used, the rotational angle of the sliding part may also be detected with only one second capacitance sensor.

In this manner, the first capacitance sensor and the second capacitance sensor may be used to detect the straight-line movement and the rotation of the sliding part.

Here, although a capacitance sensor has been used as the first detection part and the second detection part, a strain gage that measures a degree of deformation when being deformed by an external force applied via the shaft member or the contact member may also be used, and a load cell that detects a force or a load may also be used.

FIGS. 15A and 15B are still another examples of the hand grip part 330 at which the detection part 400 is provided.

The first detection part of the detection part 400 includes a first strain gage 418 that detects straight-line movement directions and straight-line movement forces of a forward movement, a backward movement, and the like of the sliding part 334, and the second detection part includes a second strain gage 428 that detects rotational movement directions and rotational movement forces of leftward and rightward rotations, and the like of the sliding part 334.

The structure of the hand grip part 330 having the first and second strain gages 418 and 428 will be described.

The hand grip part 330 includes the body part, the cap part, and the guide part disposed between the body part and the cap part and further includes a manipulation member 360 mounted on the guide part.

The manipulation member 360 may be mounted to the guide part by a shaft member 360*a* which is flexible.

Here, the manipulation member 360 is formed in the shape of a joystick and moves forward, backward, leftward, and rightward by the shaft member.

The first strain gage 418 includes a first gage 418*a* for sensing a straight-line direction corresponding to a forward movement and a second gage 418*b* for sensing a straight-line direction corresponding to a backward movement, and the second strain gage 428 includes a third gage 428*a* for sensing a rotational direction corresponding to a rightward rotation and a fourth gage 428*b* for sensing a rotational direction corresponding to a leftward rotation.

The first gage 418*a* of the first strain gage is disposed in front of the manipulation member 360, and the second gage 418*b* is disposed behind the manipulation member 360.

Accordingly, when the manipulation member 360 moves forward, the first gage is deformed by the manipulation member, and when the manipulation member 360 moves backward, the second gage is deformed by the manipulation member.

That is, according to whether the first gage and the second gage are deformed and the degree of deformation thereof, whether a movement direction intended by the user is forward or backward may be obtained, and a movement distance intended by the user may also be obtained.

Furthermore, straight-line movement distances of the cleaning tool assembly corresponding to the degree of deformation of the first gage and the second gage of the first strain gage are pre-stored.

The third gage 428*a* of the second strain gage is disposed at the right of the manipulation member 360, and the fourth gage 428*b* is disposed at the left of the manipulation member 360.

Accordingly, when the manipulation member 360 moves rightward, the third gage is deformed by the manipulation member, and when the manipulation member 360 moves leftward, the fourth gage is deformed by the manipulation member.

That is, according to whether the third gage and the fourth gage are deformed and the degree of deformation thereof, whether a rotational direction intended by the user is rightward or leftward may be obtained, and a rotational angle of the cleaning tool assembly intended by the user may also be obtained.

Furthermore, rotational angles of the cleaning tool assembly corresponding to the degree of deformation of the third gage and the fourth gage of the second strain gage are pre-stored.

In this manner, the first strain gage and the second strain gage may be used to detect the straight-line movement and the rotational movement of the cleaning tool assembly.

Here, although a strain gage has been used as the first detection part and the second detection part, a capacitance sensor in which the capacitance is changed by a movement of the manipulation member may also be used, and a load cell that detects a force or a load applied by the manipulation member may also be used.

Furthermore, a magnetic sensor and a high-frequency oscillation type induction sensor may also be used.

Figure 16:
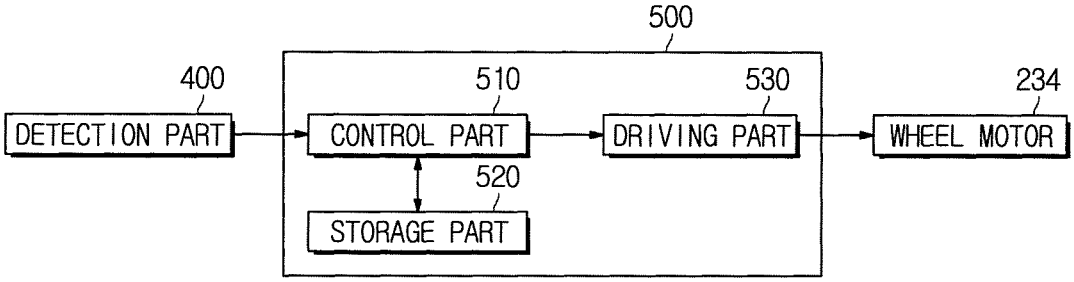
FIG. 16 is a control block diagram of the cleaner according to the first embodiment.

FIG. 16 is a control block diagram of the cleaner according to the first embodiment.

The cleaner capable of steering control includes the detection part 400 and a driving module 500.

The detection part 400 detects the magnitude and the direction of a force applied by the user and transmits a detection signal to the control part 510 of the driving module 500.

Here, the direction of the force is at least one direction among forward, backward, leftward, and rightward, and the magnitude of the force is a movement displacement of the cleaning tool assembly and includes a movement distance when moving in a straight line and a rotational angle when rotating.

Furthermore, the direction of the force is determined according to whether a value of a signal detected before the sliding part moves increases or decreases, and the magnitude of the force is determined according to a difference between a value detected before the sliding part moves and a value detected after the sliding part moves.

The driving module 500 drives the moving part provided in the cleaning tool assembly based on a signal detected by the detection part, thereby adding a movement force of the cleaner.

The driving module 500 includes the control part 510, a storage part 520, and a driving part 530.

When a detection signal transmitted from the detection part 400 is received, the control part 510 determines the magnitude and the direction of a force acted on the handle part 300 based on the received detection signal and controls the operation of each of the wheel motors provided in the cleaning tool assembly based on the determined magnitude and direction of the force.

Figure 17:
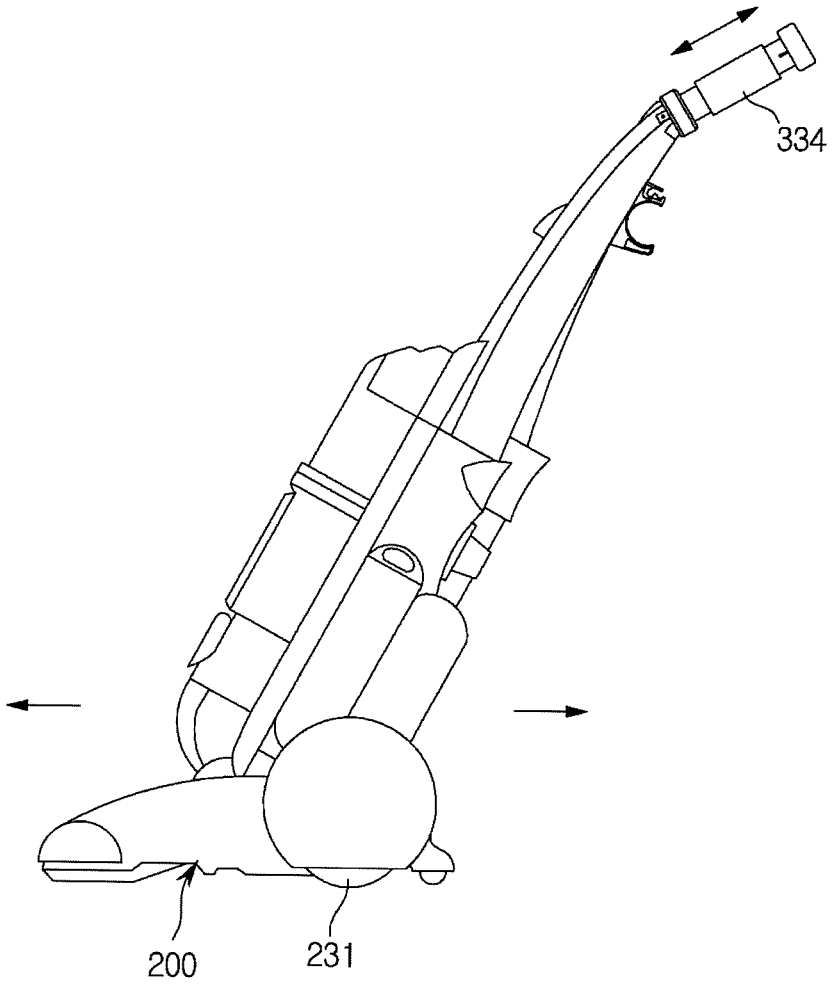
FIGS. 17, 18A, and 18B are exemplary views of a movement of the cleaning tool assembly corresponding to a manipulation state of the handle part illustrated in FIG. 5.

As illustrated in FIG. 17, when the direction of the force acted on the handle part is determined to be forward, the control part 510 controls the rotational directions of the pair of wheel motors to be a first direction so that the cleaning tool assembly moves forward, and when the direction of the force acted on the handle part is determined to be backward, the control part 510 controls the rotational directions of the pair of wheel motors to be a second direction so that the cleaning tool assembly moves backward.

Furthermore, the control part 510 checks a movement distance corresponding to the magnitude of the force acted on the handle part when moving forward or backward, checks the number of rotations of the wheel motors corresponding to the checked movement distance, and controls the pair of wheel motors to be rotated by the checked number of rotations.

Figure 18A:
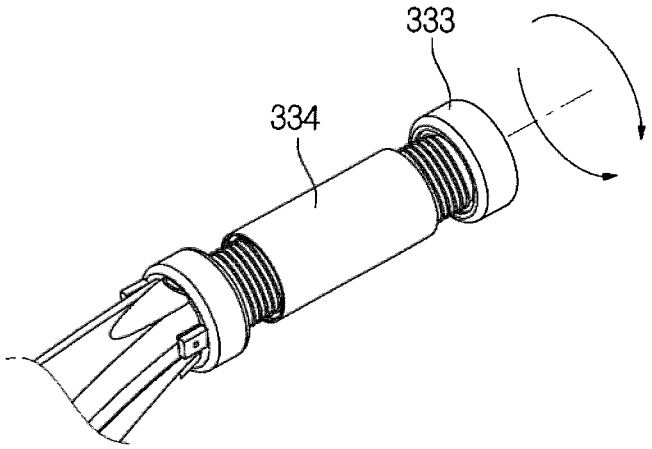
Figure 18B:
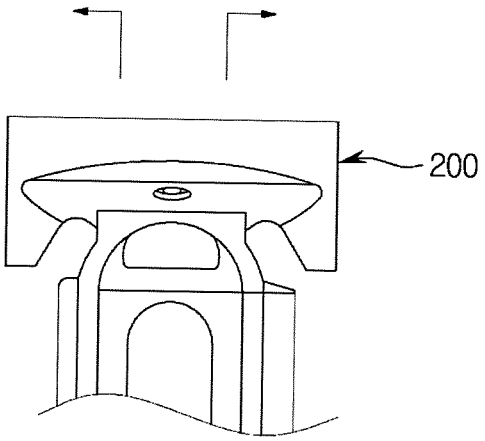

As illustrated in FIGS. 18A and 18B, when the direction of the force acted on the handle part is determined to be rightward, the control part 510 controls the rotational directions of the pair of wheel motors to be the first direction while controlling the pair of wheel motors by a different number of rotations so that the cleaning tool assembly rotates rightward, and when the direction of the force acted on the handle part is determined to be leftward, the control part 510 controls the rotational directions of the pair of wheel motors to be the first direction while controlling the pair of wheel motors by a different number of rotations so that the cleaning tool assembly rotates leftward.

Furthermore, the control part 510 checks a rotational angle corresponding to the magnitude of the force acted on the handle part when rotating rightward or leftward, checks the number of rotations of the wheel motors corresponding to the checked rotational angle, and controls the pair of wheel motors to be rotated by the checked number of rotations.

The storage part 520 may store a movement direction corresponding to the magnitude of the force and may also store a movement distance (or a rotational angle) corresponding to an amount of change of the magnitude of the force.

The storage part 520 may also store a detection signal corresponding to an initial position of the sliding part.

The driving part 530 rotates each of the wheel motors connected to a pair of wheels based on a command of the control part 510.

In this way, the cleaning tool assembly may straightly move forward and backward or rotate leftward or rightward.

In this manner, by controlling the movement of the cleaning tool assembly corresponding to the user's intention, the steering performance may be improved by reducing a horizontal load felt by the user when the user holds and moves the handle of the cleaner, fatigue felt when performing a cleaning operation may be removed by removing the vertical load applied by the handle, and convenience may be improved.

Hereinafter, a cleaner according to a second embodiment of the present disclosure will be described.

In the description of the embodiment, descriptions of configurations overlapping with the previous embodiment will be omitted.

Figure 19:
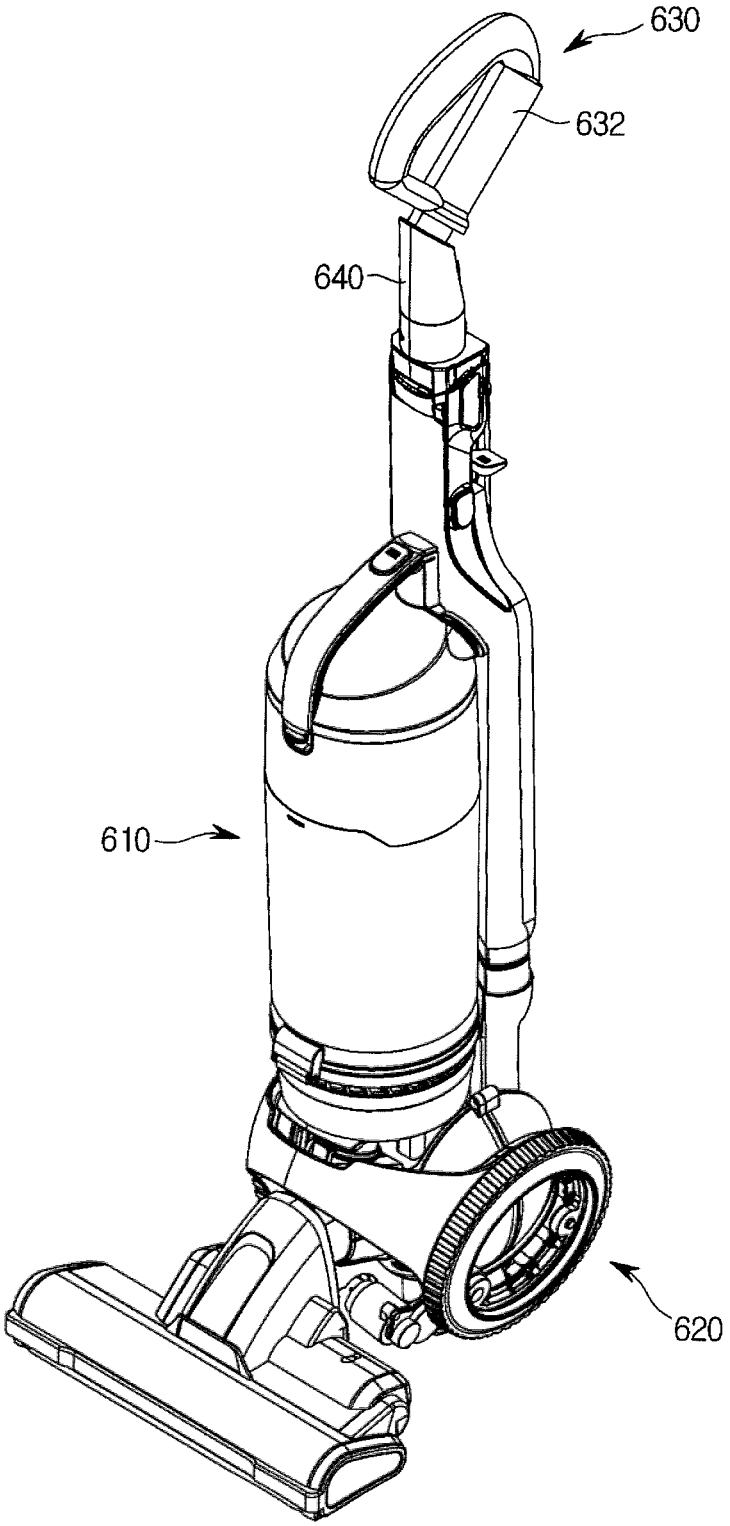
FIG. 19 is a perspective view of a cleaner according to a second embodiment of the present disclosure.
Figure 20:
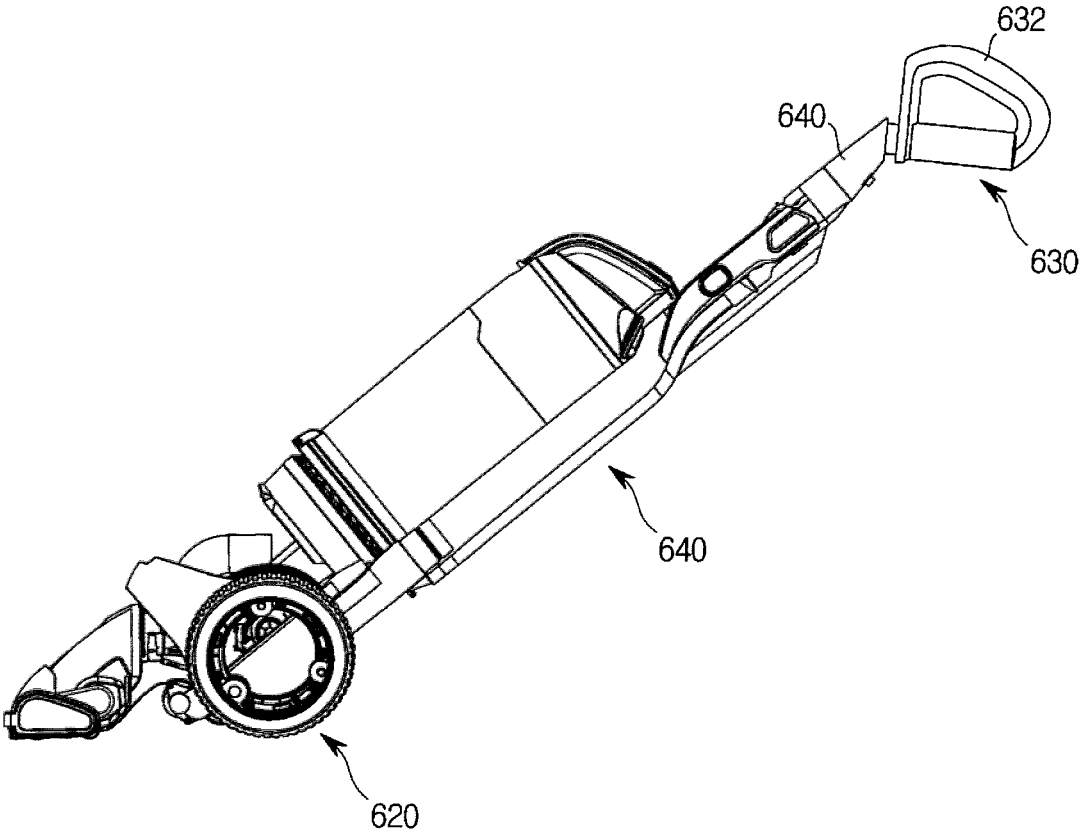
FIG. 20 is a side view of the cleaner according to the second embodiment of the present disclosure.
Figure 21:
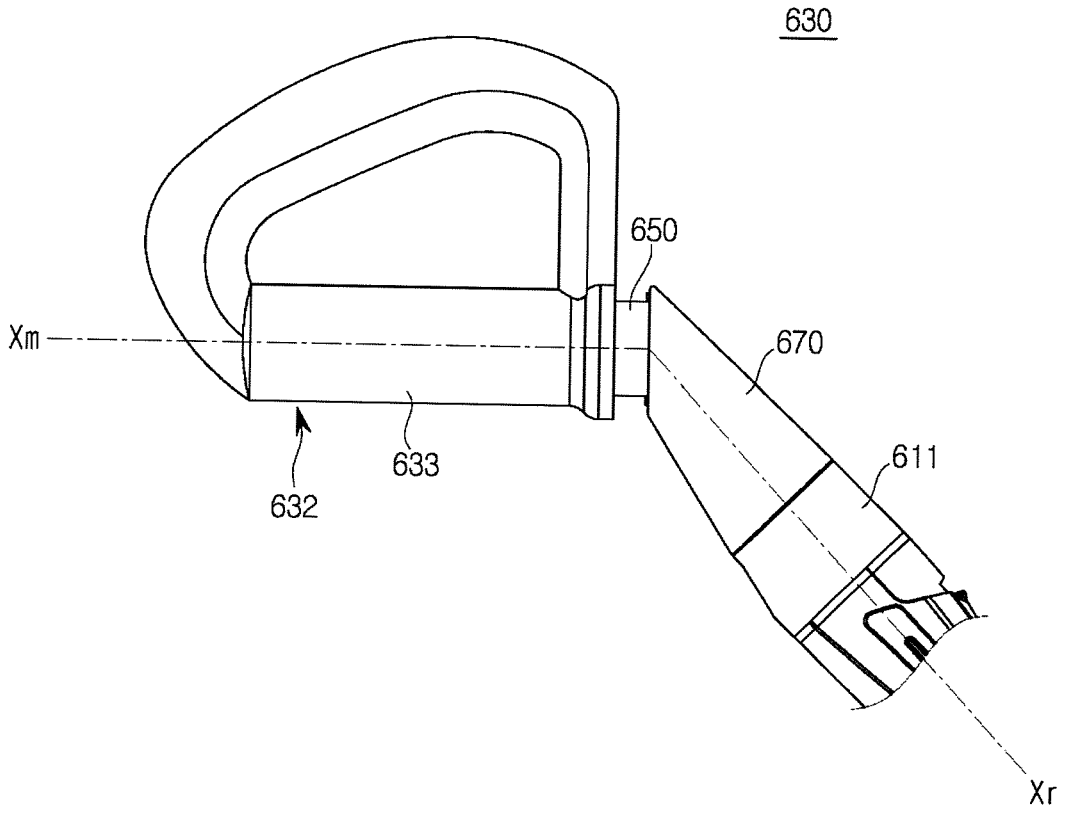
FIG. 21 is a side view of a handle part of the cleaner according to the second embodiment of the present disclosure.
Figure 22:
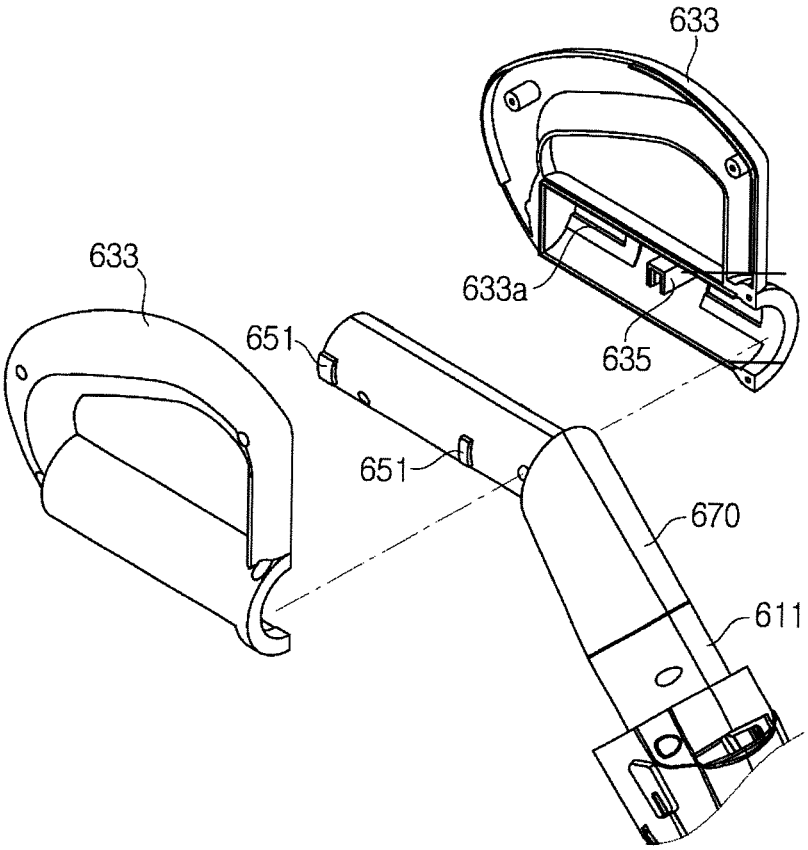
FIG. 22 is an exploded perspective view of the handle part of the cleaner according to the second embodiment of the present disclosure.

FIG. 19 is a perspective view of the cleaner according to the second embodiment of the present disclosure, FIG. 20 is a side view of the cleaner according to the second embodiment of the present disclosure, FIG. 21 is a side view of a handle part of the cleaner according to the second embodiment of the present disclosure, and FIG. 22 is an exploded perspective view of the handle part of the cleaner according to the second embodiment of the present disclosure.

The cleaner of the embodiment is an upright cleaner and may include a main body 610, a cleaning tool assembly 620, a handle part 630, and a control part. The cleaner may be operated by receiving power from an external power source or an internal battery. The cleaning tool assembly 620 is provided to be movable on a surface to be cleaned. The cleaning tool assembly 620 comes in contact with a floor surface, sweeps up or scatters dust on the floor surface, and suctions in the swept-up or scattered dust.

The cleaning tool assembly 620 may be mounted to one portion of the main body 610, and the handle part 630 may be mounted on the other portion thereof. Also, the main body 610 stores foreign substances suctioned in by the cleaning tool assembly 620 and transmits a force acted on the handle part 630 to the cleaning tool assembly 620.

The handle part 630 is provided either to redirect the cleaner or vary the movement speed of the cleaner. That is, the handle part 630 may be manipulated to operate the cleaner. Although the cleaner may be operated by physically manipulating the handle part 630, the cleaner may also be easily operated by an electric manipulation as in the embodiment of the present disclosure.

The handle part 630 is provided to relatively move with respect to the main body 610, and the manipulation of the handle part 630 is detected by the detection part. The cleaning tool assembly 620 may be provided to be controlled by the control part using a signal detected by the detection part.

That is, a force applied to the handle part 630 is detected or the relative movement amount and the relative rotation amount of the handle part 630 with respect to the main body 610 is measured to recognize the user's intention on the manipulation of the cleaner and control the cleaning tool assembly 620. In this way, the user may easily redirect, move, control the speed of, and rotate the cleaner.

On the basis of information on the relative movement amount and the relative rotation amount transmitted from the handle part 630, the control part controls the cleaning tool assembly 620. The control part may control the movement speed and the rotation amount of the cleaning tool assembly 620 to vary according to the manipulation direction of the handle part 630 and the force applied by the manipulation.

The handle part 630 may include a control part 632 and a guide part 640.

The control part 632 is provided to be gripped by the user. Also, the control part 632 is provided to move along the guide part 640 to be described below. That is, the control part 632 is provided to relatively move with respect to the guide part 640.

The control part 632 is formed to surround at least a portion of a movement guide part 650 to be described below and may include a control body 633 formed to be movable along an outer circumferential surface of the movement guide part 650 and a control holder 635 protruding from an inner circumferential surface of the control body 633.

The guide part 640 guides the movement of the control part 632 and is provided to relatively move with respect to the main body 610.

The guide part 640 may include a rotation guide part 670 and the movement guide part 650.

The rotation guide part 670 is provided to be rotatable with respect to the main body 610. That is, the rotation guide part 670 is formed nearly in the shape of a rod and is provided to be relatively rotatable with respect to the main body 610. In detail, the rotation guide part is provided to be rotatable with respect to the main body 610 about a virtual rotation axis Xr formed in the longitudinal direction of the main body 610. The rotation guide part 670 is provided to define left and right directions with respect to a progressing direction of the cleaner.

A sensor that detects a rotation of the handle part 630 is provided in the rotation guide part 670. The operations of the sensor and the rotation guide part 670 will be described in detail below.

The movement guide part 650 may be formed extending from the rotation guide part 670. The movement guide part 650 is formed nearly in the shape of a rod and is provided to define front and rear directions with respect to a progressing direction of the cleaner. The movement guide part 650 is provided to enable the control part 632 to be described below to move. The movement guide part 650 is provided so that the control part 632 is movable in the front and rear directions. In detail, a movement guide rail 633*a* formed in the shape of a groove to move along the movement guide part 650 is formed at an inner surface of the control body 633, and a movement guide protrusion 651 corresponding to the movement guide rail 633*a* is formed at the movement guide part 650.

When the main body 610 is tilted by a predetermined angle with respect to the surface to be cleaned in order to use the upright cleaner, the movement guide part 650 may be provided to be parallel to the surface to be cleaned. In detail, the movement guide part 650 is formed along a movement axis Xm formed to be tilted by a predetermined angle from the rotation axis Xr of the rotation guide part 670, and the control part 632 is provided to move along the movement axis Xm. That is, the movement guide part 650 may be formed by being bent and extending from the rotation guide part 670.

The rotation guide part 670 may rotate about the rotation axis Xr formed along the longitudinal direction of the main body 610, and the movement guide part 650 may be formed to extend from the rotation guide part 670 along the movement axis Xm formed to be tilted by a predetermined angle from the rotation axis Xr. The cleaner includes a standby state in which the main body 610 is vertically disposed with respect to the ground and an operable state in which the cleaner is usable by the main body 610 tilted from the standby mode position, and in the operable state, the movement axis Xm may be provided to be parallel to the ground.

Since the movement axis Xm is provided parallel to the ground while the main body 610 is tilted to use the upright cleaner, the user may apply only the force for a horizontal movement to the control part 632, thereby more easily manipulating the cleaner.

The sensor that detects a movement of the handle part 630 is provided in the movement guide part 650. The operations of the sensor and the movement guide part 650 will be described in detail below.

Figure 23:
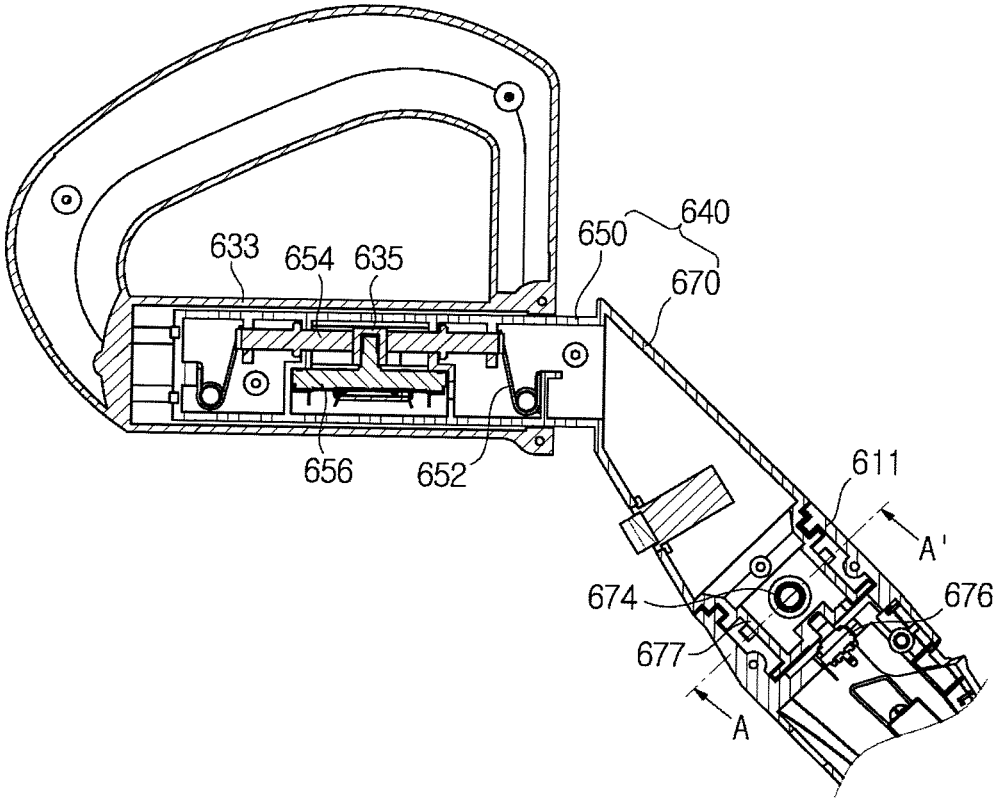
FIG. 23 is a cross-sectional view of the handle part of the cleaner according to the second embodiment of the present disclosure.
Figure 24:
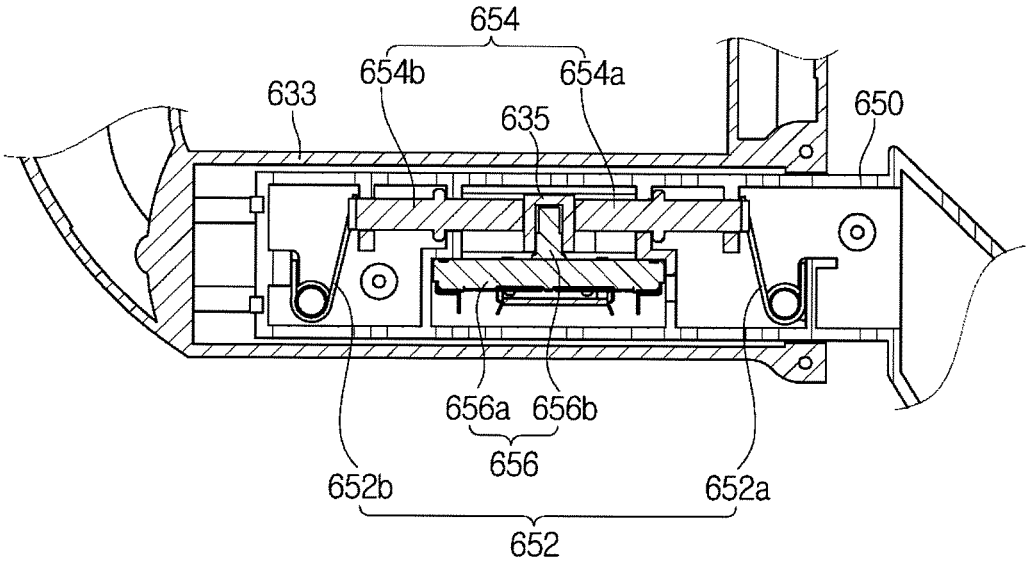
FIG. 24 is an enlarged cross-sectional view of the handle part of the cleaner according to the second embodiment of the present disclosure.

FIG. 23 is a cross-sectional view of the handle part of the cleaner according to the second embodiment of the present disclosure, and FIG. 24 is an enlarged cross-sectional view of the handle part of the cleaner according to the second embodiment of the present disclosure.

The detection part includes a first detection part that detects a straight-line movement direction and a straight-line movement force of the control part 632 and a second detection part that detects a rotational direction and a rotational movement force of the guide part 640. The first detection part transmits a first detection signal detected by the first detection part to the control part and transmits a second detection signal detected by the second detection part to the control part.

Here, the first detection part may be implemented with any one of a linear potentiometer, an optical sensor such as an infrared sensor, a capacitance sensor, a strain gage, a load cell, a magnetic sensor, and a high-frequency oscillation type induction sensor, and the second detection part may be implemented with any one of a rotational potentiometer, an optical sensor such as an infrared sensor, a capacitance sensor, a strain gage, a load cell, a magnetic sensor, and a high-frequency oscillation type induction sensor.

The movement guide part 650 includes the first detection part and a movement restoring elastic member 652.

The first detection part includes a first potentiometer 656 which is a linear potentiometer that detects a straight-line movement direction and a straight-line movement force of a forward movement, a backward movement, and the like of the control part 632.

The first potentiometer 656 is a variable resistor that converts a straight-line displacement into a change in an electrical resistance and includes a resistor 656*a* disposed to be fixed in the movement guide part 650 and a displacement member 656*b* that is connected to the control holder 635 and adjusts a resistance value of the resistor 656*a* by sliding the resistor 656*a*.

That is, when the control part 632 is straightly moved by the user, the displacement member 656*b* is straightly moved by the control holder 635 and is provided to slide the resistor 656*a*.

Here, a resistance value of the resistor 656*a* of the first potentiometer 656 is changed based on the direction and the distance in which the displacement member 656*b* of the first potentiometer 656 has straightly moved, and an electrical signal with respect to the straight-line movement direction and the straight-line movement force of the control part 632 may be obtained based on the resistance value of the first potentiometer 656.

That is, the straight-line movement direction and movement distance of the cleaning tool assembly 620 corresponding to the user's intention may be acquired. Here, the straight-line movement distance of the cleaning tool assembly 620 may be determined based on the straight-line movement force.

At least one movement restoring elastic member 652 is provided to enable the displacement member 656*b* to be restored to the original position. The movement restoring elastic member 652 is disposed in a pair to elastically press the displacement member 656*b* and the control holder 635 so that the displacement member 656*b* whose position has changed by the manipulation of the control part 632 may be restored to the original position.

In detail, the movement guide part 650 includes a pair of movement limiting members 654 provided to selectively come in contact with both sides of the movement direction of the control holder 635 and provided to prevent movement within a predetermined section. The pair of movement restoring elastic members 652 are provided to respectively press end portions of the pair of movement limiting members 654 toward the control holder 635 disposed between the pair of movement limiting members 654. By the above configuration, the control part 632 is provided to be restored to the original position when external force on the control part 632 is released.

For convenience of description, the movement restoring elastic members 652 include a first movement restoring elastic member 652*a* disposed in front of the control holder 635 and a second movement restoring elastic member 652*b* disposed behind the control holder 635. The pair of movement limiting members 654 include a first movement limiting member 654*a* disposed between the first movement restoring elastic member 652*a* and the control holder 635 and a second movement limiting member 654*b* disposed between the second movement restoring elastic member 652*b* and the control holder 635.

When the control part 632 is moved forward, the control holder 635 moves the displacement member 656*b* and changes the resistance value of the resistor 656*a*. Also, the control holder 635 presses the first movement limiting member 654*a* while moving forward.

When the control part 632 is moved backward, the control holder 635 moves the displacement member 656*b* and changes the resistance value of the resistor 656*a*. Also, the control holder 635 presses the second movement limiting member 654*b* while moving backward.

When the external force on the control part 632 is released, the control part 632 is restored to the original position by the first movement restoring elastic member 652*a* and the second movement restoring elastic member 652*b*.

In addition, when matched with a resistance value according to a spring force (f(x)=kx, k is a spring constant) of the movement restoring elastic member 652, the direction and the speed at which the cleaner moves may be controlled according to the magnitude of a force applied to the control part 632 by the user.

Figure 25:
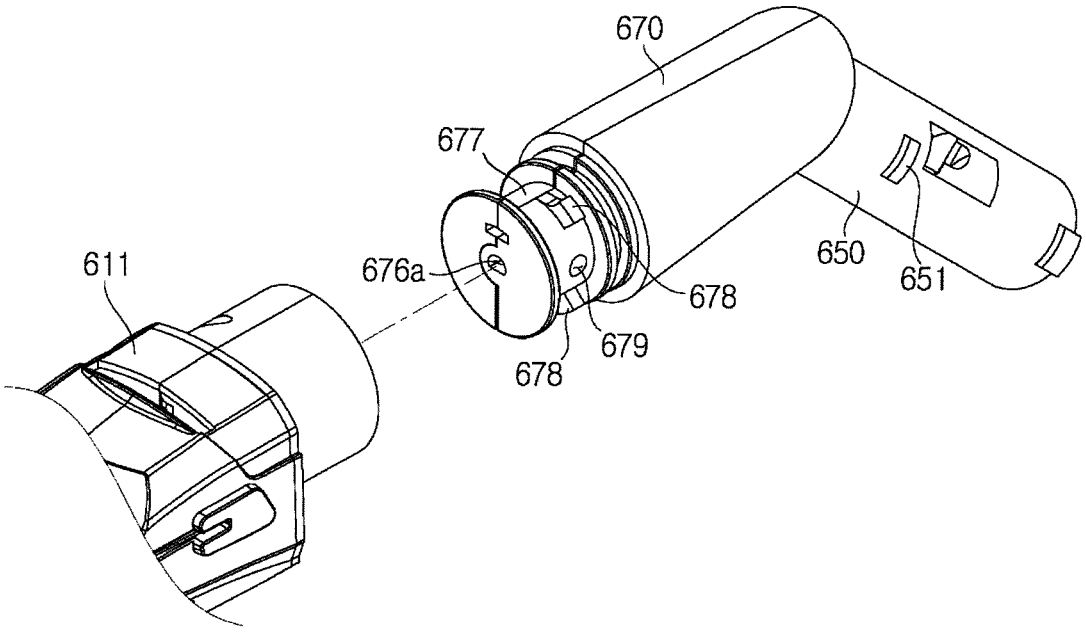
FIG. 25 is a view related to coupling between the handle part and a guide coupling part of the cleaner according to the second embodiment of the present disclosure.
Figure 26:
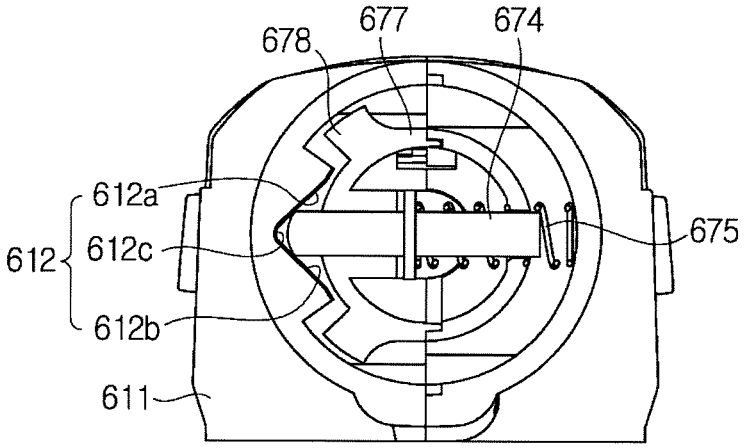
FIG. 26 is a cross-sectional view taken along line A-A' in FIG. 23.

FIG. 25 is a view related to coupling of the handle part and a guide coupling part of the cleaner according to the second embodiment of the present disclosure, and FIG. 26 is a cross-sectional view taken along line A-A' in FIG. 23.

The rotation guide part 670 includes the second detection part and a steering unit 674.

The second detection part includes a second potentiometer 676 which is a rotational potentiometer that detects rotational movement directions and rotational movement forces of leftward and rightward rotations, and the like of the rotation guide part 670.

The second potentiometer 676 is disposed to be fixed to a guide coupling part 611 of the main body 610 and is provided to detect a rotation of the rotation guide part 670. The second potentiometer 676 is coupled to a sensor hole 676*a* of the rotation guide part 670 in order to detect a rotation of the rotation guide part 670.

The steering unit 674 is provided to be elastically restorable with respect to the rotation of the rotation guide part 670. First, a sloped part 612 along which the steering unit 674 moves will be described.

The sloped part 612 is provided at a portion of the main body 610 coupled to the rotation guide part 670. The sloped part 612 may be disposed to face the rotation guide part 670. The sloped part 612 includes a pair of sloped surfaces formed to be symmetrical to each other. The sloped part 612 includes a first sloped surface 612*a*, a second sloped surface 612*b* symmetrical to the first sloped surface 612*a*, and an inflected part 612*c* at which the first sloped surface 612*a* and the second sloped surface 612*b* meet.

The steering unit 674 is provided to relatively rotate with respect to the main body 610 together with the rotation guide part and is provided to elastically and straightly move inside the rotation guide part 670. One end portion of the steering unit 674 is provided to come in contact with the sloped part 612, and the other end portion thereof is provided to be elastically supported by a steering elastic member 675. Despite the relative rotational movement of the rotation guide part 670 with respect to the main body 610 due to the elastic force of the steering elastic member 675, the steering unit 674 moves along the sloped part 612 while remaining in contact with the sloped part 612.

The steering unit 674 moves along the first sloped surface 612*a* or the second sloped surface 612*b* by an external force and is provided to be disposed at the inflected part 612*c* when the external force is released.

The rotation guide part 670 may include a steering holder 677. The steering holder 677 is provided to guide the movement of the steering unit 674 so that the steering unit 674 may straightly move elastically. The steering holder 677 is integrally formed with the rotation guide part 670 and is provided to be rotatable together with the rotation guide part 670. A steering hole 679 in the shape of a hole is formed at the steering holder 677 to have the steering unit 674 inserted and be movable therein. The steering holder 677 is formed in a nearly cylindrical shape.

The steering holder 677 may include a holder stopper 678. The holder stopper 678 is provided to prevent rotations of the steering holder 677 and the steering unit 674 caused by the rotation of the rotation guide part 670 from being deviated from a predetermined section. That is, the holder stopper 678 is provided to limit the rotations of the steering holder 677 and the steering unit 674 to be within a predetermined section. The holder stopper 678 may be provided to protrude from the steering holder 677, and a pair of holder stoppers 678 may be provided at both sides with respect to the steering unit 674 to prevent the steering unit 674 from being detached from the contact with the sloped part 612. The steering unit 674, the holder stopper 678, and the sloped part 612 may be disposed on the same plane perpendicular to the direction of the rotation axis Xr of the rotation guide part 670.

Figure 27:
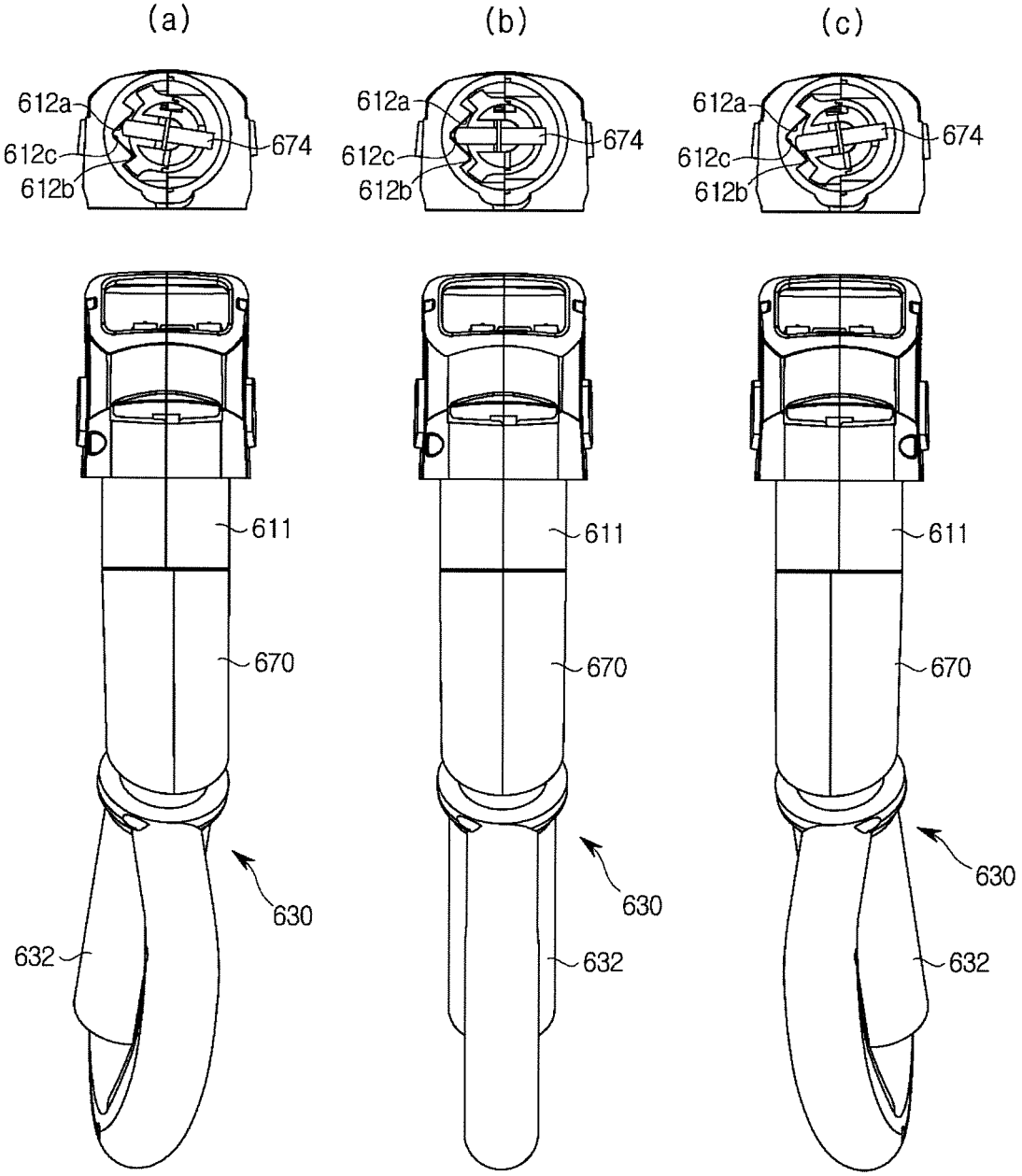
FIG. 27 is a view related to manipulations of a steering unit and the handle part according to the second embodiment of the present disclosure.

FIG. 27 is a view related to the manipulations of the steering unit and the handle part according to the second embodiment of the present disclosure.

FIG. 27(*a*) illustrates the steering unit 674 disposed on the first sloped surface 612*a* when an external force in one direction is acted on the handle part 630. As a rotational external force is acted on the handle part 630, the rotation guide part 670 that relatively rotates with respect to the main body 610 rotates in one direction. Here, one end portion of the steering unit 674 comes in contact with the first sloped surface 612*a* at the inflected part 612*c* and moves along the first sloped surface 612*a*. Due to the operation of the steering unit 674, the steering elastic member 675 becomes more compressed than in the initial state. Here, when the external force is released, the one end portion of the steering unit 674 moves along the first sloped surface 612*a* and is disposed at the inflected part 612*c* by the elastic restoration of the steering elastic member 675.

FIG. 27(*b*) illustrates the steering unit 674 disposed at the original position when an external force is not acted on the handle part 630. The one end portion of the steering unit 674 is disposed at the inflected part 612*c*.

FIG. 27(*c*) illustrates the steering unit 674 disposed at the second sloped surface 612*b* when an external force in the other direction is acted on the handle part 630. As the rotational external force is acted on the handle part 630, the rotation guide part 670 that relatively rotates with respect to the main body 610 rotates in the other direction. Here, one end portion of the steering unit 674 comes in contact with the second sloped surface 612*b* at the inflected part 612*c* and moves along the second sloped surface 612*b*. Due to the operation of the steering unit 674, the steering elastic member 675 becomes more compressed than in the initial state. Here, when the external force is released, the one end portion of the steering unit 674 moves along the second sloped surface 612*b* and is disposed at the inflected part 612*c* by the elastic restoration of the steering elastic member 675.

Hereinafter, a cleaner according to a third embodiment of the present disclosure will be described.

In the description of the embodiment, descriptions of configurations overlapping with the previous embodiments will be omitted.

Figure 28:
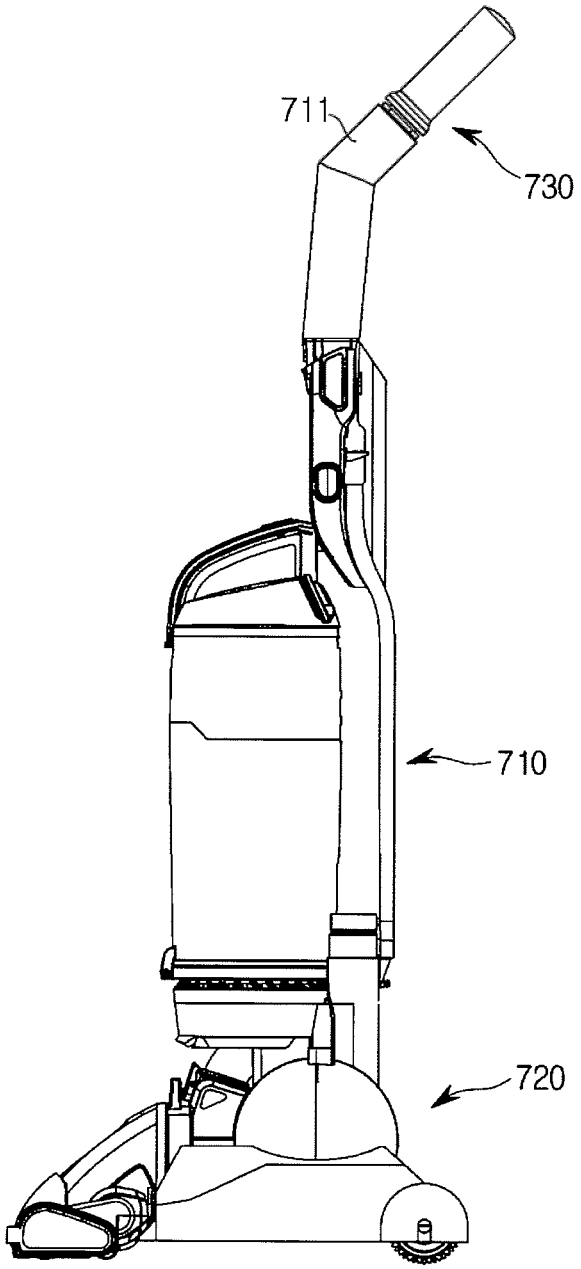
FIG. 28 is a side view of a cleaner according to a third embodiment of the present disclosure.

FIG. 28 is a side view of the cleaner according to the third embodiment of the present disclosure.

The cleaner of the embodiment is an upright cleaner and may include a main body 710, a cleaning tool assembly 720, and a handle part 730. The cleaner may be operated by receiving power from an external power source or an internal battery.

The cleaning tool assembly 720 may be mounted to one portion of the main body 710 and the handle part 730 may be mounted to the other portion thereof. Also, the main body 710 stores foreign substances suctioned in by the cleaning tool assembly 720 and transmits a force acted on the handle part 730 to the cleaning tool assembly 720.

Figure 29:
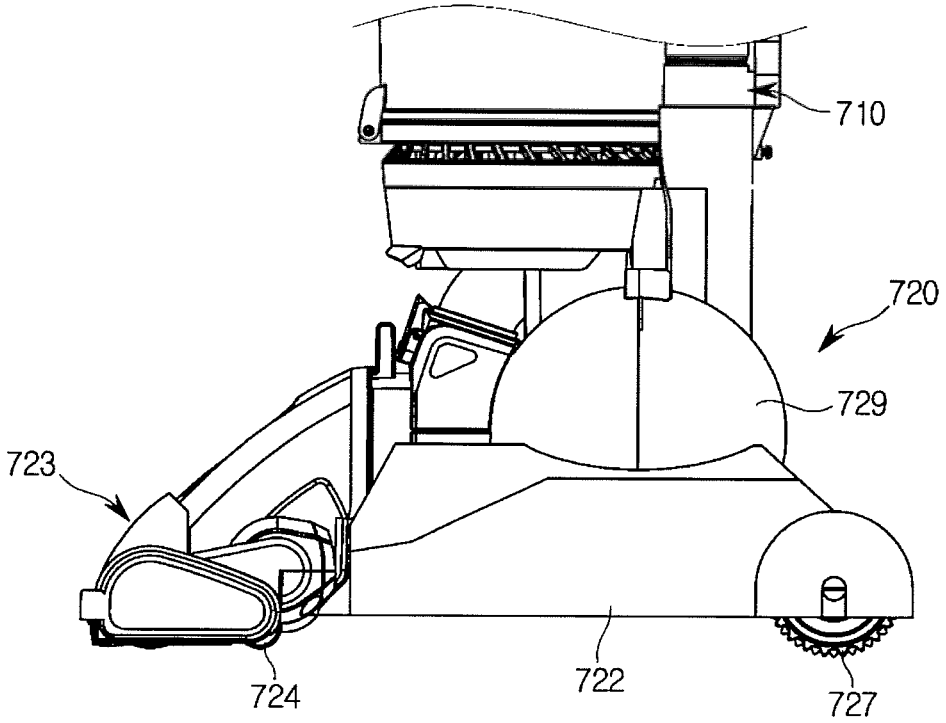
FIG. 29 is an enlarged view of a part of the cleaner according to the third embodiment of the present disclosure.
Figure 30:
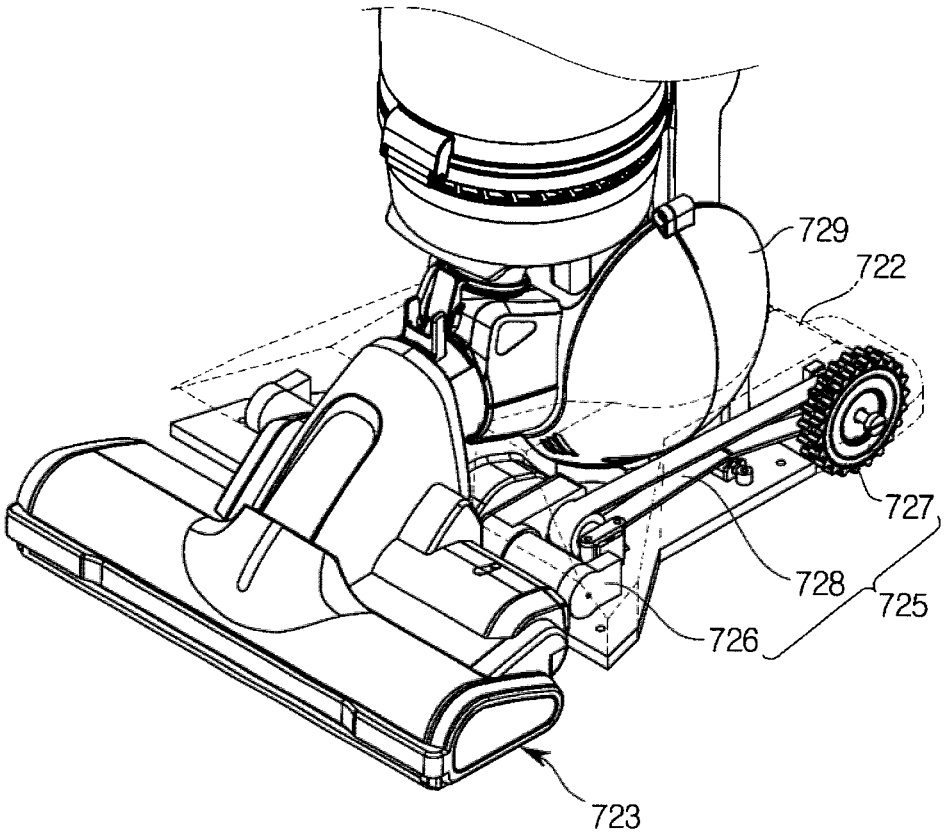
FIG. 30 is a perspective view of the cleaning tool assembly according to the third embodiment of the present disclosure.

FIG. 29 is an enlarged view of a part of the cleaner according to the third embodiment of the present disclosure, and FIG. 30 is a perspective view of the cleaning tool assembly according to the third embodiment of the present disclosure.

The cleaning tool assembly 720 is mounted to the lower portion of the main body 710 to be rotatable forward and backward or leftward and rightward with respect to the navigating direction when moving forward or backward. In detail, the main body 710 and the cleaning tool assembly 720 are connected via a rotation part 729, and the main body 710 is provided to be rotatable by the rotation part 729 while the cleaning tool assembly 720 is in contact with the surface to be cleaned. Since an elastic member is provided inside the rotation part 729, the moment load generated due to the handle part 730 and the main body 710 being tilted while being used by the user is offset by a restoration force of a spring, and thus the manipulation force applied to the user's hand is compensated. In the embodiment of the present disclosure, a torsion spring may be applied as the elastic member.

The cleaning tool assembly 720 comes in contact with the floor surface, sweeps up or scatters dust on the floor surface, and suctions in the swept-up or scattered dust. Here, the dust suctioned in is transmitted to the dust collecting part.

The cleaning tool assembly 720 includes a cleaning tool housing 722 that forms an exterior, a brush part 723 that is disposed in the cleaning tool housing 722 and sweeps up dust, and a driving part 725 that is disposed in the cleaning tool housing 722 and adds a movement force to the cleaner. A front wheel 724 that supports the front portion of the cleaning tool assembly 720 is mounted to the brush part 723.

The driving part 725 may include a driving force generation part 726 that generates a driving force and at least two main wheels 727 that receive power from the driving force generation part 726 for moving the cleaning tool assembly 720. The type of the driving force generation part 726 is not limited, but the driving force generation part 726 includes a motor in the embodiment of the present disclosure.

Coupling between the driving force generation part 726 and the main wheels 727 is not limited, but in the embodiment of the present disclosure, the driving force generation part 726 and the main wheels 727 may be provided to be connected by a belt 728 so that the power generated from the driving force generation part 726 is transmitted to the main wheels 727. By the above configuration, the driving force generation part 726 may be disposed at the front portion of the cleaning tool assembly 720, and the main wheels 727 may be disposed at the rear portion of the cleaning tool assembly 720. The main wheels 727 are disposed further behind the rotation part 729 to enable the cleaner to be stably supported.

The cleaning tool assembly 720 may be supported by two points by the front wheel 724 and the main wheels 727. The cleaner may of course be designed in a way that a larger number of wheels are mounted. However, in the embodiment of the present disclosure, the cleaning tool assembly 720 is supported by two points with respect to the surface to be cleaned such that the cleaning tool assembly 720 may be in close contact with the surface to be cleaned even when the surface to be cleaned is curved.

Figure 31:
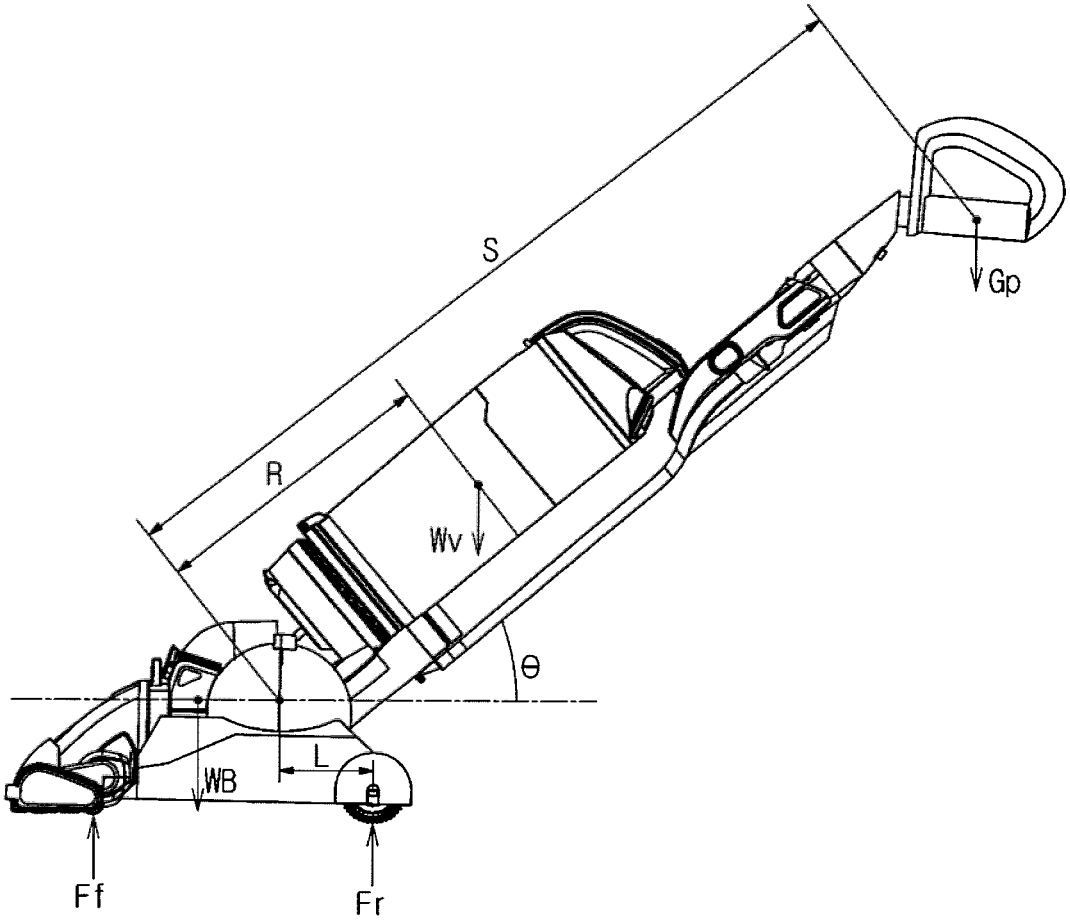
FIG. 31 is a view related to the cleaner according to the third embodiment of the present disclosure.

FIG. 31 is a view related to the cleaner according to the third embodiment of the present disclosure.

With respect to the rotation part 729, WB represents the weight of the bottom portion thereof. That is, WB represents the weight of the cleaning tool assembly 720. With respect to the rotation part 729, WU represents the weight of the upper portion thereof. That is, WU represents the weights of the main body 710 and the handle part 730. C represents the center of rotation of the rotation part 729, and S represents a distance from C up to a control part 732 of the handle part 730. R represents a distance from C up to a center of mass of WB, and Fr represents a ground reaction force on the main wheels 727. a and b respectively represent distances from the center of mass of WB to the front wheel 724 and the rear wheel. L represents a distance from C up to the main wheels 727. Mc represents an elastic moment generated from the elastic member of the rotation part 729.

In the above relations, when the main body 710 is tilted by a predetermined angle θ in order to use the cleaner, the sum of moments with respect to the center of rotation is as follows.

$$\Sigma M_p = -W_U \cdot R \cdot \cos\theta + Gp \cdot L \cdot \cos\theta + M_C = 0$$

Here, since WU is formed considerably larger than Gp (WU>>Gp), $$M_C = W_U \cdot R \cdot \cos\theta.$$

As described above, the elastic member is provided inside the rotation part 729 such that the moment load generated due to the handle part 730 and the main body 710 being tilted is offset by the elastic restoration force and the sense of weight applied to the user's hand is compensated. Thus, even when a value of θ is enlarged by enlarging the degree of tilting, Mc is acted on the cleaner from the elastic member such that the cleaner may remain fixed.

However, when the tilting degree is large, the cleaner may be overturned backward.

Accordingly, the positions of the main wheels 727 have to protrude toward the rear. The distances in which the main wheels 727 protrude are related to a design element and the steering performance of the cleaner. That is, when the distances in which the main wheels 727 protrude are enlarged, the backward overturning of the cleaner may be safely prevented, but a problem occurs with a difficulty in steering the upright cleaner. Also, in terms of design, the exterior aesthetics is negatively affected.

Thus, a proper length of L is $$\frac{R\cos\theta \cdot W_U - b \cdot W_B}{W_T} < L \leq \frac{[0.1 \cdot (R\sin\theta + h) \cdot W_T + R\cos\theta \cdot W_U - b \cdot W_B]}{W_T}.$$

-continued $$L \geq \frac{R\cos\theta \cdot W_U - b \cdot W_B}{W_T} * 1.05$$

In the above, the safety coefficient is randomly calculated as 1.05 and is a factor that is adjustable according to a designer's determination and experimental values and the shape and the weight of a cleaner.

In order to minimize L, the following embodiment may be implemented.

First, an additional weight may be disposed in front of the cleaning tool assembly 720 in order to minimize L. Also, the driving part 725 and an adaptor (not shown) provided at the driving part 725 may be disposed in the front portion of the cleaning tool assembly 720 to enlarge a value of b in order to minimize L. Also, as in the embodiment of the present disclosure, the driving force generation part 726 may be disposed in the front portion of the cleaning tool assembly 720 and the driving force generation part 726 may be connected to the main wheels 727 so that a driving force is transmitted to the main wheels 727. In this way, L may be minimized by enlarging the value of b.

Hereinafter, a cleaner according to a fourth embodiment of the present disclosure will be described.

In the description of the embodiment, descriptions of configurations overlapping with the previous embodiments will be omitted.

Figure 32:
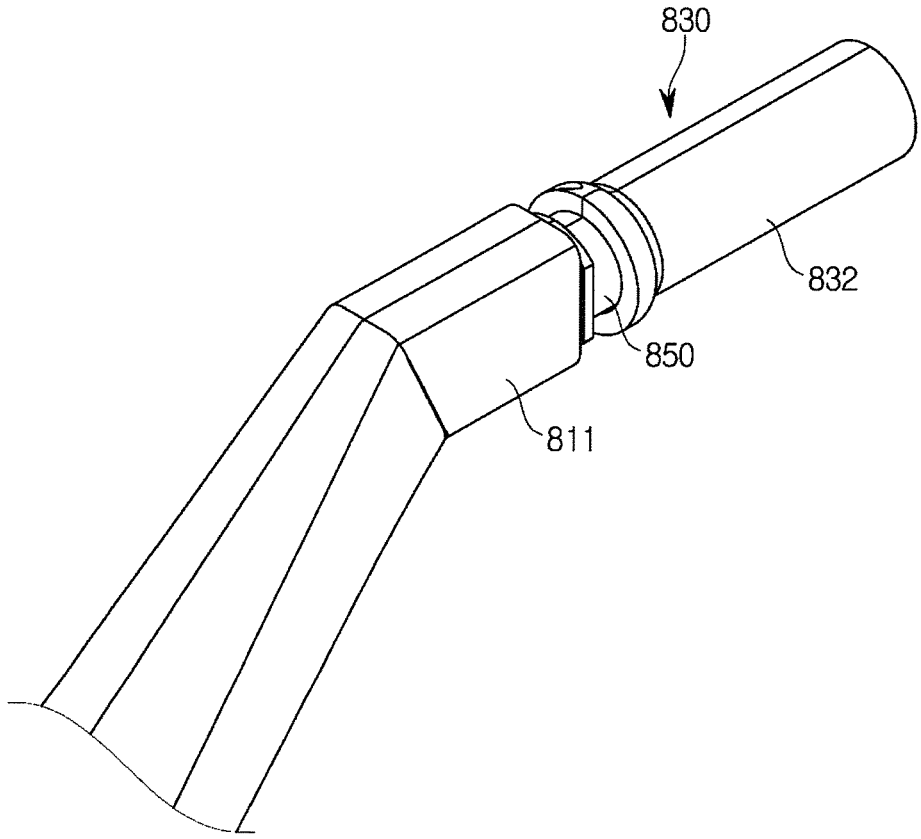
FIG. 32 is a view related to a handle part of a cleaner according to a fourth embodiment of the present disclosure.
Figure 33:
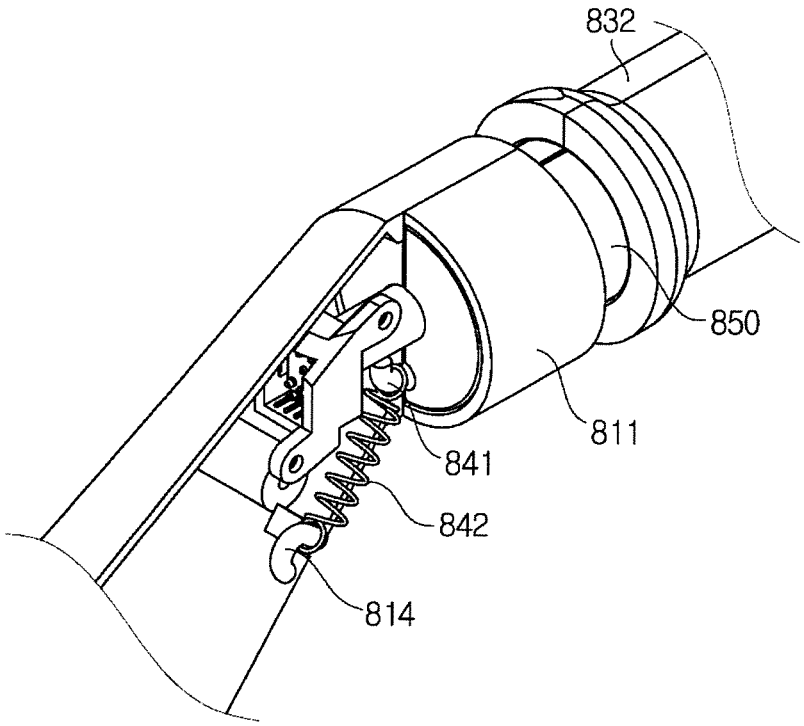
FIG. 33 is a view related to an elastic restoration of the handle part of the cleaner according to the fourth embodiment of the present disclosure.
Figure 34:
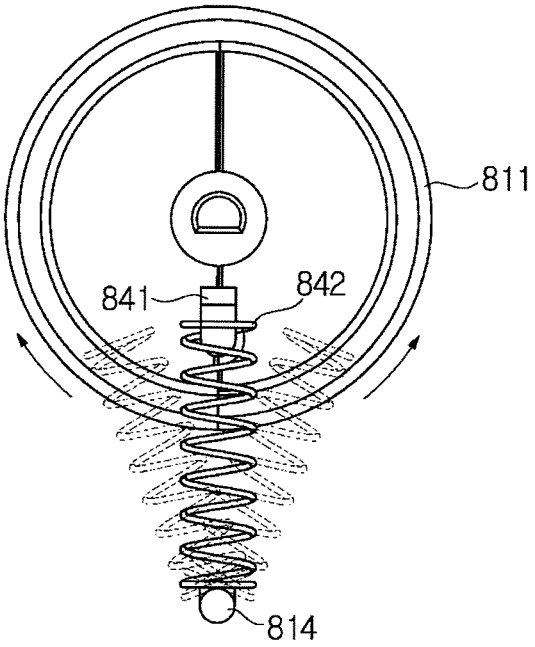
FIG. 34 is a view related to an operation of a rotational restoration part in accordance with a manipulation of the handle part of the cleaner according to the fourth embodiment of the present disclosure.

FIG. 32 is a view related to a handle part of the cleaner according to the fourth embodiment of the present disclosure, FIG. 33 is a view related to an elastic restoration of the handle part of the cleaner according to the fourth embodiment of the present disclosure, and FIG. 34 is a view related to an operation of a rotational restoration part in accordance with a manipulation of the handle part of the cleaner according to the fourth embodiment of the present disclosure.

A handle part 830 is provided either to redirect the cleaner or vary the movement speed of the cleaner. That is, manipulation of the handle part 830 may be detected to operate the cleaner. In detail, the handle part 830 is provided to relatively move with respect to a main body 810, and the manipulation of the handle part 830 is detected by the detection part. A cleaning tool assembly 820 may be provided to be controlled by the control part using a signal detected by the detection part.

That is, a force applied to the handle part 830 is detected or the relative movement amount and the relative rotation amount of the handle part 830 with respect to the main body 810 is measured to recognize the user's intention on the manipulation of the cleaner and control the cleaning tool assembly 820. In this way, the user may easily redirect, move, and rotate the cleaner.

The handle part 830 may include a guide part 840 and a control part 832.

The control part 832 is provided to be gripped by the user. Also, the control part 832 is provided to move along the guide part 840 to be described below. That is, the control part 832 is provided to relatively move with respect to the guide part 840.

The control part 832 is formed to surround at least a portion of a movement guide part 850 to be described below and may include a control body 833 formed to be movable along an outer circumferential surface of the movement guide part 850 and a control holder 835 protruding from an inner circumferential surface of the control body 833.

The guide part 840 guides the movement of the control part 832 and is provided to relatively move with respect to the main body 810.

The guide part 840 may include a rotation guide part 870 and the movement guide part 850.

The rotation guide part 870 is provided to be rotatable with respect to the main body 810. That is, the rotation guide part 870 is formed nearly in the shape of a rod and is provided to be relatively rotatable with respect to the main body 810. In the embodiment, the rotation guide part 870 is rotatably coupled to a guide coupling part 811 formed extending from the main body 810 in a curve. The rotation guide part 870 is provided to define left and right directions with respect to a progressing direction of the cleaner.

The movement guide part 850 may be formed extending from the rotation guide part 870. The movement guide part 850 is formed nearly in the shape of a rod and is provided to define front and rear directions with respect to a progressing direction of the cleaner. The movement guide part 850 is provided to enable the control part 832 to move. The movement guide part 850 is provided so that the control part 832 is movable in the front and rear directions.

When the main body 810 is tilted by a predetermined angle with respect to the surface to be cleaned in order to use the upright cleaner, the movement guide part 850 may be provided to be parallel to the surface to be cleaned. The movement guide part 850 may be disposed on the same line with the longitudinal direction of the rotation guide part 870.

A rotational restoration part 842 may be provided between the rotation guide part 870 and the main body 810.

An external force acts on the handle part 830 and the rotation guide part 870 relatively moves with respect to the main body 810. Then, when the external force is released, the rotation guide part 870 is provided to be restored to the original position by the rotational restoration part 842.

The rotational restoration part 842 may be formed with any material as long as the material has an elastic force. In the embodiment, a tension spring may be applied. One end of the rotational restoration part 842 may be fixed to a first fixing part 814 provided inside the guide coupling part 811, and the other end thereof may be fixed to a second fixing part 841 provided in front of the rotation guide part.

When the external force acts on the handle part 830 and the rotation guide part 870 rotates in one direction with respect to the main body 810, the rotational restoration part 842 is stretched while the one end and the other end thereof are fixed to the first fixing part 814 and the second fixing part 841, respectively. Also, even when the rotation guide part 870 rotates in the other direction, the rotational restoration part 842 is stretched while the one end and the other end thereof are fixed to the first fixing part 814 and the second fixing part 841, respectively.

When the external force acted on the handle part 830 is released, the rotational restoration part 842 is restored to the original position point which is a point where the length of the tension spring is minimum.

Hereinafter, a cleaner according to a fifth embodiment of the present disclosure will be described.

In the description of the embodiment, descriptions of configurations overlapping with the previous embodiments will be omitted.

Figure 35:
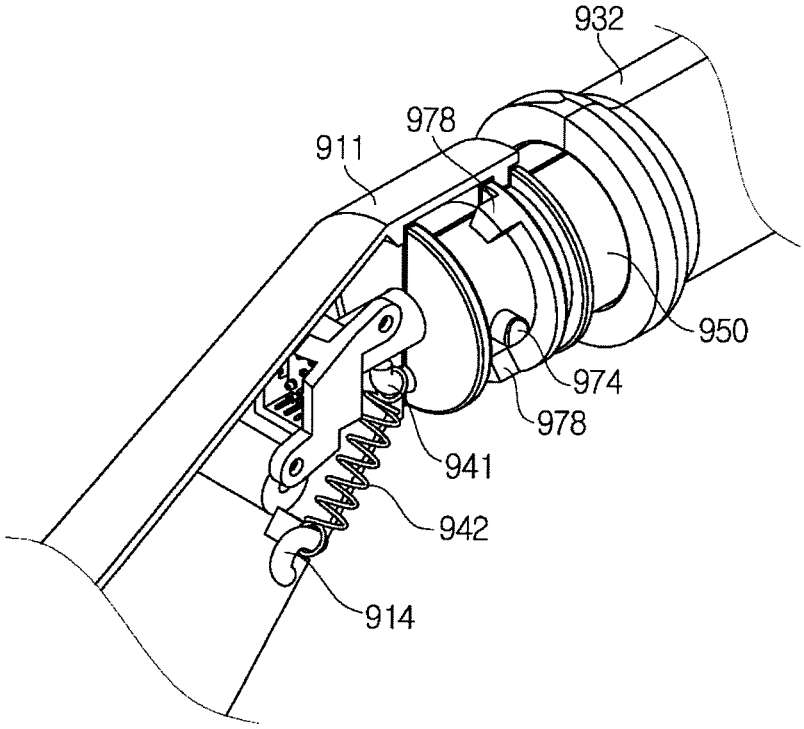
FIG. 35 is a view related to elastic restoration of a handle part of a cleaner according to a fifth embodiment of the present disclosure.
Figure 36:
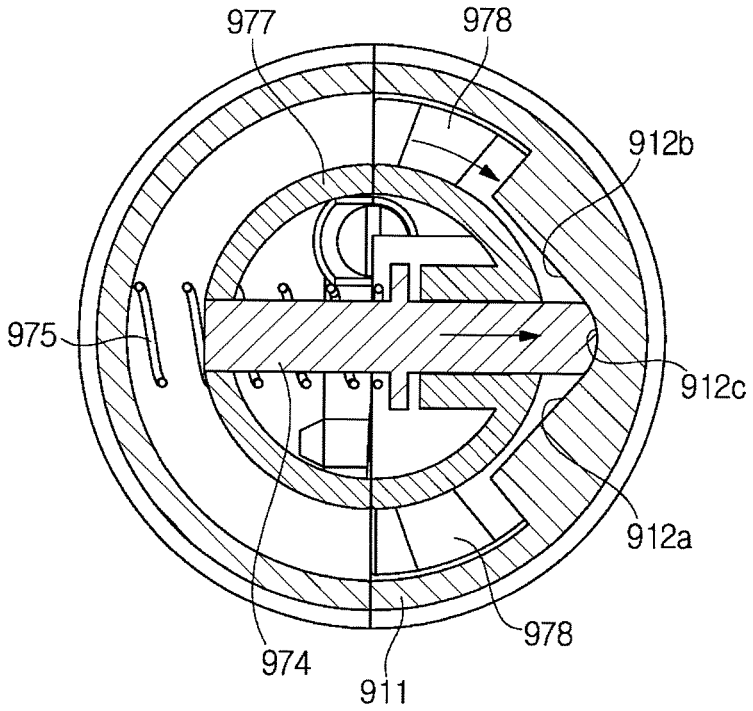
FIG. 36 is a view related to a steering unit of the handle part of the cleaner according to the fifth embodiment of the present disclosure.

FIG. 35 is a view related to elastic restoration of a handle part of the cleaner according to the fifth embodiment of the present disclosure, and FIG. 36 is a view related to a steering unit of the handle part of the cleaner according to the fifth embodiment of the present disclosure.

In the embodiment, a handle part 930 according to the fourth embodiment may further include a second rotational restoration part. That is, the rotational restoration part in the fourth embodiment is referred to as a first rotational restoration part, and the rotational restoration part further provided in the embodiment is referred to as the second rotational restoration part.

The second rotational restoration part may include a steering unit 974.

The steering unit 974 is provided to be elastically restorable with respect to rotation of a rotation guide part 970. First, a sloped part 912 along which the steering unit 974 moves will be described.

The sloped part 912 is provided at a guide coupling part 911 which is a portion of a main body 910 coupled to the rotation guide part 970. The sloped part 912 may be disposed to face the rotation guide part 970. The sloped part 912 includes a pair of sloped surfaces formed to be symmetrical to each other. The sloped part 912 includes a first sloped surface 912*a*, a second sloped surface 912*b* symmetrical to the first sloped surface 912*a*, and an inflected part 912*c* at which the first sloped surface 912*a* and the second sloped surface 912*b* meet.

The steering unit 974 is provided to relatively rotate with respect to the main body 910 together with the rotation guide part and is provided to elastically and straightly move inside the rotation guide part 970. One end portion of the steering unit 974 is provided to come in contact with the sloped part 912, and the other end portion thereof is provided to be elastically supported by a steering elastic member 975. Despite the relative rotational movement of the rotation guide part 970 with respect to the main body 910 due to the elastic force of the steering elastic member 975, the steering unit 974 moves along the sloped part 912 while remaining in contact with the sloped part 912.

The steering unit 974 moves along the first sloped surface 912*a* or the second sloped surface 912*b* by an external force and is provided to be disposed at the inflected part 912*c* when the external force is released.

The rotation guide part 970 may include a steering holder 977.

The steering holder 977 is provided to guide the movement of the steering unit 974 so that the steering unit 974 may straightly move elastically. The steering holder 977 is integrally formed with the rotation guide part 970 and is provided to be rotatable together with the rotation guide part 970. A steering hole 979 in the shape of a hole is formed at the steering holder 977 to have the steering unit 974 inserted and be movable therein. The steering holder 977 is formed in a nearly cylindrical shape.

The descriptions of a first fixing part 914, a second fixing part 941, and a rotational restoration part 942 are the same as the descriptions in the fourth embodiment.

Hereinafter, a cleaner according to a sixth embodiment of the present disclosure will be described.

In the description of the embodiment, descriptions of configurations overlapping with the previous embodiments will be omitted.

Figure 37:
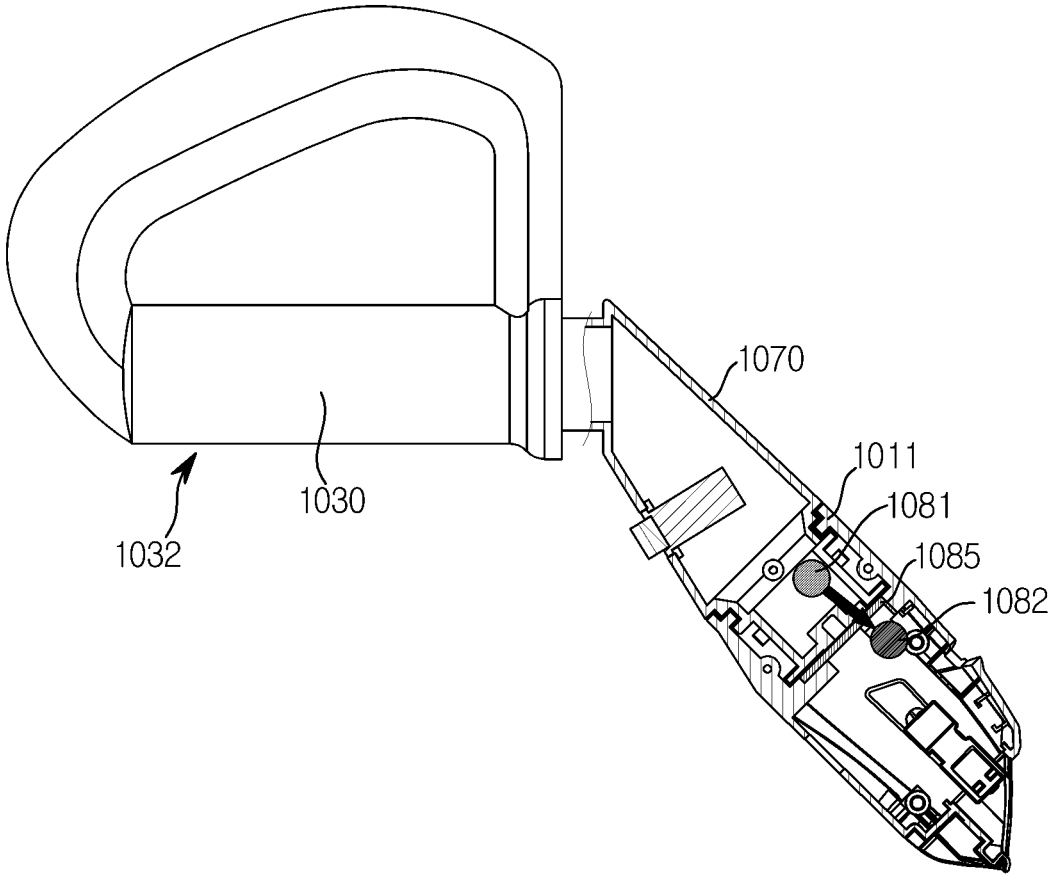
FIG. 37 is a a cross-sectional view of a part of a handle part of a cleaner according to a sixth embodiment of the present disclosure.
Figure 38:
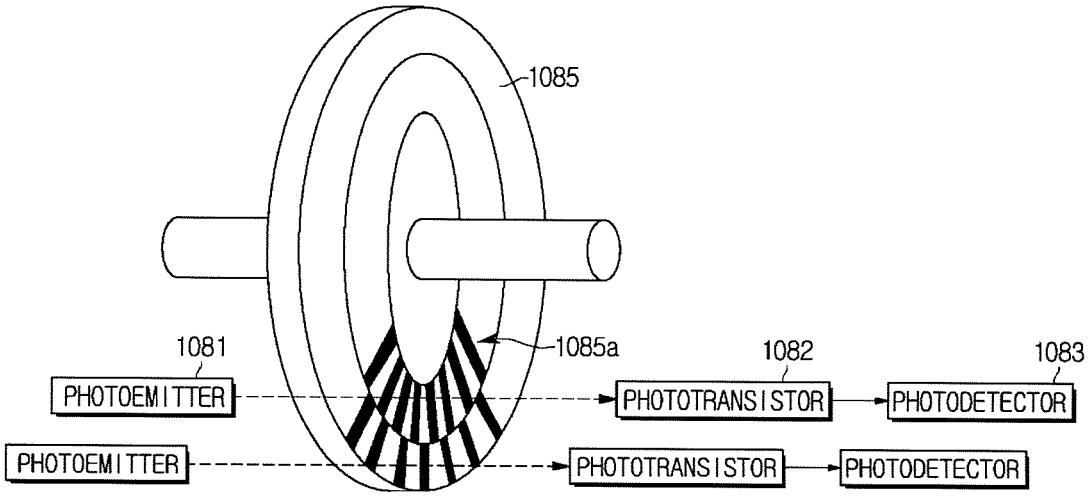
FIG. 38 is a view related to detecting a rotation amount of the handle part of the cleaner according to the sixth embodiment of the present disclosure.

FIG. 37 is a a cross-sectional view of a part of a handle part of the cleaner according to the sixth embodiment of the present disclosure, and FIG. 38 is a view related to detecting a rotation amount of the handle part of the cleaner according to the sixth embodiment of the present disclosure.

A rotation guide part 1070 includes a code disc 1085 that detects rotational movement directions and rotational movement forces of leftward and rightward rotations, and the like of a control part 1032. In the embodiment, the structure of a handle part 1030 having the code disc 1085 and an optical sensor 1080 will be described.

The optical sensor 1080 may include a photoemitter 1081, a phototransistor 1082, and a photodetector 1083.

The photoemitter 1081 may be provided to convert electrical energy into optical energy. The photoemitter 1081 may be disposed inside the rotation guide part 1070. The phototransistor 1082 is provided to convert optical energy into electrical energy. The photodetector 1083 is provided to convert electrical energy in to a measurable signal. The code disc 1085 is formed in the shape of a disc and has a coded area 1080*a* disposed along the circumferential direction. That is, optical energy emitted from the photoemitter 1081 is selectively incident on the phototransistor 1082 through a portion where the coded area 1080*a* is present.

The photoemitter 1081 is provided at the rotation guide part 1070 in order to rotate together with the rotation guide part 1070. The phototransistor 1082, the code disc 1085, and the photodetector 1083 are disposed at a guide coupling part 1011 of a main body 1010.

The photoemitter 1081 emits optical energy toward the phototransistor 1082, and the optical energy passes through the coded area 1080*a* of the code disc 1085 provided between the photoemitter 1081 and the phototransistor 1082 and is selectively incident on the phototransistor 1082. When the rotation guide part 1070 rotates, since the position of the photoemitter 1081 is changed, the form of the optical energy passing through the coded area 1080*a* of the code disc 1085 is changed. The optical energy incident on the phototransistor 1082 is changed back to electrical energy and the electrical energy is converted to a measurable signal by the photodetector 1083, thus being able to detect a rotational angle of the rotation guide part 1070. The detected information is transmitted to the control part.

Hereinafter, a cleaner according to a seventh embodiment of the present disclosure will be described.

In the description of the embodiment, descriptions of configurations overlapping with the previous embodiments will be omitted.

Figure 39:
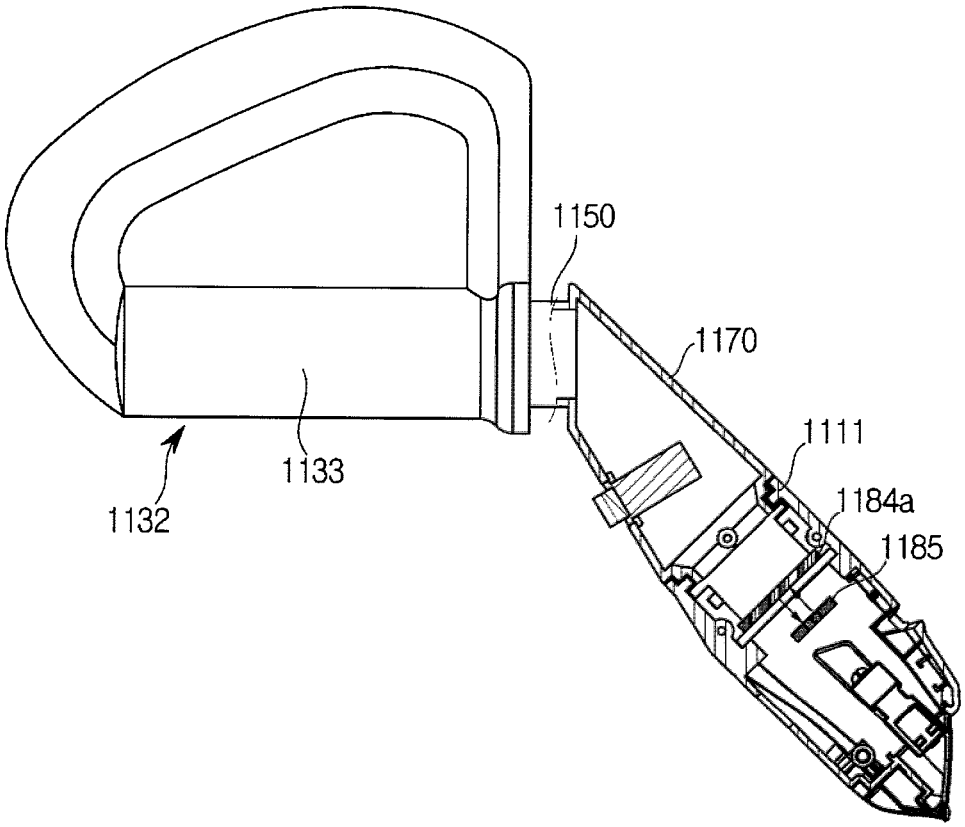
FIG. 39 is a a cross-sectional view of a part of a handle part of a cleaner according to a seventh embodiment of the present disclosure.
Figure 40:
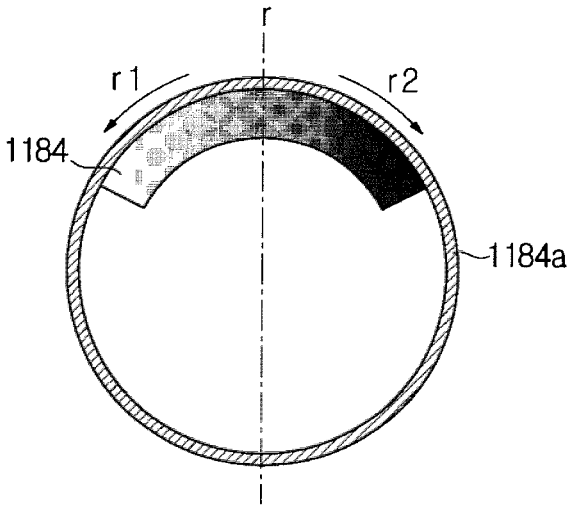
FIG. 40 is a view related to detecting a rotation amount of the handle part of the cleaner according to the seventh embodiment of the present disclosure.

FIG. 39 is a a cross-sectional view of a part of a handle part of the cleaner according to the seventh embodiment of the present disclosure, and FIG. 40 is a view related to detecting a rotation amount of the handle part of the cleaner according to the seventh embodiment of the present disclosure.

A second detection part of a rotation guide part 1170 includes an optical sensor 1185 that detects rotational movement directions and rotational movement forces of leftward and rightward rotations, and the like of a control part 1132. In the embodiment, the structure of a handle part 1130 having the optical sensor 1185 will be described.

The optical sensor 1185 is provided in a guide coupling part 1111 of a main body 1110, and the rotation guide part 1170 further includes a reflection part 1184 that reflects the incident light when light emitted from the optical sensor 1185 is incident.

Here, the reflection part 1184 may be formed at a circular disc panel 1184*a*. The circular disc panel 1184*a* may be provided to rotate together with the rotation of the rotation guide part 1170, and the reflection may be formed in the shape of an arc at the circular disc panel 1184*a*.

Here, the reflection part 1184 includes a plurality of reflection cells that have predetermined sizes and are disposed adjacent to each other, and the optical reflectivity values of the plurality of reflection cells are different from each other. That is, the plurality of reflection cells of the reflection part 1184 are formed by a gradation method, have a characteristic in which the reflectivity gradually becomes higher from a reference position r toward a first rotational direction r1, and have a characteristic in which the reflectivity gradually becomes lower from the reference position r toward a second rotational direction r2.

For example, the plurality of reflection cells of the reflection part 1184 have colors with the reflectivity gradually becoming higher from one end portion toward the other end portion.

The optical sensor 1185 for detecting a rotation distance of the rotation guide part 1170 that has moved from the main body 1110 may be provided in the guide coupling part 1111 of the main body 1110.

The optical sensor 1185 is provided to face the reflection part 1184. The optical sensor 1185 emits light and detects the incident amount of light reflected from the reflection part 1184 disposed at the rotation guide part 1170.

Here, the cleaner detects a rotational angle which is a rotational movement distance of the control part 1132 based on the amount of light detected by the optical sensor 1185.

That is, when the control part 1132 is rotationally moved leftward and rightward by the user, the reflection part 1184 disposed at the rotation guide part 1170 rotates due to being interlocked with the rotational movement of the control part 1132. Accordingly, the position of a reflection cell of the reflection part 1184 facing the optical sensor 1185 changes, and here, the optical sensor 1185 detects the amount of light reflected from the reflection cell facing the optical sensor 1185.

In this manner, the reflection cell facing the optical sensor 1185 changes according to the rotational movement of the control part 1132, the amount of light incident from the reflection cell facing the optical sensor 1185 is changed, and the rotational angle of the handle part 1130 that has rotated may be detected based on the amount of light.

Hereinafter, a cleaner according to an eighth embodiment of the present disclosure will be described.

In the description of the embodiment, descriptions of configurations overlapping with the previous embodiments will be omitted.

Figure 41:
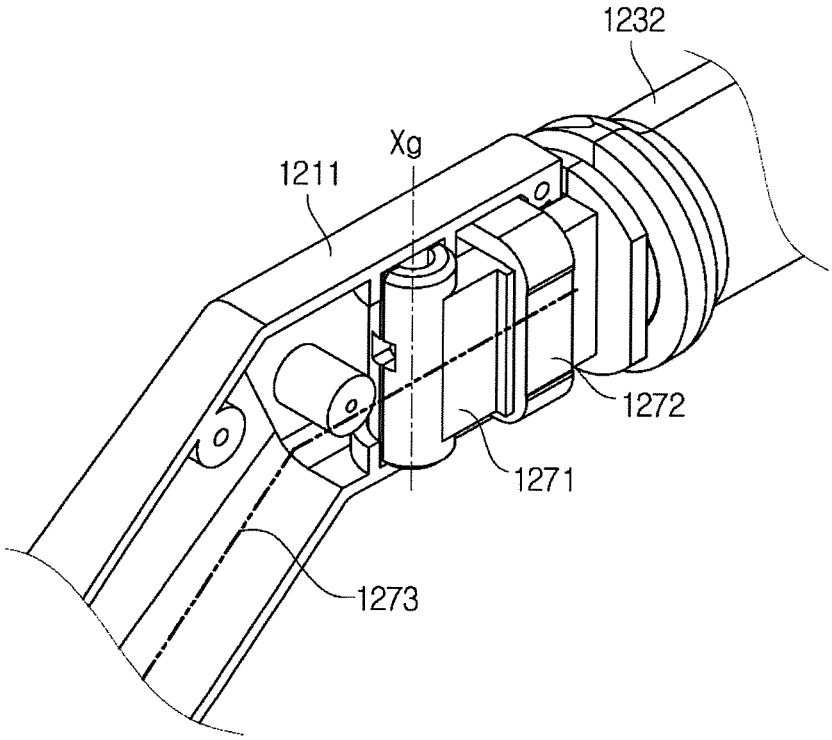
FIG. 41 is a view related to an inner configuration of a handle part of a cleaner according to an eighth embodiment of the present disclosure.
Figure 42:
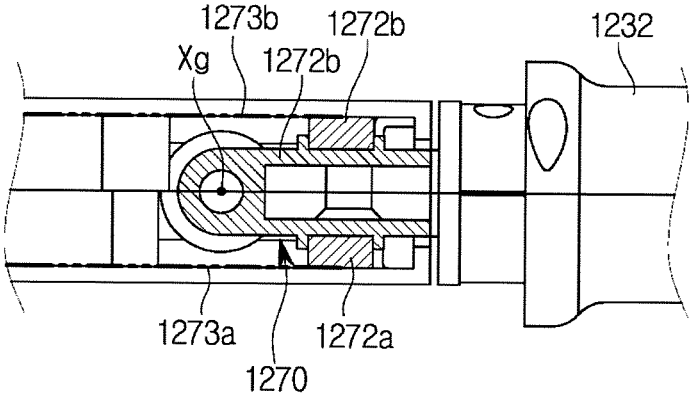
FIG. 42 is a cross-sectional view of the handle part of the cleaner according to the eighth embodiment of the present disclosure.

FIG. 41 is a view related to an inner configuration of a handle part of the cleaner according to the eighth embodiment of the present disclosure, and FIG. 42 is a cross-sectional view of the handle part of the cleaner according to the eighth embodiment of the present disclosure.

A handle part 1230 is provided either to redirect the cleaner or vary the movement speed of the cleaner. That is, manipulation of the handle part 1230 may be detected to operate the cleaner. In detail, the handle part 1230 is provided to relatively move with respect to a main body 1210, and the manipulation of the handle part 1230 is detected by the detection part. A cleaning tool assembly 1220 may be provided to be controlled by the control part using a signal detected by the detection part.

That is, a force applied to the handle part 1230 is detected or the relative movement amount and the relative rotation amount of the handle part 1230 with respect to the main body 1210 are measured to recognize the user's intention on the manipulation of the cleaner and control the cleaning tool assembly 1220. In this way, the user may easily redirect, move, and rotate the cleaner.

The handle part 1230 may include a guide part 1240 and a control part 1232.

The control part 1232 is provided to be gripped by the user. Also, the control part 1232 is provided to move along the guide part 1240 to be described below. That is, the control part 1232 is provided to relatively move with respect to the guide part 1240.

The guide part 1240 guides the movement of the control part 1232 and is provided to relatively move with respect to the main body 1210.

The guide part 1240 may include a rotation guide part 1270 and a movement guide part 1250.

The rotation guide part 1270 is provided to be rotatable leftward and rightward with respect to the main body 1210. That is, the rotation guide part 1270 is formed nearly in the shape of a rod and is provided to be relatively movable with respect to the main body 1210. In the embodiment, the rotation guide part 1270 is relatively movably coupled to a guide coupling part 1211 formed extending from the main body 1210 in a curve. The rotation guide part 1270 is provided to define left and right directions with respect to a progressing direction of the cleaner.

The movement guide part 1250 may be formed extending from the rotation guide part 1270. The movement guide part 1250 is formed nearly in the shape of a rod and is provided to define front and rear directions with respect to a progressing direction of the cleaner. The movement guide part 1250 is provided to enable the control part 1232 to move. The movement guide part 1250 is provided so that the control part 1232 is movable in the front and rear directions.

When the main body 1210 is tilted by a predetermined angle with respect to the surface to be cleaned in order to use the upright cleaner, the movement guide part 1250 may be provided to be parallel to the surface to be cleaned. The movement guide part 1250 may be disposed on the same line with the longitudinal direction of the rotation guide part 1270.

The rotation guide part 1270 includes a rotation guide body 1271 provided to be rotatable about a guide rotation axis Xg provided on the guide coupling part 1211, a rotational elastic member 1272 that surrounds at least a portion of the rotation guide body 1271, and a rotation detection sensor 1273 that detects the operation of the rotation guide body 1271.

The rotation guide body 1271 is provided to be rotatable leftward and rightward about the guide rotation axis Xg. The rotational elastic member 1272 is provided to surround at least a portion of the rotation guide body 1271 and is formed to fill a gap between the rotation guide body 1271 and the guide coupling part 1211. By the above configuration, when an external force is generated and the rotation guide body 1271 moves leftward and rightward, the rotation guide body 1271 moves only by the length by which the rotation guide body 1271 is compressed. When the external force is released, the rotation guide body 1271 is moved to the original position by the restorative elastic force of the rotational elastic member 1272.

A pair of rotation detection sensors 1273 may be provided in each of left and right sides of the rotational elastic member 1272. The rotation detection sensors 1273 may, for example, include a pressure sensor. Since a pressure sensor is used as a sensor that senses a movement of the rotation guide part 1270 in the embodiment, the sensing is possible even when a movement of the rotation guide part 1270 is not large. The pair of rotation detection sensors 1273 detect the operation of the rotation guide body 1271 and transmit the detected operation to the control part. For convenience of description, with respect to a progressing direction of the cleaner, the rotation detection sensor 1273 at the left side is referred to as a first rotation detection sensor 1273*a* and the rotation detection sensor 1273 at the right side is referred to as a second rotation detection sensor 1273*b*.

When the user grips the control part 1232 and applies an external force toward the left, the rotation guide body 1271 rotates leftward about the guide rotation axis Xg, and the rotational elastic member 1272 and the first rotation detection sensor 1273*a* are pressed. A pressure is detected by the first rotation detection sensor 1273*a*, the pressure is sent to the control part, and the cleaning tool assembly 1220 is manipulated.

On the other hand, when the user grips the control part 1232 and applies an external force toward the right, the rotation guide body 1271 rotates rightward about the guide rotation axis Xg, and the rotational elastic member 1272 and the second rotation detection sensor 1273*b* are pressed. A pressure is detected by second rotation detection sensor 1273*b*, the pressure is sent to the control part, and the cleaning tool assembly 1220 is manipulated.

When the external force is released, the rotation guide part 1270 is restored to the original position by the restorative elastic force of the rotational elastic member 1272.

Hereinafter, a cleaner according to a ninth embodiment of the present disclosure will be described.

In the description of the embodiment, descriptions of configurations overlapping with the previous embodiments will be omitted.

Figure 43:
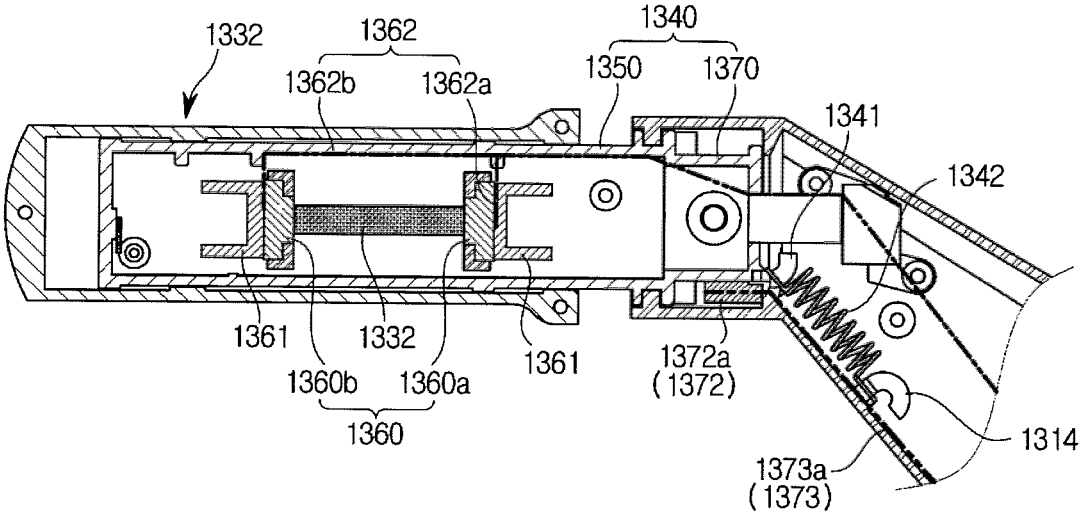
FIG. 43 is a cross-sectional view of a handle part of a cleaner according to a ninth embodiment of the present disclosure.
Figure 44:
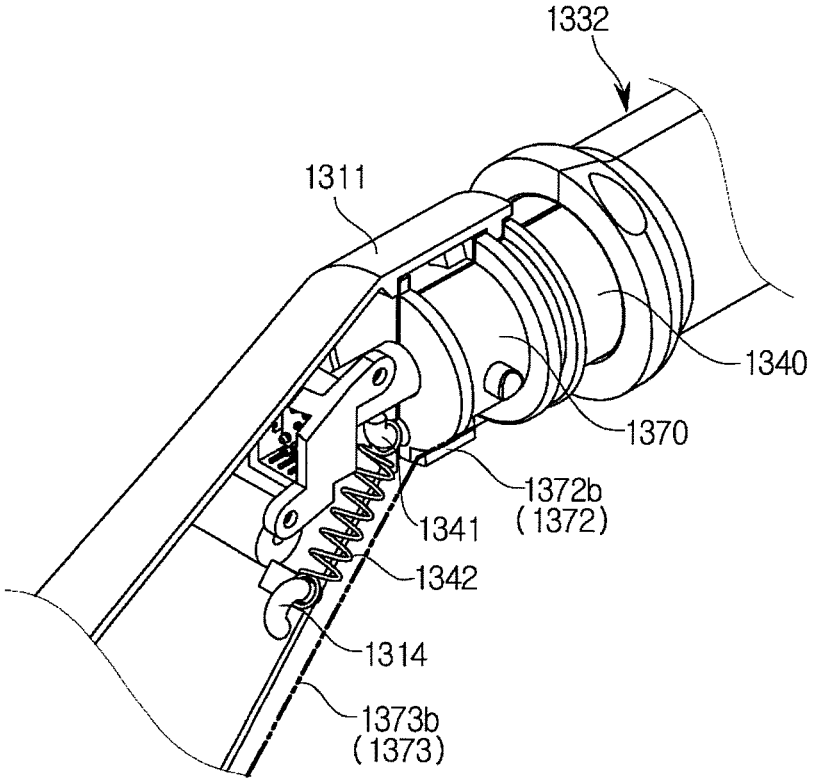
FIG. 44 is a view related to an inner configuration of the handle part of the cleaner according to the ninth embodiment of the present disclosure.

FIG. 43 is a cross-sectional view of a handle part of the cleaner according to the ninth embodiment of the present disclosure, and FIG. 44 is a view related to an inner configuration of the handle part of the cleaner according to the ninth embodiment of the present disclosure.

A handle part 1330 is provided either to redirect the cleaner or vary the movement speed of the cleaner. That is, manipulation of the handle part 1330 may be detected to operate the cleaner. In detail, the handle part 1330 is provided to relatively move with respect to a main body, and the manipulation of the handle part 1330 is detected by the detection part. A cleaning tool assembly may be provided to be controlled by the control part using a signal detected by the detection part.

That is, a force applied to the handle part 1330 is detected or the relative amount of movement and the relative rotation amount of the handle part 1330 with respect to the main body are measured to recognize the user's intention on the manipulation of the cleaner and control the cleaning tool assembly. In this way, the user may easily redirect, move, and rotate the cleaner.

The handle part 1330 may include a guide part 1340 and a control part 1332.

The control part 1332 is provided to be gripped by the user. Also, the control part 1332 is provided to move along the guide part 1340 to be described below. That is, the control part 1332 is provided to relatively move with respect to the guide part 1340.

The control part 1332 is formed to surround at least a portion of a movement guide part 1350 to be described below and may include a control body 1333 formed to be movable along an outer circumferential surface of the movement guide part 1350 and include a control holder 1335 that protrudes from an inner circumferential surface of the control body 1333.

The guide part 1340 guides the movement of the control part 1332 and is provided to relatively move with respect to the main body.

The guide part 1340 may include a rotation guide part 1370 and the movement guide part 1350.

The rotation guide part 1370 is provided to be rotatable leftward and rightward with respect to the main body. That is, the rotation guide part 1370 is formed nearly in the shape of a rod and is provided to be relatively movable with respect to the main body. In the embodiment, the rotation guide part 1370 is relatively movably coupled to a guide coupling part 1311 formed extending from the main body in a curve. The rotation guide part 1370 is provided to define left and right directions with respect to a progressing direction of the cleaner.

The movement guide part 1350 may be formed extending from the rotation guide part 1370. The movement guide part 1350 is formed nearly in the shape of a rod and is provided to define front and rear directions with respect to a progressing direction of the cleaner. The movement guide part 1350 is provided to enable the control part 1332 to move. The movement guide part 1350 is provided so that the control part 1332 is movable in the front and rear directions.

When the main body is tilted by a predetermined angle with respect to the surface to be cleaned in order to use the upright cleaner, the movement guide part 1350 may be provided to be parallel to the surface to be cleaned. The movement guide part 1350 may be disposed on the same line with the longitudinal direction of the rotation guide part 1370.

The movement guide part 1350 includes a pair of moving elastic members 1360 disposed at front and rear sides with respect to the movement direction of the control holder 1335, a pair of stoppers 1361 disposed at outer sides of the pair of moving elastic members 1360, and a movement detection sensor 1362 that detects the operation of the control holder 1335.

The control part 1332 is provided to be straightly movable in front and rear directions along the movement guide part 1350. The control holder 1335 of the control part 1332 also rotates together in accordance with the movement of the control part 1332 and selectively presses one of the pair of moving elastic members 1360. For convenience of description, the moving elastic member 1360 in front of the control holder 1335 is referred to as a first moving elastic member 1360*a*, and the moving elastic member 1360 behind the control holder 1335 is referred to as a second moving elastic member 1360*b*.

At each of the outer sides of the pair of moving elastic members 1360, the pair of stoppers 1361 for limiting the movement of the moving elastic members 1360 may be provided. A pair of movement detection sensors 1362 that detect the operation of the control holder 1335 may be provided between the pair of stoppers 1361 and the pair of moving elastic members 1360. The pair of movement detection sensors 1362 detect the operation of the control holder 1335 and transmit the detected operation to the control part. For convenience of description, the movement detection sensor 1362 in front of the control holder 1335 is referred to as a first movement detection sensor 1362*a*, and the movement detection sensor 1362 behind the control holder 1335 is referred to as a second movement detection sensor 1362*b*.

When an external force acts on the control part 1332 and the movement guide part 1350 moves forward, the control holder 1335 presses the first moving elastic member 1360*a*, and a pressure is applied to the first movement detection sensor 1362*a* between the first moving elastic member 1360*a* and the stopper 1361. The pressure is detected by the first movement detection sensor 1362*a*, the pressure is sent to the control part, and the cleaning tool assembly is manipulated.

When an external force acts on the control part 1332 and the movement guide part 1350 moves rearward, the control holder 1335 presses the second moving elastic member 1360*b*, and a pressure is applied to the second movement detection sensor 1362*b* between the second moving elastic member 1360*b* and the stopper 1361. The pressure is detected by the second movement detection sensor 1362*b*, the pressure is sent to the control part, and the cleaning tool assembly is manipulated.

The rotation guide part 1370 includes a rotation guide body 1371 provided to be rotatable about a guide rotation axis Xr provided on the guide coupling part 1311, a rotation guide protrusion formed by radially protruding from the rotation guide body 1371, rotational elastic members 1372 provided at both sides of the rotation guide protrusion, and a rotation detection sensor 1373 that detects rotation of the rotation guide body 1371.

The rotation guide body 1371 is provided to be rotatable leftward and rightward about the guide rotation axis Xr. The rotation guide protrusion also rotates together with the rotation of the rotation guide body 1371 and selectively presses one of the pair of rotational elastic members 1372. A pair of rotation detection sensors 1373 detect the operation of the rotation guide body 1371 and transmit the detected operation to the control part. For convenience of description, the rotational elastic member 1372 in a first rotational direction r1 from the rotation guide protrusion is referred to as a first rotational elastic member 1372, and the rotational elastic member 1372 in a second rotational direction r2 from the rotation guide protrusion is referred to as a second rotational elastic member 1372.

At each of the outer sides of the pair of rotational elastic members 1372, the pair of rotation detection sensors 1373 may be provided. For convenience of description, the rotation detection sensor 1373 in the first rotational direction r1 from the rotation guide protrusion is referred to as a first rotation detection sensor 1373*a*, and the rotation detection sensor 1373 in the second rotational direction r2 from the rotation guide protrusion is referred to as a second rotation detection sensor 1373*b*.

When an external force acts on the control part 1332 and the rotation guide part 1370 moves in the first rotational direction r1, the rotation guide protrusion presses the first rotational elastic member 1372, and the pressing force is transmitted to the first rotation detection sensor 1373*a*. The pressure is detected by the first rotation detection sensor 1373*a*, the pressure is sent to the control part, and the cleaning tool assembly is manipulated.

When an external force acts on the control part 1332 and the rotation guide part 1370 moves in the second rotational direction r2, the rotation guide protrusion presses the second rotational elastic member 1372, and the pressing force is transmitted to the second rotation detection sensor. The pressure is detected by the second rotation detection sensor 1373*b*, the pressure is sent to the control part, and the cleaning tool assembly is manipulated.

A first fixing part 1314, a second fixing part 1341, and a rotational restoration part 1342 are the same as in the description of the fourth embodiment.

Hereinafter, a cleaner according to a tenth embodiment of the present disclosure will be described.

In the description of the embodiment, descriptions of configurations overlapping with the previous embodiments will be omitted.

Figure 45:
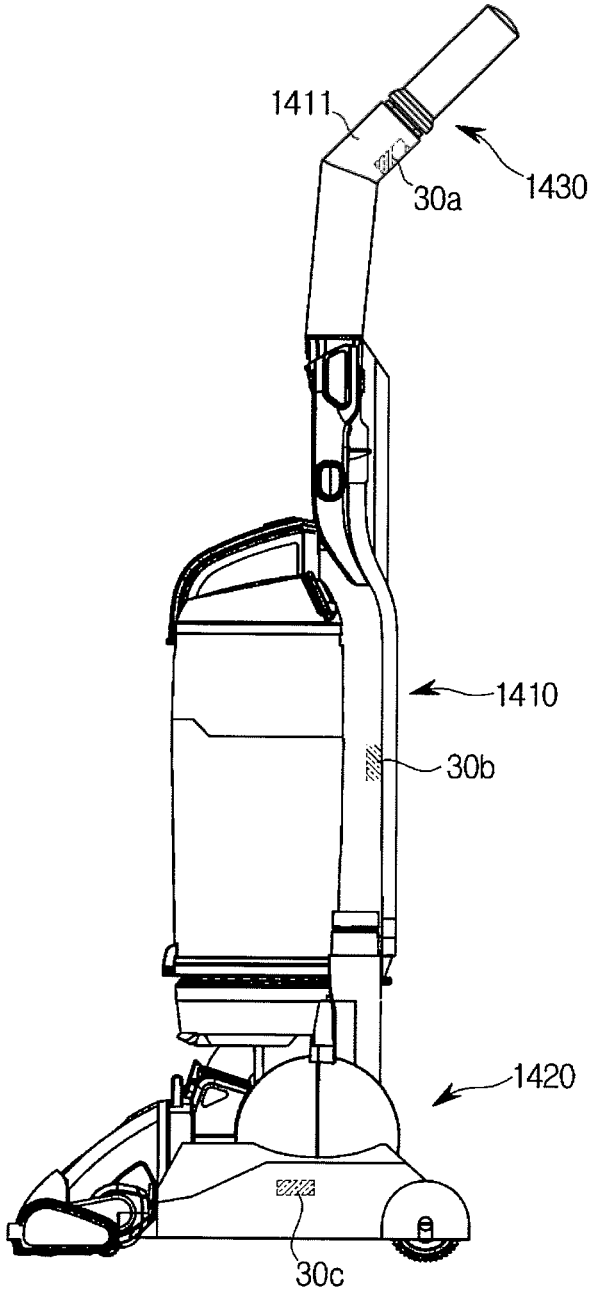
FIG. 45 is a view for describing a state detection sensor provided in a cleaner according to a tenth embodiment of the present disclosure.
Figure 46:
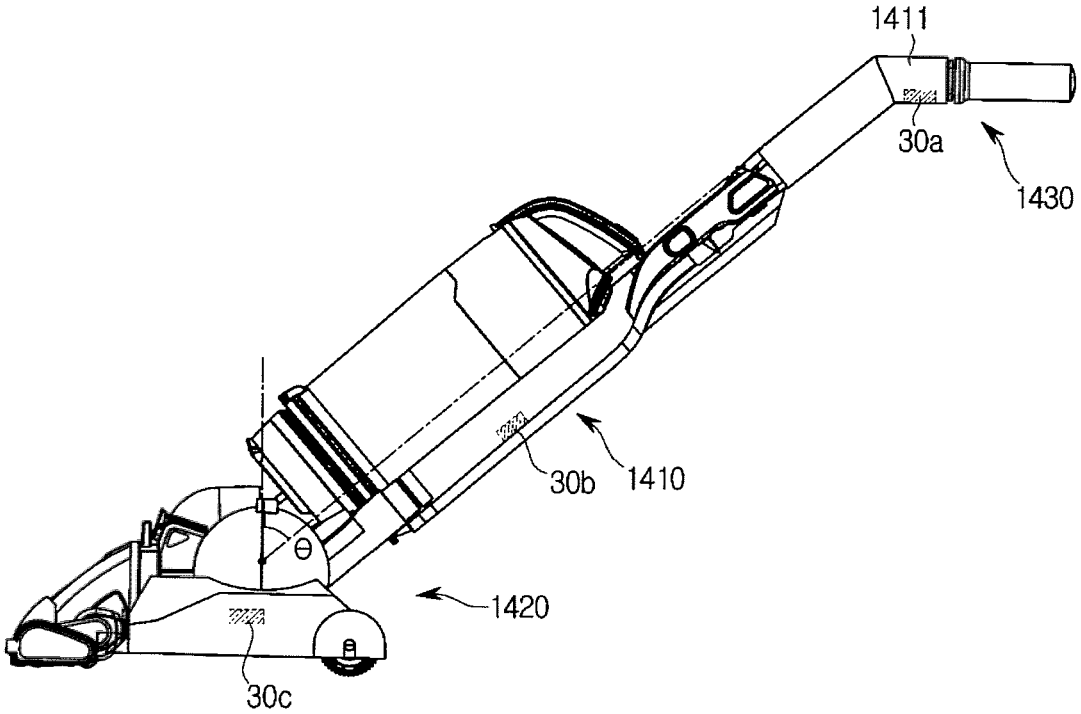
FIG. 46 is a view for describing an operation of the cleaner including the state detection sensor according to the tenth embodiment of the present disclosure.

FIG. 45 is a view for describing a state detection sensor provided in the cleaner according to the tenth embodiment of the present disclosure, and FIG. 46 is a view for describing the operation of the cleaner including the state detection sensor according to the tenth embodiment of the present disclosure.

Referring to FIG. 45, a state detection sensor 30 for detecting the state of the cleaner may be provided with the cleaner. The state detection sensor 30 detects the current state of the cleaner and outputs an electrical signal according to the result of detection so that a processor provided in the cleaner transmits a control command according to the current state of the cleaner to various parts of the cleaner.

The state detection sensor 30 may include a tilt sensor, an acceleration sensor, or a rotation detection sensor. The tilt sensor is a sensor that detects a tilt of the sensor or of a device to which the sensor is attached that depends on the flow state of an object provided in a housing in which various types of parts are embedded, e.g. a movement of a ball, or a fluid provided in the housing. The acceleration sensor is a sensor capable of detecting a dynamic force such as acceleration, vibration, or impact of the sensor or a device to which the sensor is installed using a piezoelectric element, capacitance, a movement speed of a conductor, a wire resistance strain gage, or a semiconductor strain gage. The acceleration sensor may include a gyro sensor. The rotation detection sensor is a sensor capable of detecting rotation or a rotational angle of a rotatable object such as a wheel. The rotation detection sensor may detect rotation of an object by detecting light, checking whether a current is passed, and measuring torque, and the like.

In one embodiment, a state detection sensor 30*a* may be provided in a handle part 1430. In more detail, the state detection sensor 30*a* may be installed inside a housing that forms the handle part 1430. In this case, the state detection sensor 30*a* may be provided in a frame 1411 that connects the handle part 1430 to a main body 1410. The state detection sensor 30*a* installed in the handle part 1430 may be an acceleration sensor or a tilt sensor.

In other embodiment, a state detection sensor 30*b* may be provided in the main body 1410. In this case, the state detection sensor 30*b* may be installed inside a housing that forms the main body 1410. The position at which the state detection sensor 30*b* is installed inside the main body 1410 may be randomly decided according to a system designer's choice. The state detection sensor 30*b* installed in the main body 1410 may be an acceleration sensor or a tilt sensor.

In still another embodiment, a state detection sensor 30*c* may be installed in a cleaning tool assembly 1420, and in more detail, may be installed in a rotation shaft between the cleaning tool assembly 1420 and the main body 1410 or at surroundings thereof. In this case, the state detection sensor 30*c* installed in the cleaning tool assembly 1420 may include a rotation detection sensor capable of detecting the degree of rotation of the main body 1410 with respect to the cleaning tool assembly 1420.

As illustrated in FIG. 46, the state detection sensor 30 may measure a tilt θ of the main body 1410 which is the extent to which the main body 1410 is tilted from the normal line of a reference surface. Here, the reference surface may include ground or a floor surface of the cleaning tool assembly 1420. The state detection sensor 30 may output an electrical signal corresponding to the tilt θ of the main body 1410, and the output electrical signal may be transmitted to the processor provided inside the cleaner. The processor provided inside the cleaner receives the electrical signal and may either determine whether the cleaner is being operated according to the tilt θ of the main body 1410 or determine whether the cleaner is upright or laid. The processor may generate a control signal according to the result of determination and control the cleaner.

Hereinafter, a cleaner according to an eleventh embodiment of the present disclosure will be described.

In the description of the embodiment, descriptions of configurations overlapping with the previous embodiments will be omitted.

Figure 47:
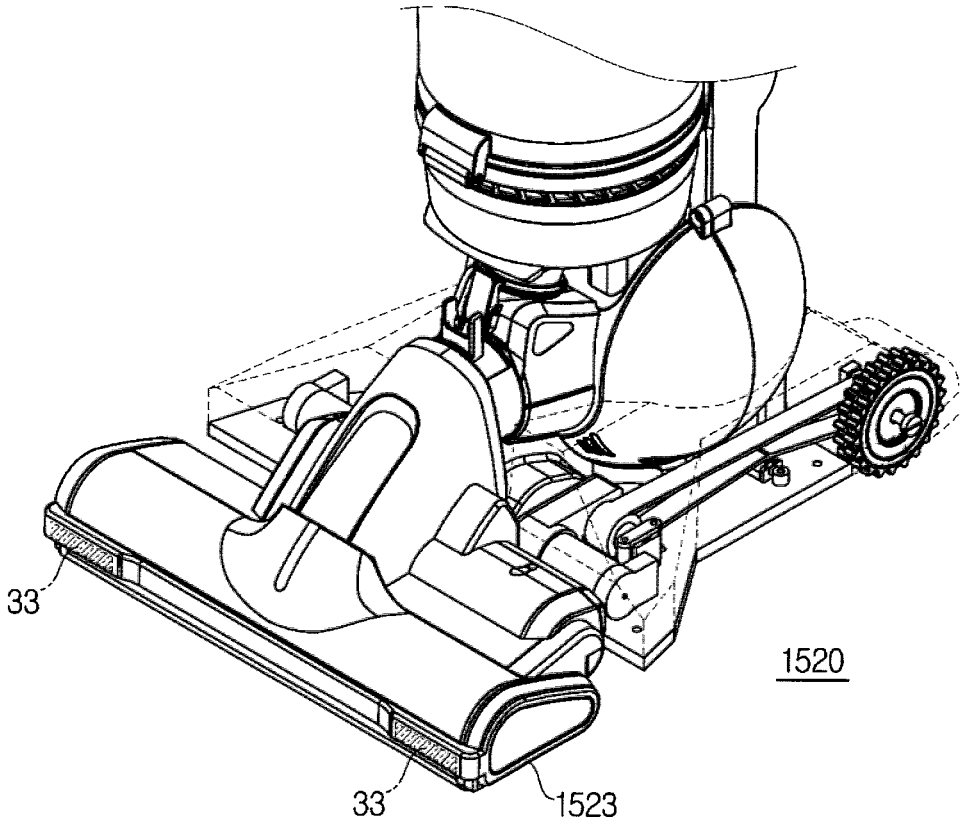
FIG. 47 is a view for describing a cleaner including an obstacle sensor according to an eleventh embodiment of the present disclosure.
Figure 48:
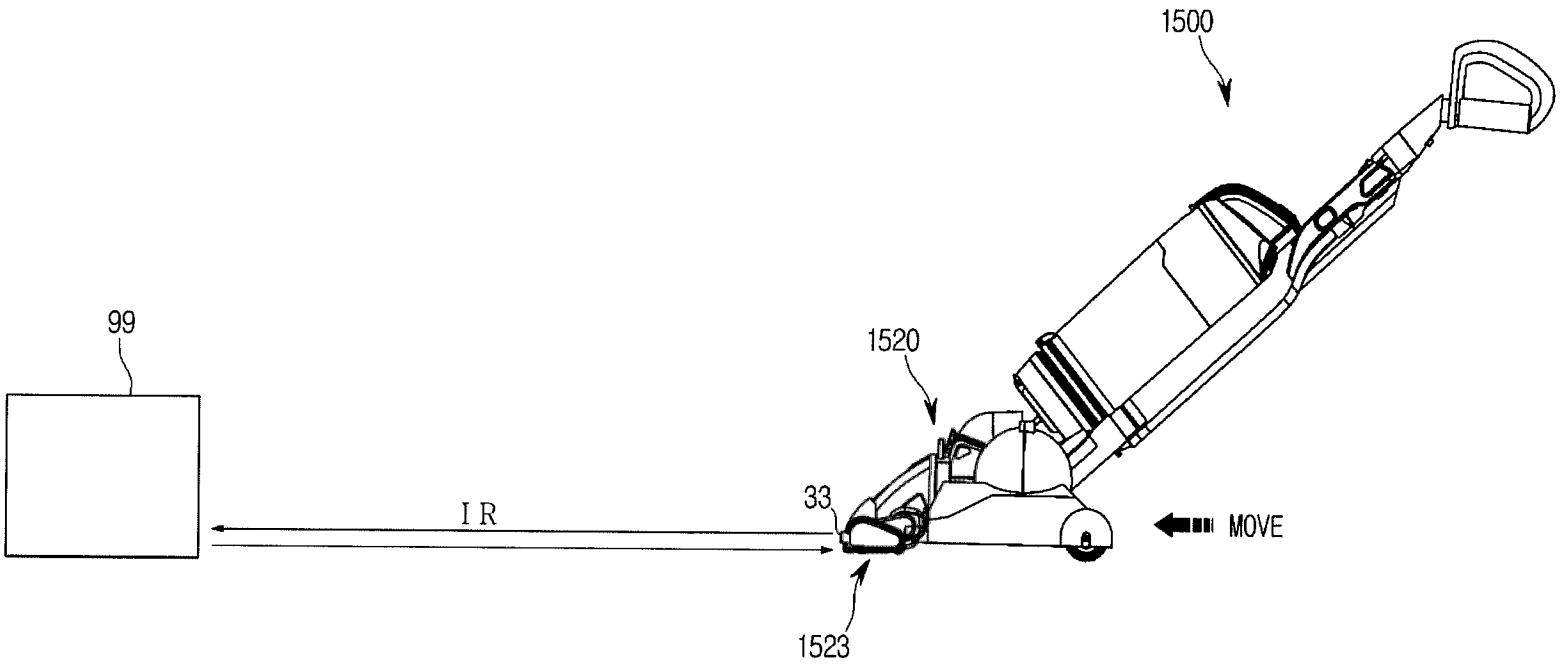
FIG. 48 is a view for describing an operation of the cleaner including the obstacle sensor according to the eleventh embodiment of the present disclosure.

FIG. 47 is a view for describing the cleaner including an obstacle sensor according to the eleventh embodiment of the present disclosure, and FIG. 48 is a view for describing the operation of the cleaner including the obstacle sensor according to the eleventh embodiment of the present disclosure.

One or more obstacle sensors 33 may be provided on a front surface of a cleaning tool assembly 1520. Here, the front surface of the cleaning tool assembly 1520 may include one surface formed to face the movement direction of the cleaning tool assembly 1520. As described above, the cleaning tool assembly 1520 may include a brush part 1523 for sweeping up dust, and in this case, the one or more obstacle sensors 33 may be provided on a front surface of the brush part 1523.

As illustrated in FIG. 48, the obstacle sensors 33 may detect an obstacle 99 that is present in the movement direction of a cleaner 1500 and output an electrical signal corresponding to the result of detection.

The obstacle sensors 33 may detect the obstacle 99 disposed in the movement direction using visible rays, infrared rays, or ultrasonic waves. For example, when the obstacle sensors 33 are infrared sensors, the obstacle sensors 33 may radiate infrared rays IR in the movement direction and receive infrared rays returning by being reflected by the obstacle 99, thereby detecting the presence of the obstacle 99. Also, the obstacle sensors 33 may measure the direction of the obstacle 99 and the distance between the obstacle 99 and the cleaner 1500 using the direction in which the infrared rays are received or the time consumed until the infrared rays are received. The obstacle sensors 33 may output an electrical signal corresponding to whether the obstacle 99 is present, the direction of the obstacle 99, or the distance between the obstacle 99 and the cleaner 1500, and the signal output by the obstacle sensors 33 may be transmitted to a processor. The processor may generate a control signal for controlling the cleaner 1500 based on the signal transmitted from the obstacle sensors 33.

Hereinafter, configurations of a cleaner according to a twelfth embodiment of the present disclosure will be described.

In the description of the embodiment, descriptions of configurations overlapping with the previous embodiments will be omitted.

Figure 49:
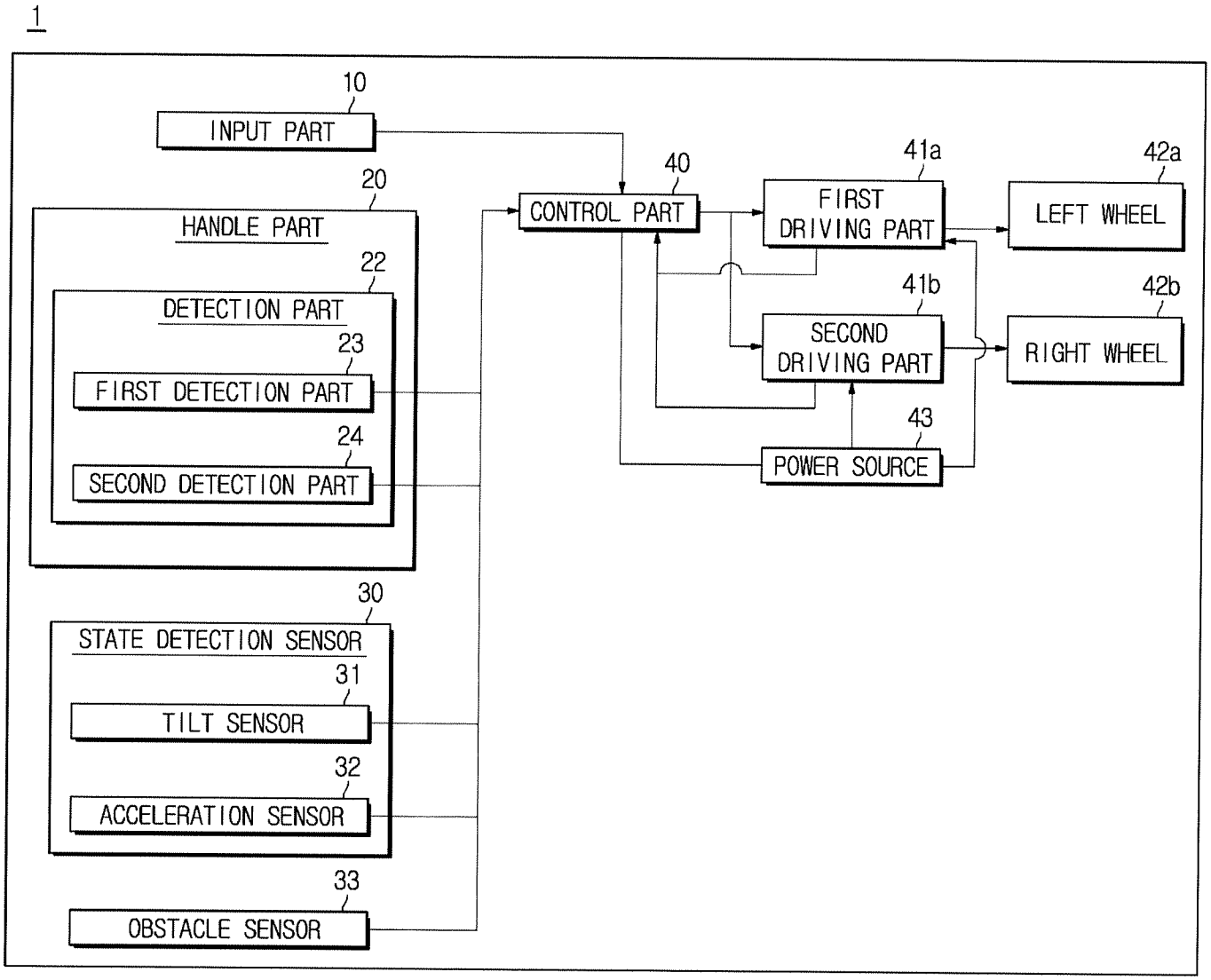
FIG. 49 is a view illustrating a block diagram of a cleaner which is one embodiment of the present disclosure.

FIG. 49 is a view illustrating a block diagram of a cleaner which is one embodiment of the present disclosure.

According to FIG. 49, the cleaner 1 may include an input part 10, a handle part 20, a state detection sensor 30, an obstacle sensor 33, a control part 40, a driving part 41, a wheel 42, and a power source 43.

The input part 10 may receive a command from the user. For example, the user may manipulate the input part 10 in order to control whether a cruise function is performed or the decrease in a rotational speed of the wheel.

The input part 10 may output an electrical signal according to the user's manipulation and transmit the electrical signal to the control part. The control part 40 may generate a control command corresponding to the signal transmitted from the input part 10 and control the operation of the cleaner 1. The input part 10 may include one or more physical buttons, a touch pad, a touch screen, a joystick, a track ball, a knob or various other manipulation devices capable of being manipulated by the user.

Figure 50A:
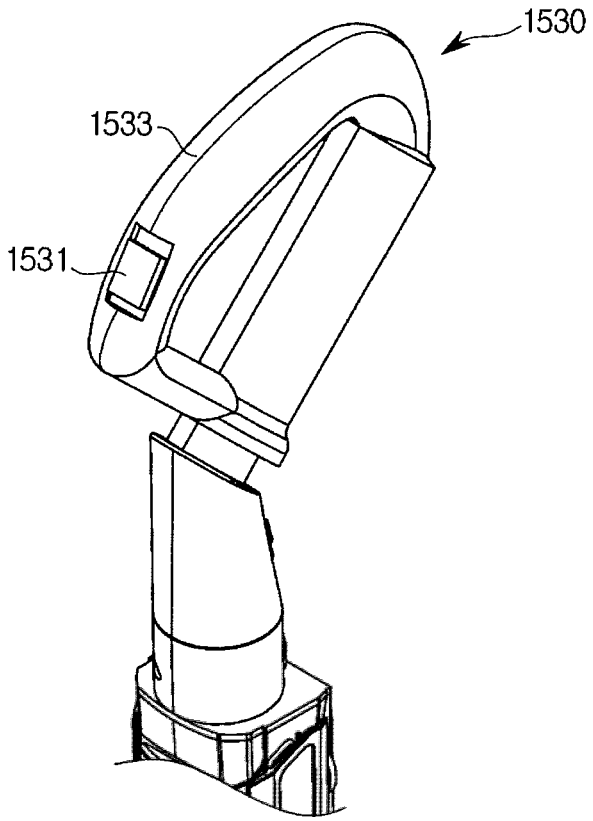
FIG. 50A is a view illustrating one embodiment of a handle part at which an input part is provided.
Figure 50B:
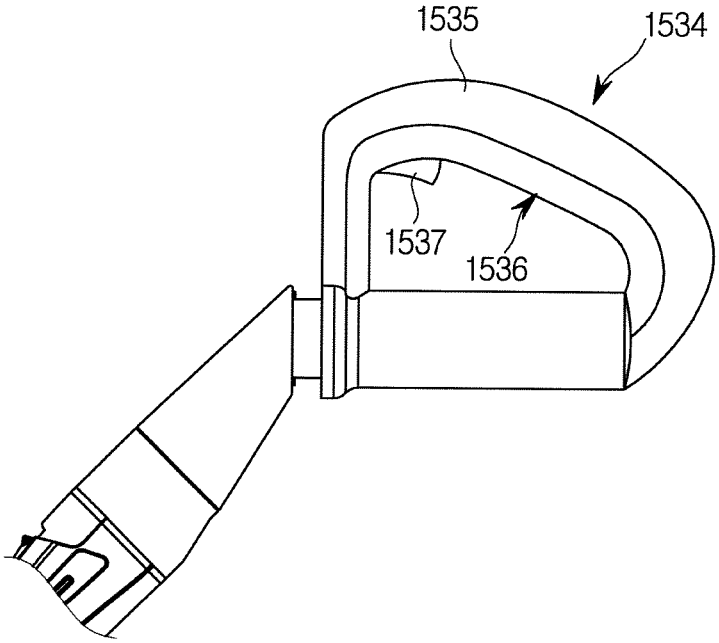
FIG. 50B is a view illustrating another embodiment of the handle part at which an input part is provided.

FIG. 50A is a view illustrating one embodiment of a handle part at which an input part is provided, and FIG. 50B is a view illustrating another embodiment of the handle part at which an input part is provided.

According to the embodiment illustrated in FIG. 50A, an input part 1531 may be installed at an upper surface 1532 of an upper frame 1533 of a handle part 1530. The input part 1531 may be a physical button as illustrated in FIG. 50A or may be a touch pad or a joystick. The user may manipulate the input part 1531 using a thumb while gripping the handle part 1530.

According to another embodiment illustrated in FIG. 50B, an input part 1537 may be installed at a lower surface 1536 of an upper frame 1535 of a handle part 1534. In this case, the input part 1537 may be a physical button as illustrated in FIG. 50B or may be a touch pad or a joystick. When the input part 1537 is a physical button, the input part 1537 may have the form of a trigger, and the user may input an operation command using the input part 1537 by pulling the trigger form using an index finger or a middle finger while gripping the handle part 1534.

As described with reference to FIGS. 50A and 50B, the input part 10 may be provided at the handle part 20 for convenience of manipulation, but the position at which the input part 10 is installed is not limited to the embodiments described above. The input part 10 may, for example, be provided on the main body or the cleaning tool assembly and may be installed at various other locations that may be considered by the system designer.

As described above, the handle part 20 may include a plurality of sensors 21. Here, the plurality of sensors 21 may include a detection part 22 described above, and the detection part 22 may include a first detection part 23 that detects straight-line movement directions and straight-line movement forces of a forward movement and a backward movement of the sliding part 334 that straightly moves along the guide part 332 and a second detection part 24 that detects rotational movement directions and rotational movement forces of a leftward rotation and a rightward rotation of the sliding part 334 that rotationally moves along the guide part 332. The first detection part 23 may include the movement detection sensor described above, and the second detection part 24 may include the rotation detection sensor described above.

The first detection part 23 and the second detection part 24 may output an electrical signal corresponding to a force applied from the user according to the user's manipulation of the handle part 20 and transmit the electrical signal to the control part 40. In more detail, when a force is applied to the handle part 20 according to the user's manipulation of the handle part 20, the displacement of the control part (632 in FIG. 20) and the like provided at the handle part 20 may be changed, and the first detection part 23 and the second detection part 24 may output a voltage electrical signal corresponding to the displacement. The output signal may be transmitted to the control part 40.

The state detection sensor 30 may detect the current state of the cleaner, output an electrical signal according to the result of detection, and transmit the electrical signal to the control part 40. As described above, the state detection sensor 30 may include a tilt sensor 31 for detecting the tilt of the main body or an acceleration sensor 32.

As described above, the obstacle sensor 33 may detect the obstacle 99 that is present in the movement direction of the cleaner, output an electrical signal according to the result of detection, and transmit the electrical signal to the control part 40.

The control part 40 may receive an electrical signal output from any one of the input part 10, the detection part 22 of the handle part 20, the state detection sensor 30, and the obstacle sensor 33, generate a control signal according to the received electrical signal, and control the operation of the cleaner.

For example, the control part 40 may determine the speed or the direction of wheels 42*a* and 42*b* of the cleaner according to the electrical signal transmitted from the detection part 22 of the handle part 20. In more detail, the control part 40 may determine the magnitude of the force applied to the handle part 20 by the user according to the electrical signal and determine each of the operations of a first driving part 41*a* that drives the left wheel 42*a* and a second driving part 41*b* that drives the right wheel 42*b* according to the result of the determination. The control part 40 may generate control signals corresponding to the speed or the direction of the wheels 42*a* and 42*b* of the cleaner. The generated control signals may be transmitted to the corresponding driving parts 41*a* and 41*b*.

In addition, the control part 40 may receive information on the rotational speed or the number of rotations of each of the wheels 42*a* and 42*b* from at least one of the first driving part 41*a* and the second driving part 41*b*. The control part 40 may determine whether the wheels 42*a* and 42*b* are being operated at a requested level based on the rotational speed or the number of rotations and further generate an additional control signal for resetting the operation of at least one of the first driving part 41*a* and the second driving part 41*b* according to the result of determination. In other words, the control part 40 may receive feedback signals in accordance with the operations of the driving parts 41*a* and 41*b* and control the driving parts 41*a* and 41*b* according to the feedback signals. For example, when the rotational speed or the number of rotations of one or more of the wheels 42*a* and 42*b* is lower than the requested value, the control part 40 may generate a control signal for increasing the rotational speed or the number of rotations of one or more of the wheels 42*a* and 42*b* and transmit the generated control signal to at least one of the first driving part 41*a* and the second driving part 41*b*. Conversely, when the rotational speed or the number of rotations of one or more of the wheels 42*a* and 42*b* is higher than the requested value, the control part 40 may generate a control signal for decreasing the rotational speed or the number of rotations of one or more of the wheels 42*a* and 42*b* and transmit the generated control signal to at least one of the first driving part 41*a* and the second driving part 41*b*.

By transmitting a control signal to the power source 43 that supplies a current to each of the driving parts 41*a* and 41*b*, the control part 40 may control whether the current is supplied to each of the driving parts 41*a* and 41*b* or the amount or the direction of the current supplied to each of the driving parts 41*a* and 41*b*, and each of the driving parts 41*a* and 41*b* may rotate at a predetermined speed in a predetermined direction according to whether the current is supplied or the amount and the direction of the supplied current.

According to an electrical signal output by the state detection sensor 30, the control part 40 may also control each of the driving parts 41*a* and 41*b* not to be operated even when the handle part 20 is manipulated. Also, according to an electrical signal output by the obstacle sensor 33, the control part 40 may also control the operation of each of the driving parts 41*a* and 41*b*.

The control part 40 may include one or more semiconductor chips, a processor that may be implemented using related parts and an associated circuit, and the processor may be a micro-controller unit (MCU).

The first driving part 41*a* may rotate the left wheel 42*a* at a predetermined rotational speed in a predetermined direction, and the second driving part 41*b* may rotate the right wheel 42*b* at a predetermined rotational speed in a predetermined direction. The first driving part 41*a* and the second driving part 41*b* may be implemented with a motor. Here, various types of motors such as a DC motor, an AC motor, a universal motor, a BLDC motor, a linear induction motor, and a step motor may be employed as the motor.

A sensor for detecting the rotational speed or the number of rotations of the left wheel 42*a* may be further provided in the first driving part 41*a*. Likewise, a sensor for detecting the rotational speed or the number of rotations of the right wheel 42*a* may be further provided in the second driving part 41*b*. The sensor in the first driving part 41*a* may transmit the rotational speed or the number of rotations detected to the control part 40. Various types of sensors that may be considered by the system designer may be employed as the sensor provided in the first driving part 41*a* or the second driving part 41*b* in order to detect the rotational speed or the number of rotations of the motor.

The left wheel 42*a* may rotate in the predetermined direction and speed according to the operation of the first driving part 41*a*. The right wheel 42*b* may rotate in the predetermined direction and speed according to the operation of the second driving part 41*b*. The left wheel 42*a* and the right wheel 42*b* may be operated independently of each other. In other words, the left wheel 42*a* and the right wheel 42*b* may rotate at speeds different from each other in directions different from each other. Of course, the left wheel 42*a* and the right wheel 42*b* may also rotate at the same speed in the same direction.

The cleaner 1 moves or rotates in a predetermined direction according to the rotations of the left wheel 42*a* and the right wheel 42*b*. Accordingly, the user may move or rotate the cleaner 1 with less effort. Thus, convenience of cleaning using the cleaner may be improved.

The power source 43 may supply power to each part of the cleaner. Also, as illustrated in FIG. 49, the power source 43 may supply a predetermined current to the first driving part 41*a* and the second driving part 41*b*. The power source 43 may supply power to each part of the cleaner according to controlling of the control part 40. The power source 43 may be implemented using a battery such as a storage battery, and the battery may also be a secondary battery that is chargeable by an external commercial current. Of course, according to embodiments, the battery may also be a primary battery.

Hereinafter, various embodiments of a method of controlling the operation of a cleaner will be described with reference to FIGS. 51 to 57. The method of controlling the operation of a cleaner described below may be performed using the cleaners according to one or two or more embodiments among the cleaners according to the first embodiment to the eleventh embodiment described above.

Hereinafter, a method of controlling the operation of a cleaner according to a first embodiment of the present disclosure will be described.

Figure 51:
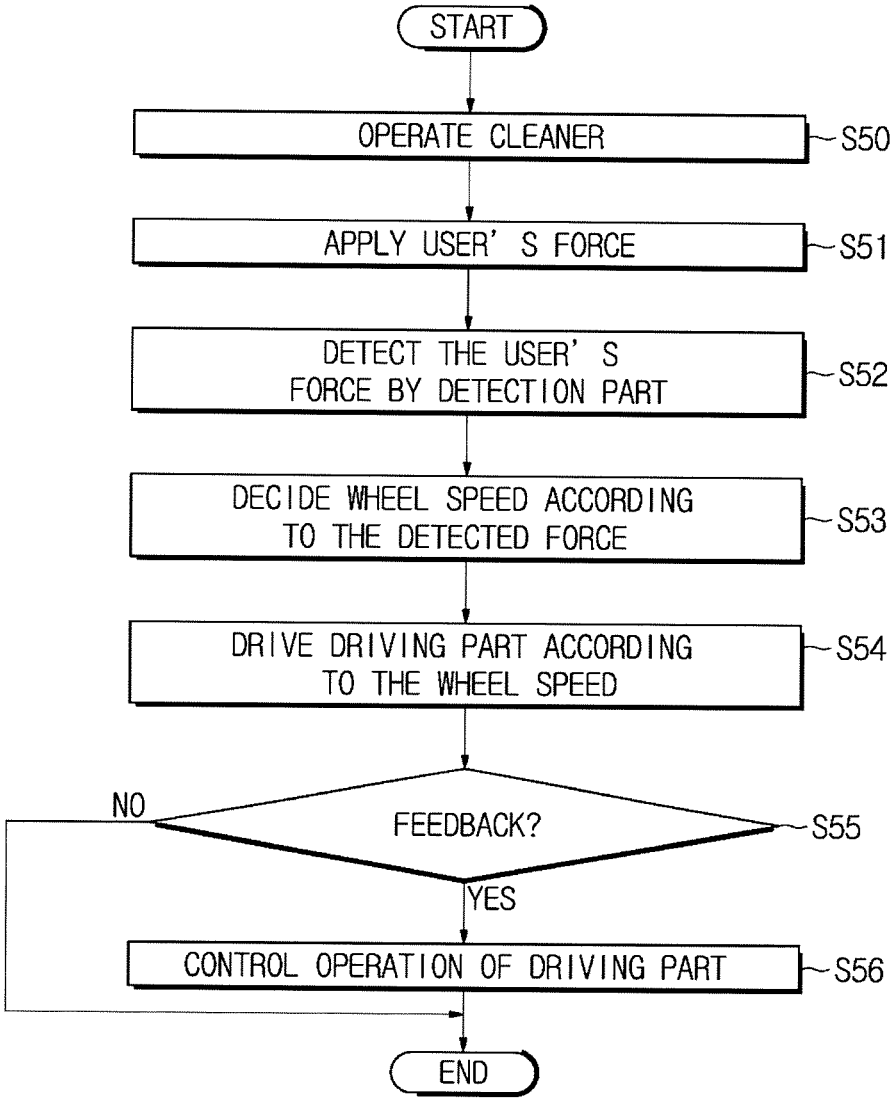
FIG. 51 is a flow chart related to a first embodiment of a method of controlling an operation of a cleaner.

FIG. 51 is a flow chart related to the first embodiment of the method of controlling the operation of a cleaner.

First, while a cleaner is being operated (S50), a force of the user may be applied to the handle part (S51). Here, the applied force may include at least one of the force that moves a control part in front and rear directions and the force that rotates the control part.

At least one of a first detection part and a second detection part may detect the force applied by the user and output an electrical signal according to the detected force (S52).

A processor of the cleaner may receive the electrical signal and determine the rotational direction or the rotational speed of at least one of the left wheel and the right wheel according to the detected force (S53). In this case, the movement speed of the cleaner according to the rotational speed of at least one of the left wheel and the right wheel may be determined to be smaller than a predetermined threshold value. For example, the movement speed of the cleaner may be determined to be smaller than 1.5 m/s. Accordingly, a decrease in safety due to an extremely rapid movement of the cleaner may be prevented.

According to one embodiment, due to the impreciseness of the inner structure of the handle part, an error may also occur in the values measured by a sensor, e.g. the first detection part and the second detection part. In other words, when actually manufacturing the sensor, the neutral position of the sensor may be different from a desired position. Thus, the control part may regard a section within a predetermined range with respect to the desired neutral position of the sensor as a dead zone and prevent malfunctioning due to an error. The size of a dead zone may be randomly decided by the system designer.

For example, in case of the first detection part that detects a straight-line movement force, the system designer may set the control part to regard a section within ±1 mm with respect to the neutral position as a dead zone. Here, the neutral position refers to a position where the first detection part does not output any signal or outputs a signal indicating a reference position, and the neutral position may be decided according to a random choice of the system designer. Also, in the case of the second detection part that detects a rotational movement force, the system designer may set the control part to regard a section within 1° with respect to the neutral position as a dead zone. The control part may reflect the set dead zones and decide the rotational direction and the rotational speed of at least one of the left wheel and the right wheel. In detail, when a movement or a rotation has occurred within the dead zone, the control part may determine that there was no such movement or rotation and ignore a signal output by the first detection part or the second detection part. In other words, the control part may control the operation of a driving part only when the straight-line movement force or the rotational movement force detected by the first detection part or the second detection part exceeds a predetermined range.

A current is applied to the driving part according to the rotational direction and speed of a wheel decided by the control part, and the driving part is driven according to the applied current (S54). According to the driving of the driving part, at least one of the left wheel and the right wheel rotates in a predetermined direction and at a predetermined speed.

When feedback is needed (YES to S55), a feedback signal may be transmitted to the control part, and the control part may transmit a control signal for resetting the operation of the driving part according to the feedback signal to the driving part in order to control the operation of the driving part (S56).

When feedback is not needed (NO to S55), the driving part is driven according to a signal transmitted from the control part, and at least one of the left wheel and the right wheel rotates according to the driving of the driving part.

Hereinafter, a method of controlling the operation of a cleaner according to a second embodiment of the present disclosure will be described.

Figure 52:
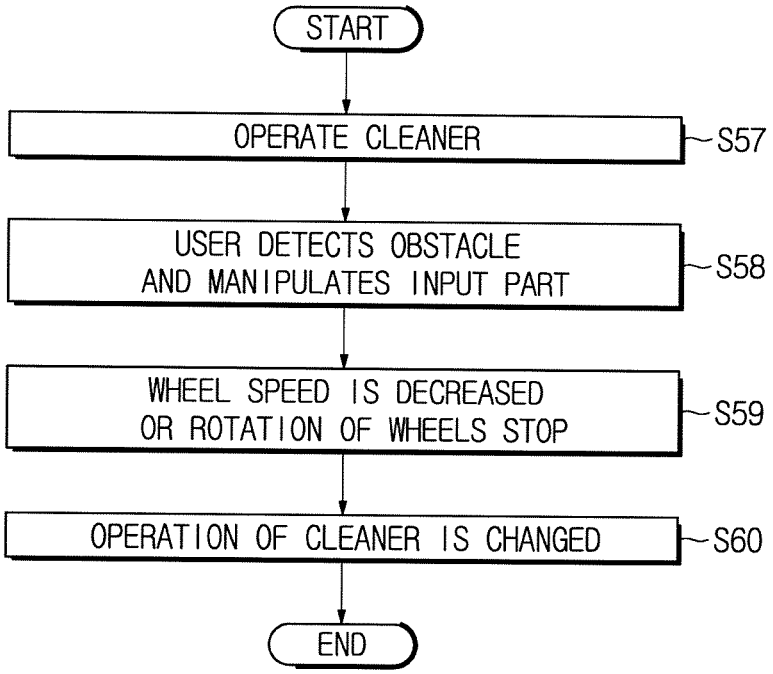
FIG. 52 is a flow chart related to a second embodiment of a method of controlling an operation of a cleaner.

FIG. 52 is a flow chart related to the second embodiment of the method of controlling the operation of a cleaner.

First, the cleaner starts operating (S57), and when the user is cleaning using the cleaner, the user may detect a presence of an obstacle in the movement direction of the cleaner and accordingly manipulate an input part (S58). Here, the input part may be implemented with the physical button provided at the upper surface or the lower surface of the handle part described with reference to FIGS. 50A and 50B or a touch pad, and the like.

Then, the control part may transmit a control signal to the driving part so that the driving part decreases the rotational speed of wheels according to the manipulation of the input part. The control part may also block the current applied to the driving part as needed (S59). In this case, the wheels may stop rotating.

In this manner, in accordance with a change in the operation of the wheel, the operation of the cleaner may also be changed (S60). In detail, due to the rotational speed of the wheel being decreased or the rotation of the wheel being stopped, the cleaner may move less even when the same force is applied.

Hereinafter, a method of controlling the operation of a cleaner according to a third embodiment of the present disclosure will be described.

Figure 53:
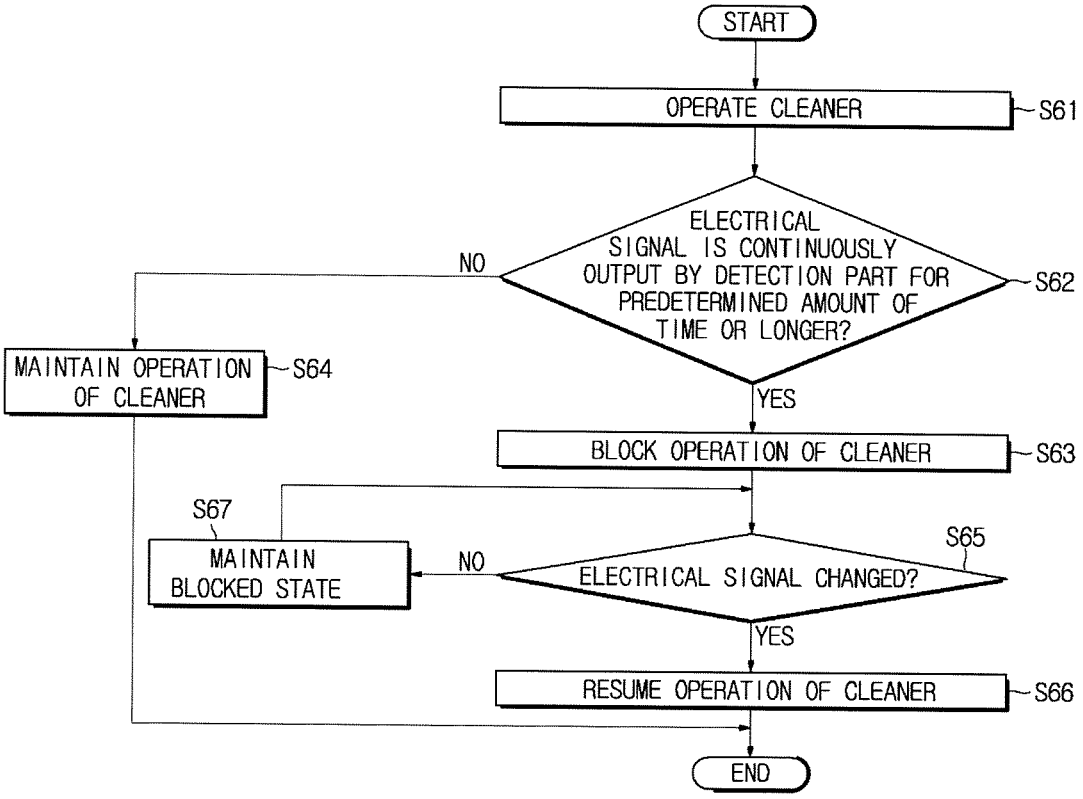
FIG. 53 is a flow chart related to a third embodiment of a method of controlling an operation of a cleaner.

FIG. 53 is a flow chart related to the third embodiment of the method of controlling the operation of a cleaner.

First, after the cleaner starts being operated by the user and the like (S61), an electrical signal may be continuously output from at least one of the first detection part and the second detection part for a predetermined amount of time or longer (YES to S62). Here, the first detection part 23 may include a movement detection sensor described above, and the second detection part 24 may include a rotation detection sensor described above.

When an electrical signal is continuously output from at least one of the first detection part and the second detection part for a predetermined amount of time, the control part may determine a failure or a malfunction of the handle has occurred and block the operation of the driving part of the cleaner by a method such as blocking the current applied to the driving part (S63). Here, the predetermined amount of time may be randomly decided by the system designer. For example, the predetermined amount of time may be the amount of time randomly selected by the system designer between 0.5 seconds and 2 seconds.

On the other hand, when a signal output by the first detection part and the second detection part is output only within the predetermined amount of time, e.g. when the signal is output only within 0.5 seconds, the control part may determine that the cleaner is not malfunctioning and allow the cleaner to maintain the current operation (S64).

When an electrical signal is continuously output from at least one of the first detection part and the second detection part for the predetermined amount of time, and the output of the electrical signal is stopped or a new electrical signal is output by the first detection part and the second detection part while the control part is blocking the operation of the driving part (YES to S65), the operation of the driving part of the cleaner may be resumed. In this case, the control part may control the operation of the driving part of the cleaner according to the electrical signal that was previously output by the first detection part and the second detection part or may also control the operation of the driving part of the cleaner according to the new electrical signal output by the first detection part and the second detection part (S66).

When there is no change in the electrical signal (NO to S65), the control part may maintain the state of blocking the operation of the driving part and wait (S67).

Hereinafter, a method of controlling the operation of a cleaner according to a fourth embodiment of the present disclosure will be described.

Figure 54:
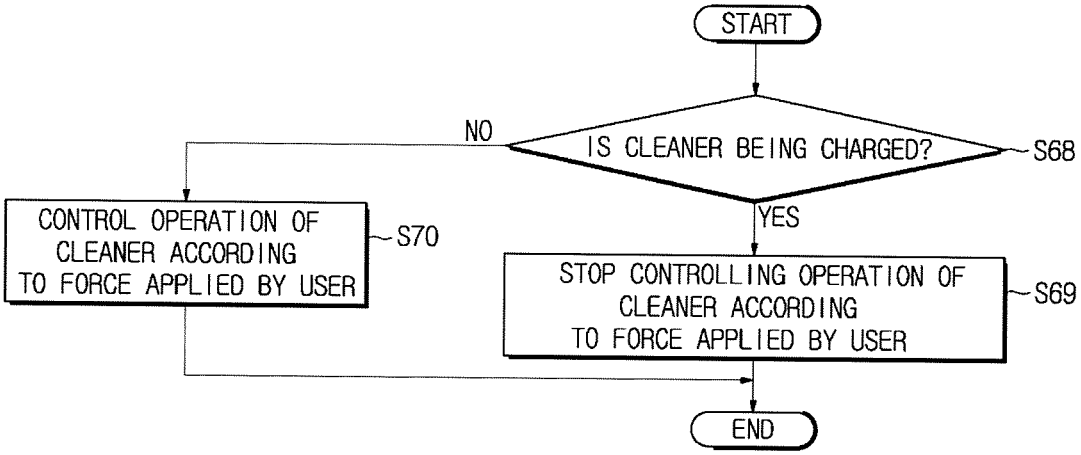
FIG. 54 is a flow chart related to a fourth embodiment of a method of controlling an operation of a cleaner.

FIG. 54 is a view illustrating a flow chart related to the fourth embodiment of the method of controlling the operation of a cleaner.

A control part may determine whether a cleaner is being charged (S68). Here, the cleaner may be a wireless cleaner that uses a storage battery as a power source.

When the cleaner is being charged, the control part stops the controlling of the operation of the cleaner according to the force of the user applied (S69). In other words, when the cleaner is being charged, the control part may ignore even when any electrical signal is input by the first detection part and the second detection part.

In the case when the cleaner is not being charged, the control part may control the operation of the driving part according to the force applied by the user detected by the first detection part and the second detection part in order to control the operation of the cleaner (S70).

Hereinafter, a method of controlling the operation of a cleaner according to a fifth embodiment of the present disclosure will be described.

Figure 55:
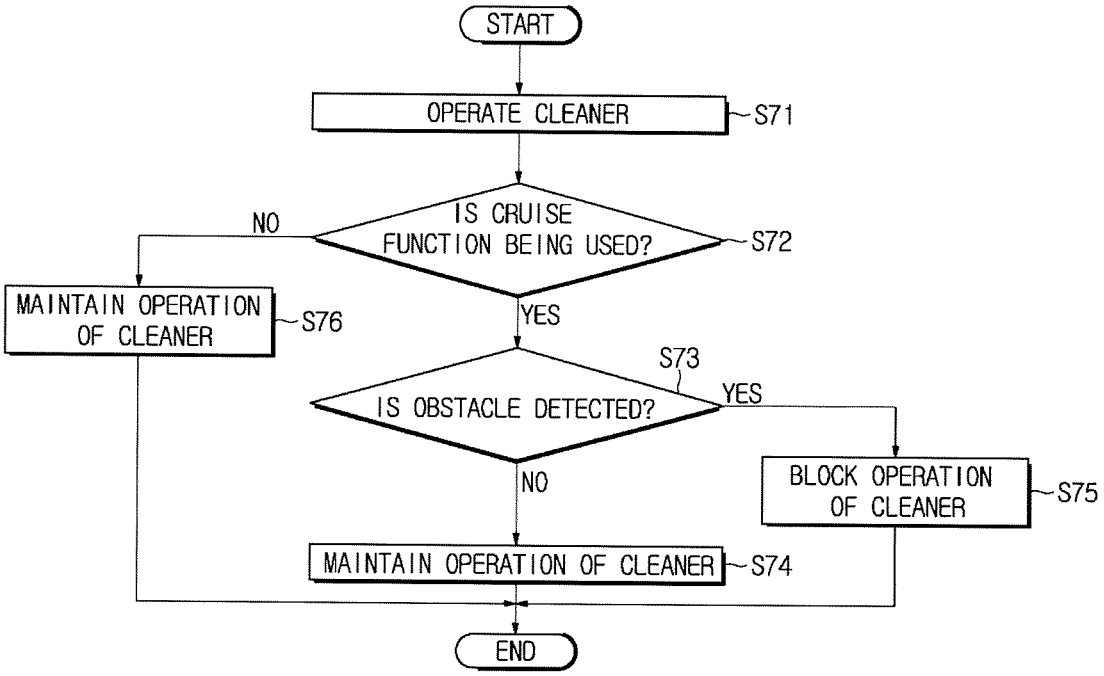
FIG. 55 is a flow chart related to a fifth embodiment of a method of controlling an operation of a cleaner.

FIG. 55 is a flow chart related to the fifth embodiment of the method of controlling the operation of a cleaner.

When a cleaner is operated (S71), a cruise function may be used according to the user's choice (S72). The cruise function represents controlling the cleaner to be moved at a predetermined speed according to the user's choice or predefined settings.

When an obstacle on a movement path is detected by an obstacle detection sensor while the cruise function is being used, the control part may stop the operation of the driving part by a method such as blocking the current applied to the driving part. Accordingly, when an obstacle is present on the movement path, the cleaner may be prevented from colliding against the obstacle.

When an obstacle is not detected, the operation of the cleaner may be maintained (S74).

Meanwhile, when the cruise function is not being used, the operation of the cleaner may be maintained regardless of the cruise function (S76).

Hereinafter, a method of controlling the operation of a cleaner according to a sixth embodiment of the present disclosure will be described.

Figure 56:
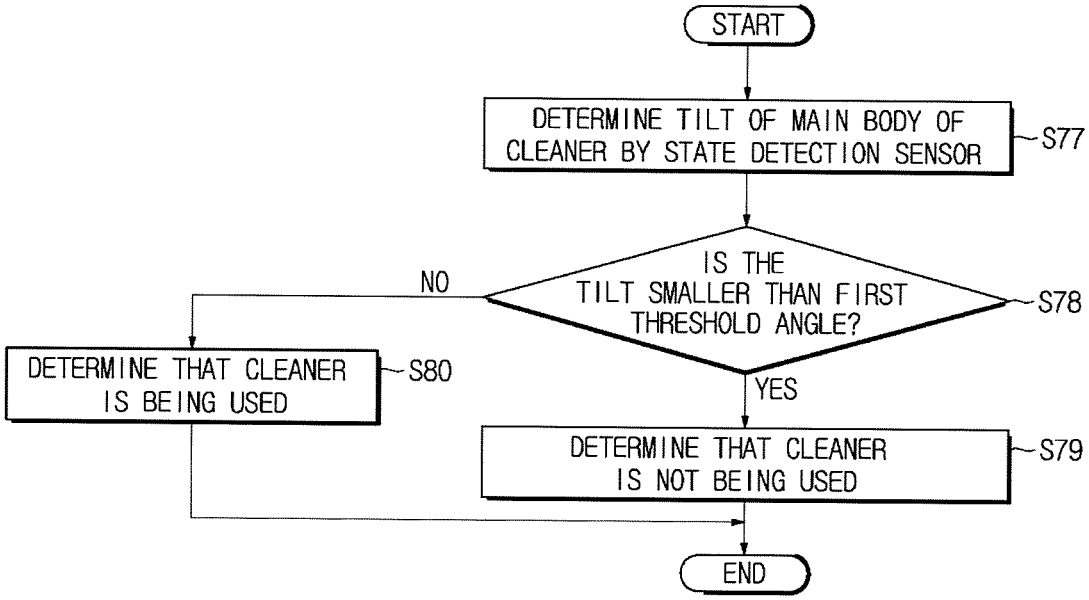
FIG. 56 is a flow chart related to the sixth embodiment of a method of controlling an operation of a cleaner.

FIG. 56 is a flow chart related to the sixth embodiment of the method of controlling the operation of a cleaner.

Referring to FIG. 56, a state detection sensor may detect a tilt of the main body of a cleaner and transmit the result of detection to a control part (S77). Here, the tilt of the main body represents the extent to which the main body is tilted from the normal line of a reference surface, and the reference surface may include the ground or the floor surface of the cleaning tool assembly 1420.

The control part may determine whether the tilt is smaller or larger than a first threshold angle (S78), determine that the main body is upright perpendicular to or nearly perpendicular to the ground when the tilt is smaller than the first threshold angle, and determine that the cleaner is not being used (S79). Here, the first threshold value may be a value randomly selected by the system designer. For example, the first threshold value may be 30°.

Conversely, when the tilt is larger than the first threshold value, the control part may determine that the main body is tilted to some extent and accordingly determine that the cleaner is currently being used (S80).

Hereinafter, a method of controlling the operation of a cleaner according to a seventh embodiment of the present disclosure will be described.

Figure 57:
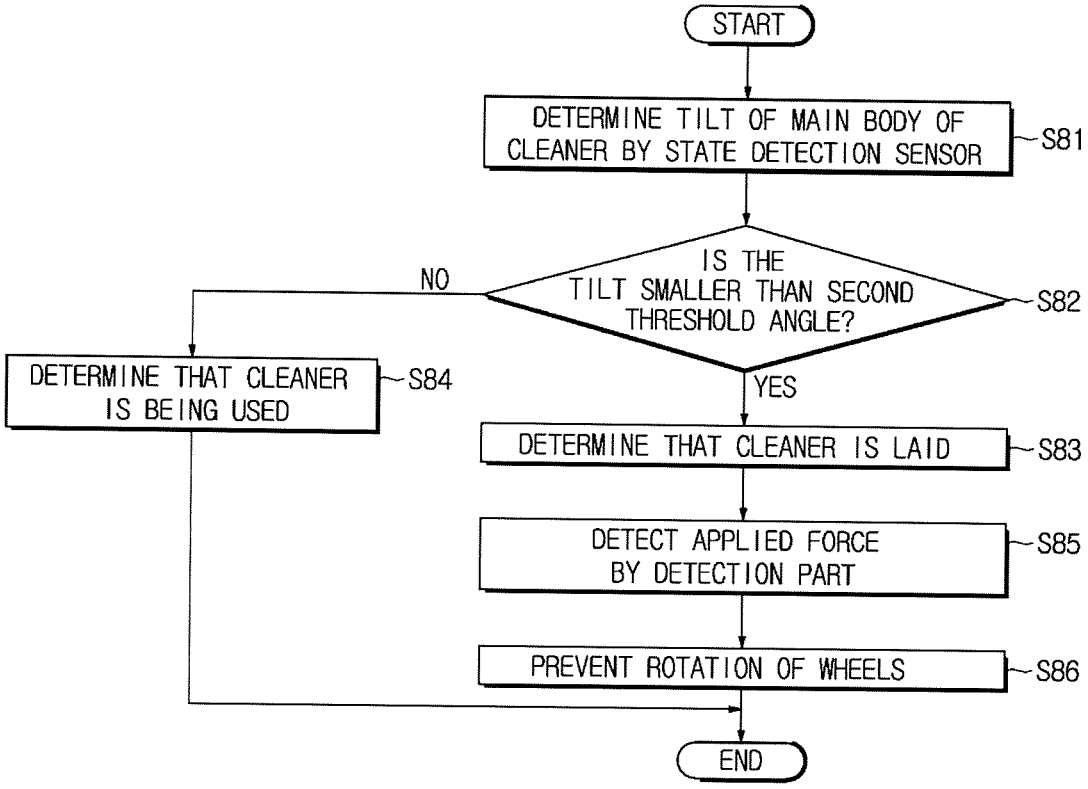
FIG. 57 is a flow chart related to the seventh embodiment of the method of controlling the operation of a cleaner.

FIG. 57 is a flow chart related to the seventh embodiment of the method of controlling the operation of a cleaner.

A state detection sensor detects a tilt of the main body of a cleaner (S81). As described above, the tilt of the main body represents the extent to which the main body is tilted from the normal line of a reference surface, and the reference surface may include the ground or the floor surface of the cleaning tool assembly 1420.

The control part may determine whether the tilt is smaller or larger than a second threshold angle (S82), determine that the cleaner is laid on the ground and the like when the tilt is larger than the second threshold angle (S83), or determine that the cleaner is being used since the cleaner is upright at an angle of some degrees when the tilt is smaller than the second threshold value (S84). Here, the second threshold value may be a value randomly selected by the system designer. For example, the second threshold value may be any value between 80° and 90°.

On the other hand, when the cleaner is determined to be laid, even when at least one of the first detection part and the second detection part detects a force applied (S85), the control part ignores an electrical signal transmitted thereto, thus preventing the wheels from rotating due to an abnormal manipulation of the handle part (S86).

In the above, particular embodiments have been illustrated and described. However, the present disclosure is not limited to the embodiments mentioned above, and those of ordinary skill in the art to which the present disclosure pertains will be able to modify and practice the present disclosure in various ways without departing from the technical gist of the disclosure described by the claims below.

The invention claimed is:

1. A cleaner comprising:

a main body;

a brush assembly including a housing connected to the main body and a set of wheels configured to be movable in at least one direction;

a handle part connected to the main body and configured to receive an applied force of a user, wherein the handle part includes:

a body part;

a cap part disposed to be spaced apart from the body part;

a guide part disposed between the body part and the cap part; and a sliding part slidably installed at the guide part and configured to straightly move and rotationally move relative to the guide part between the body part and the cap part;

a detection part provided in the handle part and configured to detect a magnitude and a direction of the applied force to the sliding part; and a control part configured to decide a rotational speed and a rotation amount of a plurality of wheels in the set of wheels using at least one of the direction and the magnitude of the applied force.

2. The cleaner of claim 1, wherein the detection part includes:

a first detection part configured to detect a straight-line movement force corresponding to a straight-line movement of the sliding part; and a second detection part configured to detect a rotational movement force corresponding to a rotational movement of the sliding part.

3. The cleaner of claim 2, wherein:

the handle part further includes a first holder part connected to the sliding part and configured to receive the straight-line movement force and the rotational movement force of the sliding part and a second holder part connected to the first holder part and configured to receive the rotational movement force transmitted to the first holder part;

the first detection part includes a linear potentiometer connected to the first holder part and configured to have a resistance value changed when the first holder part moves by the straight-line movement force transmitted to the sliding part; and the second detection part includes a rotational potentiometer connected to the second holder part and configured to have a resistance value changed when the first holder part and the second holder part move by the rotational movement force transmitted to the sliding part.

4. The cleaner of claim 2, wherein the handle part further includes:

a first elastic part configured to move the sliding part to an initial position when the straight-line movement force is applied; and a second elastic part configured to move the sliding part to the initial position when the rotational movement force is applied.

5. A cleaner comprising:

a main body;

a brush assembly including a housing connected to the main body and a set of wheels configured to be movable with respect to a surface to be cleaned;

a handle part connected to the main body, configured to be graspable, and configured to relatively move with respect to the main body, wherein the handle part includes:

a control part configured to be graspable; and a guide part configured to guide forward-to-back and side-to-side movements of the control part relative to the guide part; and a driving module configured to control a movement speed of the set of wheels and a rotation amount of the set of wheels relative to the main body such that the movement speed and the rotation amount are controlled to vary according to a relative movement amount of the handle part, wherein the guide part includes:

a rotation guide part configured to relatively rotate with respect to the main body; and a movement guide part formed by being bent and extending from the rotation guide part and configured such that the control part is movable with respect to the main body.

6. The cleaner of claim 5, wherein:

the control part includes a control body formed to surround at least a portion of the movement guide part and formed to be movable along an outer circumferential surface of the movement guide part and a control holder protruding from an inner circumferential surface of the control body;

the movement guide part includes a resistor longitudinally formed along a movement direction of the control part;

a displacement member coupled to the control holder and configured to be movable along an upper portion of the resistor together with the control holder in order to adjust a resistance value of the resistor; and at least one movement restoring elastic member configured to elastically press the displacement member so that the displacement member moves to an original position.

7. The cleaner of claim 5, wherein:

the movement guide part includes a pair of movement limiting members configured to selectively come in contact with both sides of a movement direction of a control holder and to prevent a movement within a predetermined section; and the cleaner further comprises at least one movement restoring elastic member including a pair of movement restoring elastic members configured to press end portions of the pair of movement limiting members toward the control holder.

8. The cleaner of claim 5, wherein:

the main body includes a sloped part disposed at a portion where the rotation guide part is, rotatably coupled to face the rotation guide part, and configured to have a pair of sloped surfaces formed to be symmetrical to each other; and the rotation guide part includes a steering unit configured to relatively rotate with respect to the main body together with the rotation guide part and to straightly move elastically inside the rotation guide part, wherein one end portion of the steering unit is configured to be movable along the sloped part.

9. The cleaner of claim 8, wherein:

the sloped part includes a first sloped surface, a second sloped surface symmetrical to the first sloped surface, and an inflected part where the first sloped surface and the second sloped surface meet; and the steering unit is configured to move along the first sloped surface or the second sloped surface by an external force and to be disposed at the inflected part when the external force is released.

10. The cleaner of claim 8, wherein:

the rotation guide part includes a steering holder configured to guide a movement of the steering unit; and the steering holder includes a pair of holder stoppers configured to limit a rotation of the steering unit to be within a predetermined section.

* * * * *